US009348245B2

(12) United States Patent
Morita et al.

(10) Patent No.: US 9,348,245 B2
(45) Date of Patent: May 24, 2016

(54) TONER, METHOD FOR PRODUCING THE TONER, TWO-COMPONENT DEVELOPER, AND IMAGE FORMING APPARATUS

(71) Applicants: Tatsuya Morita, Kanagawa (JP); Kazumi Suzuki, Shizuoka (JP); Shingo Sakashita, Shizuoka (JP); Masana Shiba, Shizuoka (JP); Taichi Nemoto, Shizuoka (JP); Yoshitaka Yamauchi, Shizuoka (JP); Azumi Miyaake, Shizuoka (JP); Rintaro Takahashi, Kanagawa (JP)

(72) Inventors: Tatsuya Morita, Kanagawa (JP); Kazumi Suzuki, Shizuoka (JP); Shingo Sakashita, Shizuoka (JP); Masana Shiba, Shizuoka (JP); Taichi Nemoto, Shizuoka (JP); Yoshitaka Yamauchi, Shizuoka (JP); Azumi Miyaake, Shizuoka (JP); Rintaro Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 14/373,984

(22) PCT Filed: Mar. 7, 2013

(86) PCT No.: PCT/JP2013/057114

§ 371 (c)(1),
(2) Date: Jul. 23, 2014

(87) PCT Pub. No.: WO2013/137368

PCT Pub. Date: Sep. 19, 2013

(65) Prior Publication Data

US 2015/0037718 A1 Feb. 5, 2015

(30) Foreign Application Priority Data

Mar. 13, 2012 (JP) ..... 2012-055842
Sep. 18, 2012 (JP) ..... 2012-205085

(51) Int. Cl.
*G03G 9/08* (2006.01)
*G03G 9/087* (2006.01)
*G03G 15/08* (2006.01)

(52) U.S. Cl.
CPC ..... *G03G 9/0825* (2013.01); *G03G 9/0821* (2013.01); *G03G 9/08755* (2013.01);
(Continued)

(58) Field of Classification Search
CPC ..... G03G 9/0825; G03G 9/08755; G03G 9/08764
USPC ..... 430/110.1, 109.4, 109.1
See application file for complete search history.

(56) References Cited

U.S. PATENT DOCUMENTS 5,968,701 A 10/1999 Onuma et al.
6,677,097 B2 1/2004 Ohmura et al.

(Continued)

FOREIGN PATENT DOCUMENTS

EP 0 926 565 A1 6/1999
EP 1 901 127 A1 3/2008

(Continued)

OTHER PUBLICATIONS

English language machine translation of JP 2012-155121 (Aug. 2012).*

(Continued)

*Primary Examiner* — Christopher Rodee
(74) *Attorney, Agent, or Firm* — Oblon, McClelland, Maier & Neustadt, L.L.P.

(57) ABSTRACT

A toner, including: a crystalline resin; a non-crystalline resin; and a colorant, wherein the toner has a sea-island structure which includes a sea containing the crystalline resin and an island containing the non-crystalline resin and the colorant, wherein the island is 1.0 μm or less in domain diameter, and wherein the toner is $1.7\times10^4$ Pa or less in storage elastic modulus at 160° C.

14 Claims, 5 Drawing Sheets

(52) U.S. Cl.
CPC ..... *G03G9/08757* (2013.01); *G03G 9/08764* (2013.01); *G03G 9/08788* (2013.01); *G03G 9/08795* (2013.01); *G03G 9/08797* (2013.01); *G03G 15/08* (2013.01)

(56) References Cited

U.S. PATENT DOCUMENTS

| | | | | |
|---|---|---|---|---|
| 7,052,815 | B2 | 5/2006 | Sawada et al. | |
| 7,379,696 | B2 | 5/2008 | Sawada et al. | |
| 2001/0046636 | A1 | 11/2001 | Daimon et al. | |
| 2004/0115551 | A1 | 6/2004 | Sugiyama et al. | |
| 2005/0277046 | A1 | 12/2005 | Sawada et al. | |
| 2009/0068578 | A1 | 3/2009 | Murakami et al. | |
| 2009/0291377 | A1* | 11/2009 | Hirose | G03G 9/0906 430/97 |
| 2011/0177447 | A1 | 7/2011 | Suzuki et al. | |
| 2012/0282000 | A1 | 11/2012 | Nakayama et al. | |
| 2014/0356780 | A1* | 12/2014 | Kawamura | G03G 9/0804 430/109.3 |
| 2015/0220011 | A1* | 8/2015 | Miyaake | G03G 9/0821 430/105 |

FOREIGN PATENT DOCUMENTS

| | | | |
|---|---|---|---|
| JP | 63-038955 | | 2/1988 |
| JP | 04-024702 | | 4/1992 |
| JP | 04-024703 | | 4/1992 |
| JP | 2001-222137 | | 8/2001 |
| JP | 3360527 | | 12/2002 |
| JP | 2004-046095 | | 2/2004 |
| JP | 2005-062511 | | 3/2005 |
| JP | 2005-77833 | A | 3/2005 |
| JP | 2005-338814 | | 12/2005 |
| JP | 2006-018018 | | 1/2006 |
| JP | 2006-84953 | A | 3/2006 |
| JP | 2006-330767 | | 12/2006 |
| JP | 3910338 | | 4/2007 |
| JP | 3949526 | | 7/2007 |
| JP | 4079257 | | 4/2008 |
| JP | 2010-014833 | | 1/2010 |
| JP | 2010-077419 | | 4/2010 |
| JP | 4513627 | | 7/2010 |
| JP | 2011-150043 | | 8/2011 |
| JP | 2011-203704 | | 10/2011 |
| JP | 4929411 | | 5/2012 |
| JP | 2012155121 | A * | 8/2012 |
| WO | WO 2009/122687 | A1 | 10/2009 |
| WO | WO 2012/011546 | A1 | 1/2012 |
| WO | WO 2014/038645 | A1 | 3/2014 |

OTHER PUBLICATIONS

Extended European Search Report issued Feb. 24, 2015 in Patent Application No. 13761618.1.

International Search Report and Written Opinion of the International Searching Authority Issued May 21, 2013 for counterpart International Patent Application No. PCT/JP2013/057114 filed Mar. 7, 2013.

Office Action dated Jan. 15, 2016, in Korean Patent Application No. 10-2014-7024878 (with English Translation).

* cited by examiner

TONER, METHOD FOR PRODUCING THE TONER, TWO-COMPONENT DEVELOPER, AND IMAGE FORMING APPARATUS

TECHNICAL FIELD

The present invention relates to a toner, a method for producing the same, a two-component developer, and an image forming apparatus.

BACKGROUND ART

Conventionally, in an electrophotographic image forming apparatus and others, a latent image which is electrically or magnetically formed is made apparent by an electrophotographic toner (hereinafter, simply referred to as "toner"). For example, in an electrophotographic method, an electrostatic image (latent image) is formed on a photoconductor, and the latent image is then developed by toners to form a toner image. The toner image is usually transferred on a transfer material such as paper and then fixed on the transfer material such as paper. In a fixing step during which the toner image is fixed on transfer paper, heat fixing methods such as a heating roller fixing method and a heating belt fixing method have been widely used due to an excellent energy efficiency thereof.

In recent years, there have been increasing demands from the market for higher speeds and greater energy saving of image forming apparatuses. Accordingly, a toner excellent in lower-temperature fixing property and also capable of providing high quality images is demanded. In order to realize lower-temperature fixing property of the toner, it is necessary to lower a softening temperature of the binding resin of the toner. However, if the binding resin is low in softening temperature of the binding resin, so-called offset (hereinafter, also referred to as "hot offset") may easily occur in which a toner image partially adheres to the surface of a fixing member when fixing and the thus adhered image is then transferred on copier paper. Further, so-called blocking will take place in which the toner is lowered in heat-resistant storage stability and toner particles are fused to each other particularly in a high temperature environment. In addition, there have been found such problems that in a developing device, a toner is fused inside the developing device and a carrier to contaminate and toner filming easily occurs on the surface of a photoconductor.

Such technologies for solving the above problems are known such as using a crystalline resin as a binding resin of a toner. That is, the crystalline resin is able to soften rapidly at a melting point of resin and therefore able to lower a softening temperature of toner close to the melting point, while securing the heat-resistant storage stability at a temperature lower than the melting point. Therefore, it is possible to attain the heat-resistant storage stability and lower-temperature fixing property at the same time.

As a toner which uses a crystalline resin, there is disclosed, for example, a toner using as a binding resin a crystalline resin which is prepared by elongating crystalline polyester with diisocyanate (refer to PTLs 1 and 2).

Further, such a toner is proposed that uses a crystalline resin with a crosslinked structure by unsaturated bonding containing a sulfonic group (refer to PTL 3). This toner has been improved in hot offset resistance as compared with conventional arts. There is also disclosed a technology in which a ratio of softening temperature to peak temperature of fusion heat and viscoelastic characteristics are specified to produce resin particles which are excellent in lower-temperature fixing property and heat-resistant storage stability (refer to PTL 4).

There is also disclosed a technology in which a crystalline resin is specified for durometer hardness and inorganic fine particles are contained into a toner to improve stress resistance of the toner (refer to PTL 5).

On the other hand, unlike the above-described known technologies in which a crystalline resin is used as a major composition of a binding resin, there are disclosed many technologies in which a crystalline resin and a non-crystalline resin are used in combination (for example, refer to PTLs 6 and 7).

However, a pigment contained in a toner may be unevenly distributed on the surface of the toner or may produce a large aggregate due to compatibility with a material used. Therefore, for example, as disclosed in PTL 8, such a method is commonly employed that a pigment dispersing agent is used to uniformly disperse the pigment inside the toner.

However, many of the pigment dispersing agents are non-crystalline. Where a crystalline resin is contained and in particular where the crystalline resin is used as a main binder, compatibility is poor, thus resulting in a situation that a pigment and a dispersing agent thereof produce a large aggregate or are unevenly distributed on the surface of the toner. As a result, an effect that the pigment is uniformly dispersed inside the toner is not obtained but the pigment on the surface of the toner adversely influences the charging property of the toner. Thus, defects occur in a machine when developing or transferring, which causes poor images such as blushing.

As described above, where a crystalline resin is used as a binding resin of a toner, even if fixing temperature, heat-resistant storage stability and stress resistance can be improved, the state of the pigment contained therein cannot be favorably improved. As a result, the toner is insufficient in quality for use.

Further, where a crystalline resin is used as a binding resin, such a problem is posed that a pigment is lowered in dispersion property to result in reduced image density. For example, there is proposed such a toner with base particles that is produced through a step in which, for example, a binding resin containing at least polyester soluble in an organic solvent as a major composition, a colorant master batch containing a colorant and a coloring-agent dispersing resin, and a toner composition liquid in which a mold releasing agent is dissolved or dispersed in the organic solvent are emulsified or dispersed in an aqueous medium in which, fine resin particles are dispersed (refer to PTL 9). In this proposal, as a coloring-agent dispersing resin, used is a poorly soluble polyester having an amide bond structure the weight-average molecular weight (Mw) of which is 5000 or more but 50,000 or less. Further, as a binding resin, the toner contains crystalline polyester which is poorly soluble in an organic solvent. Nevertheless, it is desired to further improve an image gloss level.

CITATION LIST

Patent Literature

PTL 1: Japanese Patent Application Publication (JP-B) No. 04-024702
PTL 2: JP-B No. 04-024703
PTL 3: Japanese Patent (JP-B) No. 3910338
PTL 4: Japanese Patent Application Laid-Open (JP-A) No. 2010-077419
PTL 5: JP-B No. 3360527
PTL 6: JP-B No. 3949526

PTL 7: JP-B No. 4513627
PTL 8: JP-B No. 4079257
PTL 9: JP-A No. 2011-203704

SUMMARY OF INVENTION

Technical Problem

An object of the present invention is to provide a toner which is excellent in hot offset resistance and image gloss level, a method for producing the toner, a two-component developer containing the toner, and an image forming apparatus which uses the developer.

Solution to Problem

A toner of the present invention as means for solving the above-described problems includes: a crystalline resin; a non-crystalline resin; and a colorant, wherein the toner has a sea-island structure which includes: a sea containing the crystalline resin; and an island containing the non-crystalline resin and the colorant, wherein the island is 1.0 μm or less in domain diameter, and wherein the toner is $1.7\times10^4$ Pa or less in storage elastic modulus at 160° C.

Advantageous Effects of Invention

The present invention is able to provide a toner which is excellent in hot offset resistance and image gloss level, a method for producing the toner, a two-component developer containing the toner, and an image forming apparatus which uses the developer.

BRIEF DESCRIPTION OF DRAWINGS

FIG. 7B is a view in which FIG. 7A is curve fitted.

DESCRIPTION OF EMBODIMENTS (Toner)

Figure 1:
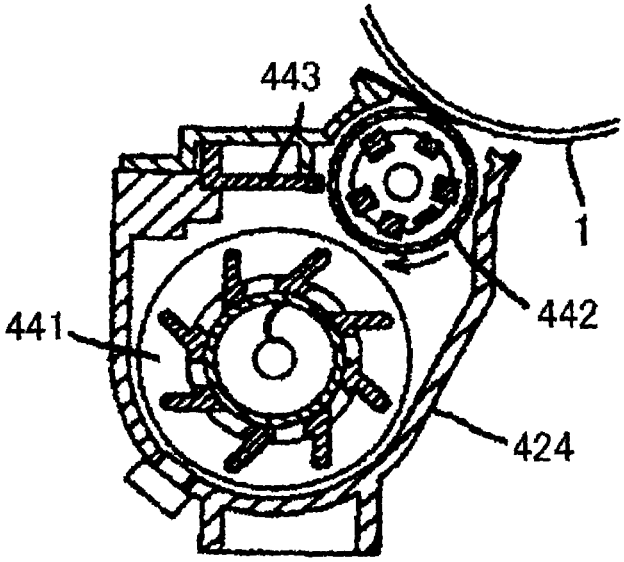
FIG. 1 is a schematic view which shows one example of a development unit used in an image forming apparatus of the present invention.

A toner of the present invention contains a crystalline resin, a non-crystalline resin and a colorant, and also contains other components as appropriate.

A binding resin contains the crystalline resin and the non-crystalline resin and also contains other resins as appropriate.

The toner has a sea-island structure which includes: a sea containing the crystalline resin; and an island containing the non-crystalline resin and the colorant, wherein the island is 1.0 μm or less in domain diameter, and wherein the toner is $1.7\times10^4$ Pa or less in storage elastic modulus at 160° C.

The island is 1.0 μm or less in domain diameter and preferably 50 nm to 200 nm. Where the domain diameter of the island exceeds 1.0 μm, an image gloss level may decrease. Where the domain diameter is less than 50 nm, production of the toner may be difficult.

Here, a dispersion state of the colorant in the toner and the sea-island structure can be confirmed by observing the cross section of the toner, for example, by use of a transmission electron microscope (TEM). At this time, when ruthenium tetraoxide is used to dye the non-crystalline resin, it is possible to give contrast.

The toner is $1.7\times10^4$ Pa or less in storage elastic modulus at 160° C., preferably $1.0\times10^3$ Pa to $1.6\times10^4$ Pa, and more preferably $5.0\times10^3$ Pa to $1.0\times10^4$ Pa. Where the storage elastic modulus of the toner at 160° C. is less than $1.0\times10^3$ Pa, the toner may be lowered in hot offset resistance. Where the storage elastic modulus exceeds $1.7\times10^4$ Pa, the image gloss level will decrease.

The storage elastic modulus of the toner at 160° C. can be measured by using, for example, a dynamic viscoelastic measurement device.

There is no particular restriction on content of the crystalline resin in the binding resin, and any content can be appropriately selected depending on the purpose. The content is preferably 50% by mass or more, more preferably 65% by mass or more, still more preferably 80% by mass or more, and in particular preferably 95% by mass or more.

Where the content of the crystalline resin in the binding resin is less than 50% by mass, it may be difficult to attain the lower-temperature fixing property and heat-resistant storage stability of the toner at the same time.

It is possible to use two or more crystalline resins in combination. For example, a first crystalline resin and a second crystalline resin greater in weight-average molecular weight Mw than the first crystalline resin are used in combination, thus making it possible to expand the molecular weight distribution of the toner as a whole. Impregnation of a low molecular weight resin into paper and suppression of hot offset by a high molecular weight resin can be attained at the same time, which is preferable. A modified crystalline resin may be used as the second crystalline resin and subjected to elongation or crosslinking reaction in the process of producing the toner.

In this case, a crystalline resin used for pigment surface treatment is fused and kneaded on surface treatment. It is, therefore, preferable to use the first crystalline resin which is closer in fusing temperature and viscosity. Where the second crystalline resin greater in weight-average molecular weight Mw is used to give surface treatment to the pigment, no sufficient mixture of the crystalline resin, the non-crystalline resin and the pigment is attained, due to a difference in fusing temperature and viscosity between the non-crystalline resin. In addition, no sufficient shearing force is applied on kneading, thus resulting in an aggregation state of pigment particles in the colorant. As a result, the pigment is aggregated or unevenly distributed inside the toner, which causes deterioration in the color reproduction range of an image and an adverse, influence on the fixing property.

There is no particular restriction on a maximum peak temperature of fusion heat of the crystalline resin, and any temperature can be appropriately selected depending on the purpose. However, in terms of attaining the lower-temperature fixing property and heat-resistant storage stability at the same time, the temperature is preferably 45° C. to 70° C., more preferably 53° C. to 65° C., and in particular preferably 58° C. to 62° C. Where the maximum peak temperature is less than 45° C., the lower-temperature fixing property becomes favorable but the heat-resistant storage stability may be deteriorated. On the other hand, where the maximum peak temperature exceeds 70° C., the heat-resistant storage stability becomes favorable but the lower-temperature fixing property may be deteriorated.

There is no particular restriction on a ratio of softening temperature of the crystalline resin to a maximum peak temperature of fusion heat (softening temperature/maximum peak temperature of fusion heat), and any ratio can be appropriately selected depending on the purpose. The ratio is preferably 0.8 to 1.55, more preferably 0.85 to 1.25, still more preferably 0.9 to 1.2, and in particular preferably 0.9 to 1.19. As the ratio (softening temperature/maximum peak temperature of fusion heat) becomes smaller, a resin is disposed to soften more abruptly. This is desirable in terms of attaining the lower-temperature fixing property and the heat-resistant storage stability at the same time.

There is no particular restriction on a storage elastic modulus G' at a (maximum peak temperature of fusion heat)+20° C. with regard to viscoelastic characteristics of the crystalline resin, and any storage elastic modulus can be appropriately selected depending on the purpose. The storage elastic modulus is preferably $5.0\times10^6$ Pa·s or less, more preferably $1.0\times10^1$ Pa·s to $5.0\times10^5$ Pa·s, and still more preferably $1.0\times10^1$ Pa·s to $1.0\times10^4$ Pa·s.

Further, there is no particular restriction on a loss elastic modulus G" at a (maximum peak temperature of fusion heat)+20° C. and any loss elastic modulus can be appropriately selected depending on the purpose. The loss elastic modulus is preferably $5.0\times10^6$ Pa·s or less, more preferably $1.0\times10^1$ Pa·s to $5.0\times10^5$ Pa·s and still more preferably $1.0\times10^1$ Pa·s to $1.0\times10^4$ Pa·s. Regarding viscoelastic characteristics of the toner of the present invention, values of G' and G" at a (maximum peak temperature of fusion heat)+20° C. which are preferably $1.0\times10^3$ Pa·s to $5.0\times10^6$ Pa·s are preferable in terms of the fixing intensity and hot offset resistance. When consideration is given to the fact that a colorant is dispersed in a binding resin to raise the G' and G", viscoelastic characteristics of the crystalline resin are preferable in the above-described range.

The viscoelastic characteristics of the crystalline resin can be realized by adjusting a ratio of crystalline monomer to non-crystalline monomer which constitute a resin, a molecular weight of the resin and others. For example, an increase in the percentage of the crystalline monomer will lower a value of G' (Ta+20).

Dynamic viscoelastic characteristic values (storage elastic modulus G' and loss elastic modulus G") of the resin and the toner can be measured by using a dynamic viscoelastic measurement device (for example, ARES (made by TA Instruments Japan Inc.). Measurement is made under conditions of a frequency of 1 Hz. That is, the measurement can be made in such a manner that a sample is made into a pellet which is 8 mm in diameter and 1 mm to 2 mm in thickness and fixed on a parallel plate which is 8 mm in diameter, thereafter, the pellet is made stable at 40° C. and heated up to 200° C. at a temperature rising rate of 2.0° C./minute under conditions that the frequency is 1 Hz (6.28 rad/s) and distortion amount is 0.1% (distortion amount control mode).

There is no particular restriction on weight-average molecular weight Mw of the crystalline resin, and any weight-average molecular weight can be appropriately selected depending on the purpose. In terms of the fixing property, the weight-average molecular weight is preferably 2,000 to 100,000, more preferably 5,000 to 60,000, and in particular preferably 8,000 to 30,000. Where the weight-average molecular weight is less than 2,000, the hot offset resistance tends to deteriorate. Where the weight-average molecular weight exceeds 100,000, the lower-temperature fixing property tends to deteriorate.

The weight-average molecular weight Mw of the crystalline resin can be measured by, for example, a gel permeation chromatography (GPC) such as GPC-8220 GPC (made by Tosoh Corporation). As a column, there a triple column of TSKgel Super HZM-H 15 cm in length (made by Tosoh Corporation) is used. A resin to be measured is dissolved with tetrahydrofuran (THF) containing a stabilizing agent (made by Wako Pure Chemical Industries Ltd.) to give a solution of 0.15% by mass. After the solution is filtered by using a 0.2 μm filter, a filtrate thereof is used as a sample. The thus prepared THF sample solution is fed into a measuring device in a quantity of 100 μL and measured at a temperature of 40° C. at a flow rate of 0.35 mL/minute. The molecular weight of the sample can be measured by referring to a relationship between a logarithm and a count number of a calibration curve prepared by several types of monodisperse polystyrene standard samples. The polystyrene standard samples include Std. No S-7300, S-210, S-390, S-875, S-1980, S-10.9, S-629, S-3.0 and S-0.580 (Showdex STANDARD made by Showa Denko K.K.) and toluene. As a detector, an RI (refraction index) detector can be used.

<<Polyester Resin>>

There is no particular restriction on the polyester resin, and any polyester resin can be appropriately selected depending on the purpose. The polyester resin includes, for example, a condensation polymerization polyester resin which is synthesized from polyol and polycarboxylic acid, a lactone ring-opening polymerization product, and polyhydroxy carboxylic acid. Of these substances, a condensation polymerization polyester resin with diol and dicarboxylic acid is preferable in terms of developing crystallinity.

—Polyol—

The polyol includes, for example, diols, trivalent to octavalent polyols and higher multivalent polyols.

There is no particular restriction on the diols, and any diol can be appropriately selected depending on the purpose. The diols include, for example, an aliphatic diol such as straight-chain aliphatic diol and branched aliphatic diol; alkylene ether glycol having the carbon number of 4 to 36; alicyclic diol having the carbon number of 4 to 36; alkylene oxide of the alicyclic diol (hereinafter, abbreviated as AO); AO-adducts of bisphenols; polylactone diol; polybutadiene diol; diol having a carboxyl group, diol having a sulfonic group or a sulfamic acid group and diols having other functional groups such as salts thereof. They may be used solely or in combination of two or more of them. Of these substances, aliphatic diol having the chain carbon number of 2 to 36 is preferable, and straight-chain aliphatic diol is more preferable.

There is no particular restriction on content of the straight-chain aliphatic diol with respect to the diol as a whole, and any content can be appropriately selected depending on the purpose. The content is preferably 80 mol % or more, and more preferably 90 mol % or more. The content of 80 mol % or more is preferable, because a resin is improved in crystallinity, the lower-temperature fixing property and the heat-resistant storage stability can be favorably attained at the same time, and resin hardness tends to be improved.

There is no particular restriction on the straight-chain aliphatic diol, and any diol can be appropriately selected depending on the purpose. The straight-chain aliphatic diol includes, for example, ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol. They may be used solely or in combination of two or more of them. Of these substances, in terms of availability, preferable are ethylene glycol, 1,3-propane diol, 1,4-butane diol, 1,6-hexane diol, 1,9-nonane diol and 1,10-decane diol.

There is no particular restriction on the branched aliphatic diol having the chain carbon number of 2 to 36, and any branched aliphatic diol can be appropriately selected depending on the purpose. The branched alophatic diol includes, for example, 1,2-propylene glycol, butane diol, hexane diol, octane diol, decane diol, dodecane diol, tetradecane diol, neopentyl glycol, and 2,2-diethyl-1,3-propane diol.

There is no particular restriction on the alkylene ether glycol having the carbon number of 4 to 36, and any alkylene ether glycol can be appropriately selected depending on the purpose. The alkylene ethy glycol includes, for example, diethylene glycol, triethylene glycol, dipropylene glycol, polyethylene glycol, polypropylene glycol, and polytetramethylene ether glycol.

There is no particular restriction on the alicyclic diol having the carbon number of 4 to 36, and any alicyclic diol can be appropriately selected depending on the purpose. The alicyclic diol includes, for example, 1,4-cyclohexane dimethanol and hydrogenated bisphenol A.

There is no particular restriction on the alkylene oxide of the alicyclic diol (hereinafter, abbreviated as AO), and any alkylene oxide can be appropriately selected depending on the purpose. The alkylene oxide includes, for example, an adduct (the number of added moles: 1 to 30) such as ethylene oxide (hereinafter, abbreviated as EO), propylene oxide (hereinafter, abbreviated as PO) and butylenes oxide (hereinafter, abbreviated as BO).

There is no particular restriction on the bisphenols, and any bisphenol can be appropriately selected depending on the purpose. The bisphenols include, for example, AO (EO, PO, BO and others) adducts (the number of added moles: 2 to 30) such as bisphenol A, bisphenol F and bisphenol S.

There is no particular restriction on the polylactone diol, and any polylactone diol can be appropriately selected depending on the purpose. The polylactone diol includes, for example, poly ϵ-caprolactone diol.

There is no particular restriction on the diol having a carboxyl group, and any diol can be appropriately selected depending on the purpose. The diol includes, for example, dialkylol alkanoic acid having the carbon number of 6 to 24 such as 2,2-dimethylol propionic acid (DMPA), 2,2-dimethylol butanoic acid, 2,2-dimethylol heptanoic acid, and 2,2-dimethylol octanoic acid.

There is no particular restriction on the diol having a sulfonic group or a sulfamic acid group, and any diol can be appropriately selected depending on the purpose. The diol includes, for example, sulfamic acid diol such as N,N-bis(2-hydroxyethyl)sulfamic acid and N, or a N-bis(2-hydroxyethyl)sulfamic acid PO2 mole adduct, [N,N-bis(2-hydroxyalkyl)sulfamic acid (alkyl group having the carbon number of 1 to 6), or an AO-adduct thereof (EO or PO as AO, AO having the number of added moles from 1 to 6); and bis(2-hydroxyethyl)phosphate.

There is no particular restriction on a neutralizing base of the diol having the neutralizing base, and any neutralizing base can be appropriately selected depending on the purpose. The neutralizing base includes, for example, tertiary amine (such as triethyl amine) having the carbon number of 3 to 30 and alkaline metal (such as sodium salt).

Of these substances, preferable are alkylene glycol having the carbon number of 2 to 12, diol having a carboxyl group, AO-adducts of bisphenols, and combined use thereof.

Further, there is no particular restriction on the trivalent to octavalent and higher multivalent polyols, and any polyol can be appropriately selected depending on the purpose. The polyols include, for example, alkane polyol, intramolecular- or intermolecular-dehydrates thereof (for example, glycerine, trimethylolethane, trimethylolpropane, penta-erythritol, sorbitol, sorbitan and polyglycerine), trivalent to octavalent or higher multivalent aliphatic alcohols having the carbon number of 3 to 36 such as sugars and derivatives thereof (for example, sucrose and methylglucoside); AO adducts (the number of added moles from 2 to 30) of trisphenols (such as trisphenol PA); AO adducts (the number of added moles of 2 to 30) of novolac resins (such as phenol novolac and cresol novolac); and acrylpolyols such as copolymerization products of hydroxyethyl(meth)acrylate with other vinyl monomers. Of these substances, preferable are trivalent to octavalent or higher multivalent aliphatic alcohols and AO adducts of novolac resins, and more preferable are AO adducts of novolac resins.

—Polycarboxylic Acid—

There is no particular restriction on the polycarboxylic acid, and any polycarboxylic acid can be appropriately selected depending on the purpose. The polycarboxylic acid includes, for example, dicarboxylic acid, and trivalent to hexavalent or higher multivalent polycarboxylic acids.

There is no particular restriction on the dicarboxylic acid, and any dicaroxylic acid can be appropriately selected depending on the purpose. The dicarboxylic acid includes, for example, aliphatic dicarboxylic acids such as straight-chain aliphatic dicarboxylic acid and branched aliphatic dicarboxylic acid; and aromatic dicarboxylic acids. Of these substances, more preferable is straight-chain aliphatic dicarboxylic acid.

There is no particular restriction on the aliphatic dicarboxylic acid, and any aliphatic dicaroxylic acid can be appropriately selected depending on the purpose. The aliphatic dicarboxylic acid includes, for example, alkane dicarboxylic acids having the carbon number of 4 to 36 such as succinic acid, adipic acid, sebacic acid, azelaic acid, dodecane dicarboxylic acid, octadecane dicarboxylic acid and decylsuccinic acid; alkane dicarboxylic acids having the carbon number of 4 to 36, for example, alkenyl succinic acids such as dodecenyl succinic acid, pentadecenyl succinic acid and octadecenyl succinic acid, and maleic acid, fumaric acid, citraconic acid; and alicyclic dicarboxylic acids having the carbon number of 6 to 40 such as dimer acid (dimerized linoleic acid).

There is no particular restriction on the aromatic dicarboxylic acid, and any aromatic dicarboxylic acid can be appropriately selected depending on the purpose. The aromatic dicarboxylic acid includes, for example, aromatic dicarboxylic acids having the carbon number of 8 to 36 such as phthalic acid, isophthalic acid, terephthalic acid, t-butyl isophthalic acid, 2,6-naphthalene dicarboxylic acid, and 4,4'-biphenyl dicarboxylic acid.

Further, the trivalent to hexavalent or higher multivalent polycarboxylic acids used as appropriate include, for example, aromatic polycarboxylic acids having the carbon number of 9 to 20 such as trimellitic acid and pyromellitic acid.

It is noted that the dicarboxylic acid and the trivalent to hexavalent or higher multivalent polycarboxylic acids may include acid anhydrides of the above-described substances and lower alkylesters having the carbon number of 1 to 4 (such as methyl ester, ethyl ester and isopropyl ester).

Of the above-described dicarboxylic acid, it is in particular preferable that the aliphatic dicarboxylic acid (preferably, adipic acid, sebacic acid, dodecane dicarboxylic acid, terephthalic acid, isophthalic acid, and others) is used solely. Also preferably used is a copolymerization product of the aromatic dicarboxylic acid (preferably, terephthalic acid, isophthalic acid, t-butyl isophthalic acid or others; lower alkylesters of the aromatic dicarboxylic acid) with the aliphatic dicarboxylic acid.

There is no particular restriction on the degree of copolymerization with the aromatic dicarboxylic acid, and any degree can be appropriately selected depending on the purpose. The degree is preferably 20 mol % or less.

—Lactone Ring-Opening Polymerization Product—

There is no particular restriction on the lactone ring-opening polymerization product, and any lactone ring-opening polymerization product can be appropriately selected depending on the purpose. The lactone ring-opening polymerization product includes, for example, a lactone ring-opening polymerization product obtained by ring-opening polymerization of lactone such as a monolactone (the number of ester groups in a ring is one) having the carbon number of 3 to 12 such as β-propiolactone, γ-butyrolactone, δ-valerolactone and ϵ-caprolactone by using a catalysts such as metal oxide and an organic metal compound; and a lactone ring-opening polymerization product having a hydroxyl groups at its end and which is obtained by ring-opening polymerization of monolactones having the carbon number of 3 to 12 by using glycol (for example, ethylene glycol and diethylene glycol) as an initiator.

There is no particular restriction on the monolactone having the carbon number of 3 to 12, and any monolactone can be appropriately selected depending on the purpose. However, in terms of crystallinity, ϵ-caprolactone is preferable.

Further, as the lactone ring-opening polymerization product, commercially available products may be used. The commercially available products include, for example, highly crystalline polycaprolactone such as H1P, H4, 115 and H7 of PLACCEL Series made by Daicel Corporation.

—Polyhydroxy Carboxylic Acid—

There is no particular restriction on a method for preparing the polyhydroxy carboxylic acid, and any method can be appropriately selected depending on the purpose. The method includes, for example a method in which hydroxycarboxylic acid such as glycolic acid and lactic acid (L body, D body, racemic body and the like) is directly dehydrated and condensed, and a method in which cyclic ester (the number of ester groups in a ring is 2 or 3) having the carbon number of 4 to 12 corresponding to a dehydration condensation product between two or three molecules of hydroxycarboxylic acid such as glycolide and lactide (L body, D body, racemic body or the like) is subjected to ring-opening polymerization by using a catalyst such as a metal oxide and an organic metal compound. Of these methods, in terms of adjusting the molecular weight, the method for ring-opening polymerization is preferable.

Of the cyclic esters, in terms of crystallinity, preferable are L-lactide and D-lactide. Further, the polyhydroxy carboxylic acid may be modified so as to have a hydroxyl group or a carboxyl group at an end.

<<<Polyurethane Resin>>>

The polyurethane resin includes polyurethane resins which are synthesized from diol, polyol such as trivalent to octavalent or higher multivalent polyol, diisocyanate, and polyisocyanate such as trivalent or higher multivalent polyisocyanate. Of these resins, preferable is a polyurethane resin synethesized from the diol and the diisocyanate.

The diol and the trivalent to octavalent or higher multivalent polyol include those similar to the diol and the trivalent to octavalent or higher multivalent polyol given in the polyester resin.

—Polyisocyanate—

The polyisocyanate includes, for example, diisocyanate and trivalent or higher multivalent polyisocyanate.

There is no particular restriction on the diisocyanate, and any diisocyanate can be appropriately selected depending on the purpose. The diisocyanate includes, for example, aromatic diisocyanates, aliphatic diisocyanates, alicyclic diisocyanates, and aromatic and aliphatic diisocyanates. Of these substances, there are included aromatic diisocyanates having the carbon number of 6 to 20 excluding carbon in an NCO group, aliphatic diisocyanates having the carbon number of 2 to 18, alicyclic diisocyanates having the carbon number of 4 to 15, aromatic and aliphatic diisocyanates having the carbon number of 8 to 15, modified products of these diisocyanates (modified products containing urethane group, carbodiimide group, allophanate group, urea group, burette group, uretdione group, uretimine group, isocyanurate group, oxazolidone group, or the like) and a mixture of two or more of them. Further, trivalent or higher multivalent isocyanates may be used in combination, as appropriate.

There is no particular restriction on the aromatic diisocyanates, and any aromatic diisocyanate can be appropriately selected depending on the purpose. The aromatic diisocyanates include, for example, 1,3- and/or 1,4-phenylene diisocyanate, 2,4- and/or 2,6-tolylene diisocyanate (TDI), crude TDI, 2,4'- and/or 4,4'-diphenyl methane diisocyanate (MDI), crude MDI [a phosgenation product of crude diaminophenyl methane [formaldehyde and aromatic amine (aniline) or a condensation product with a mixture thereof; a mixture of diaminodiphenyl methane with a small quantity of tri- or higher functional polyamine (for example, 5% by mass to 20% by mass)]: polyallyl polyisocyanate (PAPI)], 1,5-naphthylene diisocyanate, 4,4',4"-triphenylmethane triisocyanate, and m- and p-isocyanate phenylsulfonyl isocyanate.

There is no particular restriction on the aliphatic diisocyanates, and any aliphatic diisocyanate can be appropriately selected depending on the purpose. The aliphatic diisocyanates include, for example, ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanate methyl caproate, bis(2-isocyanate ethyl) fumarate, bis(2-isocyanate ethyl) carbonate, and 2-isocyanate ethyl-2,6-diisocyanate hexanoate.

There is no particular restriction on the alicyclic diisocyanates, and any alicyclic diisocyanate can be appropriately selected depending on the purpose. The alicyclic diisocyanates include, for example, isophorone diisocyanate (IPDI), dicyclohexyl methane-4,4'-diisocyanate (hydrogenated MDI), cyclohexylene diisocyanate, methyl cyclohexylene diisocyanate (hydrogenated TDI), bis(2-isocyanate ethyl)-4-cyclohexene-1,2-dicarboxylate, and 2,5- and 2,6-norbornane diisocyanate.

There is no particular restriction on the aromatic and aliphatic diisocyanates, any aromatic and aliphatic diisocyanate can be appropriately selected depending on the purpose. The aromatic and aliphatic diisocyanates include, for example, m- and p-xylylene diisocyanate (XDI), and α,α,α',α'-tetramethyl xylylene diisocyanate (TMXDI).

Further, there is no particular restriction on the modified products of diisocyanates, and any modified product can be appropriately selected depending on the purpose. The modified products of diisocyanates include, for example, modified products containing urethane group, carbodiimide group, allophanate group, urea group, burette group, uretdione group, uretimine group, isocyanurate group and oxazolidone group. To be more specific, the modified products include modified MDI such as urethane modified MDI, carbodiimide modified MDI, trihydrocarbyl phosphate modified MDI, modified products of diisocyanates, for example, urethane modified TDI such as isocyanate-containing prepolymer; and a mixture of two or more of modified products of these diisocyanates (for example, combined use of modified MDI and urethane modified TDI).

Of these diisocyanates, preferable are aromatic diisocyanates having the carbon number of 6 to 15 excluding carbon in an NCO group, aliphatic diisocyanates having the carbon number of 4 to 12, and alicyclic diisocyanates having the carbon number of 4 to 15. In particular, preferable are TDI, MDI, HDI, hydrogenated MDI, and IPDI.

<<<Polyurea Resin>>>

The polyurea resin includes polyurea resins which are synthesized from diamines, polyamine such as trivalent or higher multivalent polyamines, diisocyanate and polyisocyanate such as trivalent or higher multivalent polyisocyanates. Of these resins, preferable is a polyurea resin which is synthesized from the diamine and the diisocyanate.

The diisocyanate and the trivalent or higher multivalent polyisocyanates include those similar to the diisocyanate and the trivalent or higher multivalent polyisocyanates given in the polyurethane resin.

—Polyamine—

The polyamine includes, for example, diamine and trivalent or higher multivalent polyamines.

There is no particular restriction on the diamine, and any diamine can be appropriately selected depending on the purpose. The diamine includes, for example, aliphatic diamines and aromatic diamines. Of these diamines, preferable are aliphatic diamines having the carbon number of 2 to 18 and aromatic diamines having the carbon number of 6 to 20. Further, the trivalent or higher multivalent amines may be used, as appropriate.

There is no particular restriction on the aliphatic diamines having the carbon number of 2 to 18, and any aliphatic diamine can be appropriately selected depending on the purpose. The aliphatic diamines include, for example, alkylene diamines having the carbon number of 2 to 6 such as ethylene diamine, propylene diamine, trimethylene diamine, tetramethylene diamine and hexamethylene diamine; polyalkylene diamines having the carbon number of 4 to 18 such as diethylene triamine, imino-bis-propyl amine, bis(hexamethylene) triamine, triethylene tetramine, tetraethylene pentamine and pentaethylene hexamine; the alkylene diamine such as dialkyl aminopropyl amine, trimethyl hexamethylene diamine, aminoethyl ethanol amine, 2,5-dimethyl-2,5-hexamethylene diamine and methyl imino-bis-propyl amine, or alkyl of the polyalkylene diamine having the carbon number of 1 to 4, or hydroxyalkyl substitutes having the carbon number of 2 to 4; alicyclic diamines having the carbon number of 4 to 15 such as 1,3-diaminocyclohexane, isophorone diamine, menthene diamine, 4,4-'methylene dicyclohexane diamine (hydrogenated methylene dianiline); heterocyclic diamines having the carbon number of 4 to 15 such as piperazine, N-aminoethyl piperazine, 1,4-diaminoethyl piperazine, 1,4 bis(2-amino-2-methyl propyl)piperazine and 3,9-bis(3-aminopropyl)-2,4,8,10-tetraoxaspiro[5,5]undecane; and aromatic ring-containing aliphatic amines having the carbon number of 8 to 15 such as xylylene diamine and tetrachlor-p-xylylene diamine.

There is no particular restriction on the aromatic diamines having the carbon number of 6 to 20, and any aromatic diamine can be appropriately selected depending on the purpose. The aromatic diamines include, for example, non-substituted aromatic diamines such as 1,2-, 1,3- and 1,4-phenylene diamine, 2,4'- and 4,4'-diphenyl methane diamine, crude diphenyl methane diamine (polyphenyl polymethylene polyamine), diaminodiphenyl sulfone, benzidine, thiodianiline, bis(3,4-diaminophenyl)sulfone, 2,6-diaminopyridine, m-aminobenzyl amine, triphenylmethane-4,4',4"-triamine and naphthylene diamine; aromatic diamines with a nuclear substitution alkyl group having the carbon number of 1 to 4 such as 2,4- and 2,6-tolylene diamine, crude tolylene diamine, diethyl tolylene diamine, 4,4'-diamino-3,3'-dimethyl diphenyl methane, 4,4'-bis(o-toluidine), dianisidine, diaminoditrylsulfone, 1,3-dimethyl-2,4-diaminobenzene, 1,3-dimethyl-2,6-diaminobenzene, 1,4-diisopropyl-2,5-diaminobenzene, 2,4-diamino mesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethyl benzidine, 3,3',5,5'-tetramethyl-4,4'-diaminodiphenyl methane, 3,5-diethyl-3'-methyl-2',4-diaminodiphenyl methane, 3,3'-diethyl-2,2'-diaminodiphenyl methane, 4,4'-diamino-3,3'-dimethyldiphenyl methane, 3,3',5,5'-tetraethyl-4,4'-diamino benzophenone, 3,3',5,5'-tetraethyl-4,4'-diaminodiphenyl ether, and 3,3',5,5'-tetraisopropyl-4,4'-diaminodiphenyl sulfone; the non-substituted aromatic diamines or mixtures of aromatic diamine isomers at various percentages having a nuclear substitution alkyl group having the carbon number of 1 to 4; methylene-bis-o-chloroaniline, 4-chloro-o-phenylene diamine, 2-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine and 3-dimethoxy-4-aminoaniline; aromatic diamines having nuclear substitution electron-withdrawing groups (halogen such as CI, Br, I, F; alkoxy group such as methoxy, ethoxy; nitro group) such as 4,4'-diamino-3,3'-dimethyl-5,5'-dibromo-diphenyl methane, 3,3'-dichloro benzidine, 3,3'-dimethoxy benzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylene-bis(2-iodoaniline), 4,4'-methylene-bis(2-bromoaniline), 4,4'-methylene-bis(2-fluoroaniline) and 4-aminophenyl-2-chloroaniline; aromatic diamines having a secondary amino group such as 4,4'-di(methylamino) diphenyl methane and 1-methyl-2-methylamino-4-aminobenzene [the non-substituted aromatic diamines, the aromatic diamines with the nuclear substitution alkyl group having the carbon number of 1 to 4, mixtures of isomers thereof at various percentages, and those in which a primary amine group of the aromatic diamines having the nuclear substitution electron-withdrawing group is partially or entirely substituted to a secondary amino group by lower alkyl groups such as methyl and ethyl].

In addition, the diamines include, for example, polyamide polyamines such as low-molecular weight polyamide polyamine which is obtained by condensation of dicarboxylic acid (dimer acid and others) with the polyamines (such as the alkylene diamine and the polyalkylene polyamine) which are excessive (two moles or more for one mole of acid); polyether polyamines such as hydrides of cyanoethylated polyether-polyols (polyalkylene glycol and others).

<<<Polyamide Resin>>>

The polyamide resins include a polyamide resin which is synthesized from diamine, polyamine such as trivalent or higher multivalent polyamines, dicarboxylic acid, and polycarboxylic acid such as trivalent to hexavalent or higher multivalent polycarboxylic acid. Of the polyamide resins, preferable is a polyamide resin which is synthesized from diamine and dicarboxylic acid.

The diamine and the trivalent or higher multivalent polyamines include those similar to the diamine and the trivalent or higher multivalent polyamines that are given in the polyurea resin.

The dicarboxylic acid and the trivalent to hexavalent or higher multivalent polycarboxylic acids include those similar to the dicarboxylic acid and the trivalent to hexavalent or higher multivalent polycarboxylic acids that are given in the polyester resin.

<<<Polyether Resin>>>

There is no particular restriction on the polyether resin, and any polyether resin can be appropriately selected depending on the purpose. The polyether resin includes, for example, crystalline polyoxy alkylene polyol.

There is no particular restriction on a method for producing the crystalline polyoxy alkylene polyol, and any method can be appropriately selected depending on the purpose. The method includes, for example, a method in which AO of chiral is subjected to ring-opening polymerization by using a catalyst which is usually used in polymerization of AO (for example, refer to Journal of the American Chemical Society, 1956, Vol. 78, no. 18, pp. 4787-4792) and a method in which AO of low-priced chiral is subjected to ring-opening polymerization by using a complex which is sterically bulky and special in chemical structure as a catalyst.

As a method in which a special complex is used, there are known a method in which a compound obtained by bringing a lanthanoid complex into contact with organic aluminum is used as a catalyst (for example, refer to JP-A No. 11-12353) and a method in which bimetal μ-oxoalkoxide and a hydroxyl compound are allowed to react in advance (for example, refer to JP-A No. 2001-521957).

As a method for obtaining crystalline polyoxy alkylene polyol which is quite high in isotacticity, there is known a method in which a salen complex is used as a catalyst (for example, refer to Journal of the American Chemical Society, 2005, Vol. 127, No. 33, pp. 11566-11567). Where, for example, AO of chiral is used and glycol or water is used as an initiator on a ring-opening polymerization thereof, there is obtained polyoxy alkylene glycol which has a hydroxyl group at an end and which is 50% or more in isotacticity.

The polyoxyalkylene glycol which is 50% or more in isotacticity may be that which is modified so as to have a carboxyl group at an end thereof. It is noted that where the isotacticity is 50% or more, the polyoxyalkylene glycol is usually crystallinity. The glycol includes, for example, the diol. Carboxylic acid which is used in carboxy modification includes, for example, the dicarboxylic acid.

AOs used in producing the crystalline polyoxyalkylene polyol include those having the carbon number of 3 to 9, and they are, for example, PO, 1-chlorooxetane, 2-chlorooxetane, 1,2-dichlorooxetane, epichlorohydrin, epibromohydrin, 1,2-BO, methylglycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allylglycidyl ether, 1,2-heptylene oxide, stylene oxice, and phenyl glycidyl ether. Of the AOs, preferable are PO, 1,2-BO, stylene oxide and cyclohexene oxide, and more preferable are PO, 1,2-BO and cyclohexene oxide. Further, the AOs may be used solely or in combination of two or more of them.

Further, there is no particular restriction on the isotacticity of the crystalline polyoxy alkylene polyol, and any isotacticity can be appropriately selected depending on the purpose. In terms of sharp melt properties and blocking resistance of the thus obtained crystalline polyether resin, the isotacticity is preferably 70% or more, more preferably 80% or more, in particular preferably 90% or more, and most preferably 95% or more.

The isotacticity can be calculated by a method described in Macromolecules, Vol. 35, No. 6, pp. 2389 to 2392 (2002) and, to be more specific, determined as follows.

A sample to be determined (approximately 30 mg) is weighed in a sample tube with a diameter of 5 mm for $^{13}$C-NMR and dissolved by adding approximately 0.5 mL of a deuterated solvent, thereby given as an analysis sample. Here, there is no particular restriction on the deuterated solvent and any solvent can be appropriately selected as long as it is able to dissolve the sample. The solvent includes, for example, deuterated chloroform, deuterated toluene, deuterated dimethyl sulfoxide and deuterated dimethyl formamide. Three signals of $^{13}$C-NMR derived from a methine group are respectively observed in the vicinity of 75.1 ppm which is a syndiotactic value (S), in the vicinity of 75.3 ppm which is a heterotactic value (H) and in the vicinity of 75.5 ppm which is an isotactic value (I).

The isotacticity can be calculated by the following formula 1.

$$\text{Isotacticity (\%)}=[I/(I+S+H)]\times 100 \qquad \text{<Formula 1>}$$

In the formula 1, I indicates an integral value of the isotactic signal; S, an integral value of the syndiotactic signal; and H, an integral value of the heterotactic signal.

<<<Vinyl Resin>>>

There is no particular restriction on the vinyl resin, as long as it has the crystallinity, and any vinyl resin can be appropriately selected depending on the purpose. Preferable is such a vinyl resin that has a vinyl monomer with crystallinity and a vinyl monomer free of crystallinity, as appropriate, as constitution units.

There is no particular restriction on the vinyl monomer having crystallinity, and any vinyl monomer can be appropriately selected depending on the purpose. The vinyl monomer includes, for example, straight-chain alkyl(meth)acrylate in which an alkyl group has the carbon number of 12 to 50 (a straight-chain alkyl group having the carbon number of 12 to 50 is a crystalline group) such as lauryl(meth)acrylate, tetradecyl(meth)acrylate, stearyl(meth)acrylate, eicosyl(meth) acrylate and behenyl(meth)acrylate.

There is no particular restriction on the vinyl monomer which is free of crystallinity, and any vinyl monomer free of crystallinity can be appropriately selected depending on the purpose. Preferable is a vinyl monomer with the molecular weight of 1000 or less. The vinyl monomer includes, for example, styrenes, a (meth)acryl monomer, a carboxyl group-containing vinyl monomer, other vinyl ester monomers, and an aliphatic hydrocarbon-based vinyl monomer. They may be used solely or in combination of two or more of them.

There is no particular restriction on the styrenes, and any styrene can be appropriately selected depending on the purpose. The styrenes include, for example, styrene, and alkyl styrene in which an alkyl group has the carbon number of 1 to 3.

There is no particular restriction on the (meth)acryl monomer, and any (meth)acryl monomer can be appropriately selected depending on the purpose, including, for example, alkyl(meth)acrylate in which an alkyl group has the carbon number of 1 to 11 such as methyl(meth)acrylate, ethyl(meth) acrylate, butyl(meth)acrylate and 2-ethyl hexyl(meth)acrylate and branched alkyl(meth)acrylate in which an alkyl group has the carbon number of 12 to 18; hydroxyl alkyl (meth)acrylate in which an alkyl group has the carbon number of 1 to 11 such as hydroxylethyl(meth)acrylate; and alkyl amino group-containing (meth)acrylate in which an alkyl group has the carbon number of 1 to 11 such as dimethyl aminoethyl(meth)acrylate and diethyl aminoethyl(meth) acrylate.

There is no particular restriction on the carboxyl group-containing vinyl monomer, and any carboxyl group-containing vinyl monomer can be appropriately selected depending on the purpose. The carboxyl group-containing vinyl monomer includes, for example, monocarboxylic acid having the carbon number of 3 to 15 such as (meth)acrylic acid, crotonic acid and cinnamic acid; dicarboxylic acid having the carbon number of 4 to 15 such as (anhydrous) maleic acid, fumaric acid, itaconic acid and citraconic acid; dicarboxylic acid monoester such as monoalkyl (the carbon number of 1 to 18) ester of the dicarboxylic acid, for example, maleic acid monoalkyl ester, fumaric acid monoalkyl ester, itaconic acid monoalkyl ester, and citraconic acid monoalkyl ester.

There is no particular restriction on the other vinyl ester monomers, and any other vinyl ester monomers can be appropriately selected depending on the purpose. The other vinyl ester monomers include, for example, aliphatic vinyl ester having the carbon number of 4 to 15 such as vinyl acetate, vinyl propionate and isopropenyl acetate; unsaturated carboxylic acid multivalent (divalent to trivalent or higher multivalent) alcohol ester having the carbon number of 8 to 50 such as ethylene glycol di(meth)acrylate, propylene glucol di(meth)acrylate, neopentyl glycol di(meth)acrylate, trimethylol propane tri(meth)acrylate, 1,6 hexane diol diacrylate, and polyethylene glycol di(meth)acrylate; and aromatic vinyl ester having the carbon number of 9 to 15 such as methyl-4-vinyl benzoate.

There is no particular restriction on the aliphatic hydrocarbon-based vinyl monomer, and any aliphatic hydrocarbon-based vinyl monomer can be appropriately selected depending on the purpose, including, for example, olefin having the carbon number of 2 to 10 such as ethylene, propylene, butane and octen; and diene having the carbon number of 4 to 10 such as butadiene, isoprene and 1,6-hexadiene.

<<<Modified Crystalline Resin (Binding Resin Precursor)>>>

There is no particular restriction on the modified crystalline resin, as long as it is a crystalline resin which has a functional group capable of reacting with an active hydrogen group. Any modified crystalline resin can be appropriately selected depending on the purpose and including, for example, a crystalline polyester resin having a functional group capable of reacting with the active hydrogen group, a crystalline polyurethane resin, a crystalline polyurea resin, a crystalline polyamide resin, a crystalline polyether resin, and a crystalline vinyl resin. In the process of producing a toner, the modified crystalline resin is allowed to react with a resin having an active hydrogen group and compounds having an active hydrogen group such as a cross-linking agent and an elongating agent having an active hydrogen group, by which the resin can be increased in molecular weight to give a binding resin. Therefore, the modified crystalline resin can be used as a binding resin precursor in producing the toner.

The binding resin precursor covers a monomer and an oligomer constituting the binding resin, a modified resin having a functional group capable of reacting with an active hydrogen group, and a compound containing an oligomer which allows elongation or crosslinking reaction to proceed. When these conditions are satisfied, the binding resin precursor may be a crystalline resin or a non-crystalline resin. Of these resins, as the binding resin precursor, preferable is the modified crystalline resin having at least an isocyanate group at its end. It is also preferable that the binding resin is formed by elongation or crosslinking reaction resulting from reaction with an active hydrogen group, when dispersed or emulsified in an aqueous medium to granulate toner particles.

As the binding resin formed with the binding resin precursor, preferable is a crystalline resin which is obtained by subjecting a modified resin having a functional group capable of reacting with the active hydrogen group and a compound having the active hydrogen group to elongation or crosslinking reaction. In particular preferable are a urethane modified polyester resin which is obtained by subjecting a polyester resin having an isocyanate group at its end and the polyol to elongation or crosslinking reaction, and a urea modified polyester resin which is obtained by subjecting a polyester resin having an isocyanate group at its end and amines to elongation or crosslinking reaction.

There is no particular restriction on the functional group capable of reacting with an active hydrogen group, and any functional group can be appropriately selected depending on the purpose. The functional groups include, for example, functional groups such as an isocyanate group, epoxy group, carboxylic acid, and acid chloride group. Of these functional groups, an isocyanate group is preferable in terms of reactivity and stability.

There is no particular restriction on the compound having an active hydrogen group as long as the compound has the active hydrogen group. Any compound can be appropriately selected depending on the purpose. Where the functional group capable of reacting with the active hydrogen group is an isocyanate, the compound includes, for example, a compound having, as the active hydrogen group, hydroxyl group (alcoholic hydroxyl group and phenolic hydroxyl group), amino group, carboxyl group and mercapto group. Of these compounds, in terms of a reaction rate, particularly preferable are compounds having an amino group (that is, amines).

There is no particular restriction on the amines, and any amine can be appropriately selected depending on the purpose. The amines include, for example, phenylene diamine, diethyltoluene diamine, 4,4'-diaminodiphenyl methane, 4,4'-diamino-3,3' dimethyl dicyclohexyl methane, diamine cyclohexane, isophorone diamine, ethylene diamine, tetramethylene diamine, hexamethylene diamine, diethylene triamine, triethylene tetramine, ethanol amine, hydroxyethyl aniline, aminoethyl mercaptan, aminopropyl mercaptan, aminopropionic acid, and aminocapronic acid. The amines also include ketimine compounds in which amino groups of the amines are blocked with ketones (such as acetone, methylethyl ketone and methylisobutyl ketone), and oxazolizone compounds.

<<Non-Crystalline Resin>>

There is no particular restriction on the non-crystalline resin as long as it is non-crystalline, and any non-crystalline resin can be appropriately selected from any known resins. The non-crystalline resin includes, for example, styrene such as polystyrene, poly p-styrene and polyvinyl toluene or a single polymer of a substitute thereof; a styrene-based copolymer such as styrene-p-chlorostyrene copolymer, styrene-propylene copolymer, styrene-vinyl toluene copolymer, styrene-acrylic acid methyl copolymer, styrene-acrylic acid ethyl copolymer, styrene-meta acrylic acid copolymer, styrene-meta acrylic acid methyl copolymer, styrene-meta acrylic acid ethyl copolymer, styrene-meta acrylic acid butyl copolymer, styrene-α-chlormeta acrylic acid methyl copolymer, styrene-acrylonitrile copolymer, styrene-vinylmethyl ether copolymer, styrene-vinyl methylketone copolymer, styrene-butadiene copolymer, styrene-isopropyl copolymer, and styrene-maleic acid ester copolymer; polymethyl methacrylate resin, polybutyl methacrylate resin, polyvinyl chloride resin, polyvinyl acetate resin, polyethylene resin, polyester resin, polyurethane resin, epoxy resin, polyvinyl butyral resin, polyacrylic resin, rosin resin, modified rosin resin, terpene resin, phenol resin, aliphatic or aromatic hydrocarbon resin, aromatic petroleum resin, and modified resins so as to have a functional group capable of reacting with an active hydrogen group. They may be used solely or in combination of two or more of them. Of these resins, particularly preferable is non-crystalline polyester.

The non-crystalline resin is preferably a resin which has a constitution unit similar to that of a crystalline resin.

It is also preferable that the non-crystalline resin is poorly soluble in ethyl acetate.

In addition, a wavelength in a 1 cm optical path length after a 20% by mass ethyl acetate solution of the non-crystalline resin is allowed to stand at 50° C. for 24 hours is 50% or less in transmittance of light at 500 nm is defined as being poorly soluble in ethyl acetate.

Diol used in synthesis of the non-crystalline polyester is preferably a straight-chain or branched aliphatic diol.

There is no particular restriction on the straight-chain or branched aliphatic diol, and any diol can be appropriately selected depending on the purpose. The diol includes, for example, ethylene glycol, 1,3-propane diol, 1,4-butane diol, 1,6-hexane diol, 1,9-nonane diol, 1,10-decane diol, 1,2-propylene glycol, butane diol, hexane diol, octane diol, decane diol, dodecane diol, tetradecane diol, neopentyl glycol, and 2,2-diethyl-1,3-propane diol. They may be used solely or in combination of two or more of them.

There is no particular restriction on dicarboxylic acid used in synthesis of the non-crystalline polyester, and any dicarboxylic acid can be appropriately selected depending on the purpose. The dicarboxylic acid includes, for example, aromatic dicarboxylic acid such as isophthalic acid, terephthalic acid and phthalic acid; aliphatic dicarboxylic acid such as fumaric acid and succinic acid.

<<Block Copolymer>>

It is preferable that the binding resin additionally contains a block copolymer having crystalline block and non-crystalline block. It is, thereby, possible to easily form a sea-island structure which is composed of a sea containing a crystalline resin and an island containing a non-crystalline resin and a colorant.

It is preferable that the crystalline block and the non-crystalline block are resins which have constitution units respectively similar to a crystalline resin and a non-crystalline resin.

There is no particular restriction on a glass transition temperature of the block copolymer, and any glass transition temperature can be appropriately selected depending on the purpose. The glass transition temperature is preferably 30° C. or less, and more preferably 20° C. or less. Where the glass transition temperature of the block copolymer is lower than 30° C., an image gloss level may be decreased.

There is no particular restriction on content of the block copolymer in the binding resin, and any content can be appropriately selected depending on the purpose. The content is preferably 5% by mass to 20% by mass. Where the content of the crystalline resin in the binding resin is less than 5% by mass, it may be difficult to form a sea-island structure. Where the content exceeds 20% by mass, there is a case that the island may exceed 1.0 μm in domain diameter.

There is no particular restriction on a mass ratio of the crystalline block to the non-crystalline block, and any mass ratio can be appropriately selected depending on the purpose. The mass ratio is preferably 1/9 or more but 9 or less, and more preferably 0.25 to 4. Where the mass ratio of the crystalline block to the non-crystalline block is less than 1/9 or where it exceeds 9, it may be difficult to form a sea-island structure.

There is no particular restriction on the block copolymer, and any block copolymer can be appropriately selected depending on the purpose. The block copolymer includes, for example, polyester, polyurethane, polyurea, polyamide, polyether and vinyl resin. They may be used solely or in combination of two or more of them. Of these block copolymers, polyester is preferable.

It is preferable that the block copolymer is poorly soluble in ethyl acetate.

Here, the fact that a wavelength in a 1 cm optical path length after a 20% by mass ethyl acetate solution of the block copolymer is allowed to stand at 50° C. for 24 hours is 50% or less in transmittance of light at 500 nm is defined as being poorly soluble in ethyl acetate.

Where the block copolymer is polyester, the block copolymer can be synthesized by allowing non-crystalline polyester to react with a crystalline resin.

In the present invention, as a colorant, there is used a pigment which is surface-treated by a "poorly soluble resin."

The above "poorly soluble resin" usable is, for example, (i) a poorly soluble non-crystalline resin, (ii) a mixture of a crystalline resin and a poorly soluble non-crystalline resin or (iii) a poorly soluble block copolymer containing a crystalline block and a non-crystalline block.

In the following description, a resin for surface-treating a pigment is referred to as "surface-treating resin."

It is noted that "poorly soluble" referred to in the present invention will be defined as follows.

"Poorly soluble" means that when 40 parts by mass of the surface-treating resin is added to and mixed with 100 parts by mass of ethyl acetate, the mixture yields a white turbidity at 50° C., or even when the mixture becomes a transparent solution without yielding a white turbidity at 50° C., the mixture yields a white turbidity after it is allowed to stand for 12 hours.

The above-described surface-treating resin is defined as being "poorly soluble."

Hereinafter, a description will be given of reasons why the surface of a pigment as the colorant is surface-treated by using a poorly soluble surface-treating resin.

A pigment is uniformly dispersed in a toner to increase rheology, viscosity and elasticity of the toner as a whole. As a result, the toner is improved in stress resistance, thereby eliminating flaws associated with image transfer which will occur on recrystallization after being thermally fixed and solving insufficient hardness of an output image. Further, the pigment is uniformly dispersed in the toner, thus making it possible to obtain a high-quality image in which the pigment is uniformly dispersed even in a state that the toner is fixed on a medium. In a toner in which a pigment is not uniformly dispersed inside the toner but unevenly distributed on the surface of the toner, the pigment inside a fixed image is consequently present locally, thus causing variance in color and deterioration of image quality such as a reduction in image density and colorfulness.

In order that a toner which is high in image quality, large in stress resistance and capable of eliminating flaws associated with image transfer which will occur on recrystallization when the toner is thermally fixed and also solving insufficient hardness of an output image and in which a crystalline resin is used as a main binder is increased in pigment dispersion property, the surface of the pigment is preferably treated by a poorly soluble surface-treating resin. Since the surface-treating resin is poorly soluble, fine resin particles having already been formed in a solvent on granulation of the toner, and pigment particles adhere to the surface of the toner due to higher adsorption. The crystalline resin which is a main binder undergoes granulation thereon, thereby encapsulating the pigment. At this time, the poorly soluble resin keeps a certain dimension, and the toner is granulated, with pigment particles kept at certain or greater intervals inside the toner. Thereby, the toner can be granulated in a state that the pigment is uniformly dispersed.

Further, it is preferable that the surface-treating resin is poorly soluble at 50° C. Where a temperature is lower than 50° C., some of the resins to be used are lowered in rate of dissolution and may not be appropriately evaluated. Still further, where a temperature is 50° C. or higher, an organic solvent to be used is increased in volatility, which may make adjustment of concentrations difficult.

In the present invention, as the surface-treating resin, a resin obtained by mixing a non-crystalline polyester resin with a crystalline polyester resin is used for surface treatment to a pigment. The resin can be controlled so as to give a desired level of poor solubility in a solvent by adjusting a mixing ratio. Further, in a toner in which a non-crystalline polyester resin is solely used in a crystalline polyester binder, the surface-treating resin is not uniformly dispersed in the binder due to poor compatibility with the toner on granulation of the toner, thus resulting in a failure of uniform dispersion of the pigment. However, a crystalline resin is mixed to give surface treatment in advance, by which the non-crystalline polyester resin which has not been mutually soluble can be increased in dispersion in a main binder.

Further, when a crystalline resin with lower-temperature fixing property is introduced into the toner together with the non-crystalline resin, there is a case that desired lower-temperature fixing property may not be provided or heat-resistant storage stability may be deteriorated (blocking takes place). However, the crystalline resin and the non-crystalline resin are kneaded in advance, by which the crystalline resin is dispersed in an appropriate size. Thus, the pigment can be dispersed uniformly inside the toner, with the heat-resistant storage stability and the lower-temperature fixing property being provided.

Regarding a structure of the non-crystalline polyester resin, it is preferable that diol which is used as a monomer has a straight-chain carbon structure. Straight-chain aliphatic diol is used to increase the compatibility with the crystalline polyester which is a main binder, and as a result, it is possible to disperse the pigment uniformly in the toner.

A method for dispersing a pigment in a toner may include a method in which a resin solution obtained by mixing a surface-treating resin with a pigment in a solvent is used as a colorant for granulating the toner. Where there is no step in which the pigment is surface-treated by the resin, aggregated pigment particles are not sufficiently removed or the pigment is not effectively dispersed.

There is no particular restriction on a ratio of the non-crystalline polyester resin to the crystalline polyester resin in the surface-treating resin used in a colorant (mass ratio), and any ratio can be appropriately selected depending on the purpose. The ratio is preferably 30:70 to 90:10. Where a percentage of the non-crystalline polyester resin is less than 30% by mass and higher than 90% by mass, a main binder may be poorly compatible with the crystalline polyester.

Further, it is preferable that the colorant is a pigment which is surface-treated with the surface-treating resin, where a ratio by mass between the pigment and the surface-treating resin is 50:50 to 20:80 as the pigment:the surface-treating resin. Where a mass ratio of the surface-treating resin is lower than 50% by mass, the pigment is not effectively dispersed on granulation of the toner. And, the pigment may undergo aggregation or may be unevenly distributed on the surface. Where the mass ratio of the surface-treating resin is higher than 80% by mass, the toner is increased in total content, which may affect thermal physical properties of the toner to result in defects when the toner is fixed.

Still further, it is preferable that a resin which is obtained by mixing non-crystalline polyester with crystalline polyester is used as the surface-treating resin to give surface treatment to a pigment. The resin can be controlled so as to give a desired level of poor solubility in a solvent by adjusting a mixing ratio thereof. In addition, in a toner in which a non-crystalline polyester resin is solely used in a crystalline polyester binder, the surface-treating resin is not uniformly dispersed in the binder due to poor compatibility on granulation of the toner, thus resulting in a failure of uniform dispersion of the pigment. However, the crystalline resin is mixed to give surface treatment, by which the non-crystalline polyester which has not been mutually soluble can be increased in dispersion in a main binder.

Regarding a structure of the non-crystalline polyester resin, it is preferable that diol which is used as a monomer has a straight-chain carbon structure. A straight-chain aliphatic diol is used to increase compatibility with the crystalline polyester as a main binder. As a result, it is possible to disperse the pigment uniformly in the toner.

<Surface-Treating Resin>

All the crystalline and non-crystalline resin polyesters can be used as crystalline polyester and non-crystalline polyester used in the surface-treating resin. Of these polyesters, preferable are those in which straight-chain or branched aliphatic diol is used as a diol component. They include, for example, ethylene glycol, 1,3-propane diol, 1,4-butane diol, 1,6-hexane diol, 1,9-nonane diol, 1,10-decane diol, 1,2-propylene glucol, butane diol, hexane diol, octane diol, decane diol, dodecane diol, tetradecane diol, neopentyl glycol, and 2,2-diethyl-1,3-propane diol.

<Method for Surface Treatment>

The surface-treating resin and the pigment can be subjected to surface treatment by a melting and kneading method or by melting and kneading which follows a method for producing a so-called master batch. A treatment method includes all known methods capable of mixing a resin with a pigment by melting and kneading. The following machines can be used; a continuous-type biaxial extrusion machine (for example, KTK biaxial extrusion machine made by Kobe Steel Ltd., TEM biaxial extrusion machine made by Toshiba Machine Co. Ltd., PCM biaxial extrusion machine made by Ikegai Corp. and KEX biaxial extrusion machine made by Kurimoto Ltd.), and a thermal kneader such as a continuous-type uniaxial kneader (for example, Co-kneader made by Buss AG and a kneader made by KCK Inc.), and a direct open roll-type continuous kneader, Kneadex (open roll continuous kneading granulator made by Mitsui Mining Co., Ltd.).

Where mixing and kneading are carried out by using a uniaxial kneader (Co-kneader) made by Buss AG, it is preferable that a temperature of an input port is controlled so as to be 50° C. to 120° C.; a temperature of an exhaust port, 40° C. to 70° C.; a temperature of a screw, 30° C. to 40° C.; the number of rotations of a screw, at 80 rpm, and a feeding speed, at 5 kg/h.

Further, where melting and kneading are carried out by using a direct open roll-type continuous kneader, Kneadex, made by Mitsui Mining Co., Ltd., it is preferable that a temperature of a front roll input port is controlled so as to be 50°

C. to 100° C.; a temperature of a front roll exhaust port, 40° C. to 70° C.; a temperature of a back roll input port, 30° C. to 50° C. and a temperature of a back roll exhaust port, 10° C. to 30° C.

Still further, the surface-treating resin and the pigment can be surface-treated by using a wet-type dispersion machine, together with the organic solvent. Surface treatment can be carried out by using, for example, a bead mill (Ultravisco Mill made by Imex Co., Ltd.), a paint shaker (made by Asada Iron Works Co., Ltd.) and a nanomizer (NM2-L200AR-D, made by Yoshida Kikai Co., Ltd.).

<Method for Confirming Pigment Dispersion Property>

A state that a pigment is present in a toner can be confirmed by procedures in which a sample prepared by burying toner particles into an epoxy resin or the like is cut with a micromicrotome or ultramicrotome and a cross section of the toner is observed under a scanning-type electron microscope (SEM). Where the SEM is used to observe the toner, confirmation is preferably made by a back-scattered electron image. This is preferable because the presence of the pigment can be observed in sharp contrast. Further, FIB-STEM (HD-2000 made by Hitachi, Ltd.) may be used to cut the sample obtained by burying toner particles into an epoxy resin or the like with ion beams, thereby observing the cross section of the toner. In this case, it is also preferable to make confirmation by a back-scattered electron image in terms of visibility.

Further, the vicinity of the surface of the toner in the present invention is defined as a region which is 0 nm to 300 nm in the toner from the outermost surface of the toner, when observation is made for an image of the cross section of the toner which is obtained by using a micromicrotome, a ultramicrotome or FIB-STEM to cut the sample in which toner particles are buried into an epoxy resin or the like.

<Pigment or Dye>

There is no particular restriction on pigments or dyes used in the colorant, and any pigment and dye can be appropriately selected from any known dyes and pigments depending on the purpose. They include, for example, carbon black, nigrosin dye, black iron oxide, naphthol yellow S, hansa yellow (10G, 5G, G), cadminum yellow, yellow iron oxide, Chinese yellow, chrome yellow, titan yellow, polyazo yellow, oil yellow, hansa yellow (GR, A, RN, R), pigment yellow L, benzidine yellow (G, GR), permanent yellow (NCG), valcan fast yellow (5G, R), tartrazine lake, quinoline yellow lake, anthrazane yellow BGL, isoindolinone yellow, red iron oxide, red lead, red vermilion, cadmium red, cadmium mercury red, antimony red, permanent red 4R, para red, fiser red, para-chloro-ortho-nitroaniline red, lithol fast scarlet G, brilliant fast scarlet, brilliant carmine BS, permanent red (F2R, F4R, FRL, FRLL, F4RH), fast scarlet VD, Vulcan fast rubin B, brilliant scarlet G, lithol rubin GX, permanent red F5R, brilliant carmine 6B, pigment scarlet 3B, Bordeaux 5B, toluidine maroon, permanent Bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, iron blue, anthraquinone blue, fast violet B, methyl violet lake, cobalt purple, manganese purple, dioxane violet, anthraquinone violet, chrome green, zinc green, chrome oxide, pyridiane, emerald green, pigment green B, naphthol green B, green gold, acid green lake, malachite green lake, phtharocyanine green, anthraquinone green, titanium oxide, zinc white, and lithopone. They may be used solely or in combination of two or more of them.

There is no particular restriction on color of the pigments or dyes, and any pigment or dye can be appropriately selected depending on the purpose, including, for example, pigments or dyes for black, and pigments or dyes for the color of magenta, cyan and yellow. They may be used solely or in combination of two or more of them.

The pigments or dyes for black include, for example, carbon black (C. I. pigment black 7) such as furnace black, lamp black, acetylene black and channel black; metals such as copper, iron (C. I. pigment black 11) and titanium oxide; organic pigments such as aniline black (C. I. pigment black 1).

Pigments or dyes for magenta include, for example, C. I. pigment red 1, 2, 3, 4, 5, 6, 7, 8, 9, 10, 11, 12, 13, 14, 15, 16, 17, 18 19, 21, 22, 23, 30, 31, 32, 37, 38, 39, 40, 41, 48, 48:1, 48:2, 48:3, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 184, 202, 206, 207, 209, 211, 238, 269, 282; C. I. pigment violet 19; C. I. violet 1, 2, 10, 13, 15, 23, 29, and 35.

Pigments or dyes for cyan include, for example, C. I. pigment blue 2, 3, 15, 15:1, 15:2, 15:3, 15:4, 15:6, 16, 17, 60; C. I. bat blue 6; C. I. acid blue 45, a copper phthalocyanine pigment in which 1 to 5 of phthalimidemethyl groups are substituted to a phthalocyanine skeleton, green 7, and green 36.

Pigments or dyes for yellow include, for example, C. I. pigment yellow 0-16, 1, 2, 3, 4, 5, 6, 7, 10, 11, 12, 13, 14, 15, 16, 17, 23, 55, 65, 73, 74, 83, 97, 110, 151, 154, 155, 174, 180, 185; C. I. bat yellow 1, 3, 20, and orange 36.

There is no particular restriction on content of the colorant (pigment) in the toner, and any content can be appropriately selected depending on the purpose. The content is preferably 1% by mass to 15% by mass, and more preferably 3% by mass to 10% by mass. Where the content is less than 1% by mass, the toner may be lowered in coloring power. Where the content exceeds 15% by mass, a pigment may be poorly dispersed in the toner to result in a lowering in coloring power and a lowering in electric characteristics of the toner.

<Other Components>

The toner of the present invention may contain, as appropriate, other components such as a mold releasing agent, a charge control agent, an external additive, a flowability improver, a cleaning improver and a magnetic material, as long as they will not impair the effects of the present invention.

<<Mold Releasing Agent>>

There is no particular restriction on the mold releasing agent, and any mold releasing agent can be appropriately selected from known mold releasing agents, depending on the purpose, including, for example, waxes such as carbonyl group-containing wax, polyolefin wax and long-chain hydrocarbon. They may be used solely or in combination of two or more of them. Of these waxes, the carbonyl group-containing wax is preferable.

The carbonyl group-containing wax includes, for example, polyalkanoic acid ester, polyalkanol ester, polyalkanoic acid amide, polyalkyl amide and dialkyl ketone.

The polyalkanoic acid ester includes, for example, carnauba wax, montan wax, trimethylolpropane tribehenate, pentaerythritol tetrabehenate, pentaerythritol diacetatedibehenate, glycerin tribehenate and 1,18-octadecane diol distearate. The polyalkanol ester includes, for example, trimellitic acid tristearyl and distearyl maleate. The polyalkanoic acid amide includes, for example, dibehenyl amide. The polyalkyl amide includes, for example, trimellitic acid tristearyl amide.

The dialkyl ketone includes, for example, distearyl ketone. Of these carbonyl group-containing waxes, polyalkanoic acid ester is particularly preferable.

The polyolefin wax includes, for example, polyethylene wax and polypropylene wax.

The long-chain hydrocarbon includes, for example, paraffin wax and Sasolwax.

There is no particular restriction on a melting point of the mold releasing agent, and any melting point can be appropriately selected depending on the purpose. The melting point is preferably 40° C. to 160° C., more preferably 50° C. to 120° C., and particularly preferably 60° C. to 90° C. Where the melting point is less than 40° C., wax may affect heat-resistant storage stability. Where the melting point exceeds 160° C., cold offset may easily take place on fixing at low temperatures.

A melting point of the mold releasing agent can be determined as follows; a sample which has been heated up to 200° C. and cooled from this temperature down to 0° C. at a temperature-lowering rate of 10° C./minute, and is heated at a temperature rising rate of 10° C./minute, for example, by using a differential scanning calorimeter (DSC 210 made by Seiko Instruments Inc.), thereby obtaining a maximum peak temperature of fusion heat as the melting point.

There is no particular restriction on melting viscosity of the mold releasing agent, and any melting viscosity can be appropriately selected depending on the purpose. The melting viscosity is preferably 5 cps to 1,000 cps and more preferably 10 cps to 100 cps, when measured at a temperature higher by 20° C. than the melting point of the wax. Where the melting viscosity is less than 5 cps, the mold releasability may be lowered. Where the melting viscosity exceeds 1,000 cps, there may be provided no effect on improving the hot offset resistance or the lower-temperature fixing property.

There is no particular restriction on content of the mold releasing agent in the toner, and any content can be appropriately selected depending on the purpose. The content is preferably 40% by mass or less, and more preferably 3% by mass to 30% by mass. Where the content exceeds 40% by mass, the flowability of toner may be deteriorated.

<<Charge Control Agent>>

There is no particular restriction on the charge control agent, and any charge control agent can be appropriately selected from known agents, depending on the purpose. Since the use of colored materials may change the color tone, it is preferable to use a material which is colorless or close to white. The above-described charge control agent includes, for example, triphenylmethane-based dye, molybdic acid chelate pigment, rhodamine-based dye, alkoxy amine, quaternary ammonium salt (including fluorine modified quaternary ammonium salt), alkyl amide, a single body of phosphorous or its compound, a single body of tungsten or its compound, fluorine activator, a metal salt of salicylic acid, and a metal acid of salicylic acid derivative. They may be used solely or in combination of two or more of them.

The charge control agent may include a commercially available product. The commercially available product includes, for example, Bontron P-51 (quaternary ammonium salt), E-82 (oxynaphthoic acid metal complex), E-84 (salicylic acid metal complex), E-89 (phenol condensation product) (all of which are made by Orient Chemical Industries Ltd.), TP-302, TP-415 (quaternary ammonium salt molybdenum complex) (both of which are made by Hodogaya Chemical Co., Ltd.), Copy Charge PSY VP2038 (quaternary ammonium salt), Copy Blue PR (triphenylmethane derivative), Copy Charge NEG VP2036 and Copy Charge NX VP434 (quaternary ammonium salt) (all of which are made by Hoechst AG); LRA-901 and LR-147 (boron complex) (Japan Carlit Co., Ltd.); quinacridone, azo pigment, and other polymeric compounds having a functional group such as a sulfonic group, carboxyl group and quaternary ammonium salt.

The charge control agent may be dissolved or dispersed after being melted and kneaded together with the master batch, added together with individual components of the toner on dissolution and dispersion, or fixed to the surface of the production toner after production toner particles.

A content of the charge control agent in the toner varies depending on types of the binding resin, the presence or absence of additives and a dispersion method, and cannot be defined in the same manner. The content is preferably, for example, 0.1 parts by mass to 10 parts by mass with respect to 100 parts by mass of the binding resin, and more preferably 0.2 parts by mass to 5 parts by mass. Where the content is less than 0.1 parts by mass, there is a case that no electrostatic charge control may be obtained. Where the content exceeds 10 parts by mass, there is a case that the toner may be excessively large in charging property to reduce the effect of a main charge control agent, thus resulting in an increased electrostatic suction force with a developing roller, thereby reducing the flowability of a developer and the density of an image.

<<External Additive>>

There is no particular restriction on the external additive, and any external additive can be appropriately selected depending on the purpose. The external additive includes, for example, silica fine particles, silica fine particles which have been hydrophobized, aliphatic acid metal salt (for example, zinc stearate and aluminum stearate); metal oxide (for example, titanium oxide, alumina, tin oxide and antimony oxide), metal oxide fine particles which have been hydrophobized, and fluoropolymer. Of these substances, silica fine particles which have been hydrophobized, titanium oxide fine particles which have been hydrophobized and alumina fine particles which have been hydrophobized are preferably used.

The silica fine particles include, for example, HDK H 2000 HDK H 2000/4, HDK H 2050EP, HVK21, and HDK H1303 (all of which are made by Hoechst AG); R972, R974, RX200, RY200, R202, R805, R812 (all of which are made by Nippon Aerosil Co., Ltd.). Further, the titanium oxide fine particles include, for example, P-25 (Nippon Aerosil Co., Ltd.), STT-30, STT-65C-S (both of which are made by Titan Kogyo Ltd.), TAF-140 (Fuji Titanium Industry Co., Ltd.), MT-150W, MT-500B, MT-600B and MT-150A (all of which are made by Tayca Corporation). The titanium oxide fine particles which have been hydrophobized include, for example, T-805 (made by Nippon Aerosil Co., Ltd.); STT-30A, STT-65S-S (both of which are made by Titan Kogyo Ltd.); TAF-500T, TAF-1500T (both of which are made by Fuji Titanium Industry Co., Ltd.); MT-100S, MT-100T (both of which are made by Tayca Corporation), and IT-S (made by Ishihara Sangyo Kaisha Ltd.).

The silica fine particles which have been hydrophobized, the titanium oxide fine particles which have been hydrophobized and the alumina fine particles which have been hydrophobized can be obtained by treating hydrophilic fine particles such as silica fine particles, titanium oxide fine particles and alumina fine particles with silane coupling agents such as methyl trimethoxysilane, methyl triethoxysilane and octyl trimethoxysilane.

Further, as the external additive, also preferable are silicone oil-treated inorganic fine particles which are obtained by treating inorganic fine particles with silicone oil, if necessary, by heating.

The silicone oil includes, for example, dimethyl silicone oil, methylphenyl silicone oil, chlorphenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl- or methacryl-modified silicone oil, and α-methyl styrene-modified silicone oil.

The inorganic fine particles include, for example, silica, alumina, titanium oxide, barium titanate, magnesium titanate, calcium titanate, strontium titanate, iron oxide, copper oxide, zinc oxide, tin oxide, silicon sand, clay, mica, wollastonite, diatomaceous earth, chrome oxide, ceric oxide, red iron oxide, antimony trioxide, magnesium oxide, zirconium oxide, barium sulfate, barium carbonate, calcium carbonate, silicon carbide and silicon nitride. Of these substances, silica and titanium dioxide are particularly preferable.

There is no particular restriction on an added quantity of the external additive, and any quantity can be appropriately selected depending on the purpose. The external additive is added to the toner preferably 0.1% by mass to 5% by mass, and more preferably 0.3% by mass to 3% by mass.

There is no particular restriction on the number-average particle diameter of primary particles in the inorganic fine particles, and any number-average particle diameter can be appropriately selected depending on the purpose. The number-average particle diameter is preferably 100 nm or less, and more preferably 3 nm to 70 nm. Where the number-average particle diameter is less than 3 nm, inorganic fine particles are buried into the toner and may not effectively function. Where the number-average particle diameter exceeds 100 nm, the surface of an electrostatic latent image bearing member may be damaged unevenly.

As the external additive, the inorganic fine particles or the inorganic fine particles which have been hydrophobized can be used in combination. There is no particular restriction on the number-average particle diameter of primary particles which have been hydrophobized, and any number-average particle diameter can be appropriately selected depending on the purpose. The number-average particle diameter is preferably 1 nm to 100 nm. It is more preferable to contain at least two or more types of inorganic fine particles with the diameter of 5 nm to 70 nm. Further, it is more preferable to contain at least two or more types of inorganic fine particles in which the number-average particle diameter of primary particles which have been hydrophobized is 20 nm or less and also to contain at least one type of inorganic fine particles in which the number-average particle diameter is 30 nm or more. Still further, there is no particular restriction on a specific surface area by the BET method, and any specific surface area can be appropriately selected depending on the purpose. The specific surface area is preferably 20 $m^2/g$ to 500 $m^2/g$.

There is no particular restriction on a surface treatment agent of the external additive containing the oxide fine particles, and any surface treatment agent can be appropriately selected depending on the purpose. The surface treatment agent includes, for example, silane coupling agents such as dialkyldihalogenated silane, trialkylhalogenated silane, alkyltrihalogenated silane and hexaalkyldisilazane, a silylation agent, a silane coupling agent having a fluorinated alkyl group, an organic titanate-based coupling agent, an aluminum-based coupling agent, silicone oil, and silicone varnish.

Fine resin particles are also added as the external additive. These fine resin particles include, for example, polystyrene obtained by soap-free emulsion polymerization, suspension polymerization and dispersion polymerization; a methacrylic acid ester, acrylic acid ester copolymer; polycondensation system polymer particles such as silicone, benzoguanamine and nylon; polymerization particles of a thermosetting resin. These fine resin particles are used in combination, by which it is possible to strengthen the charging property of toner, reduce reversely-charged toner and reduce scumming.

There is no particular restriction on an added quantity of the fine resin particles, and any added quantity can be appropriately selected depending on the purpose. The fine resin particles are preferably added to the toner at 0.01% by mass to 5% by mass and more preferably at 0.1% by mass to 2% by mass.

<<Flowability Improver>>

The flowability improver is that which is increased in hydrophobic property by surface treatment of the toner so as to prevent deterioration in flow characteristics and charge characteristics of the toner at high humidity. The improver includes, for example, a silane coupling agent, a silylation agent, a silane coupling agent having a fluorinated alkyl group, an organic titanate-based coupling agent, an aluminum coupling agent, silicone oil and modified silicone oil.

<<Cleaning Improver>>

The cleaning improver is added to the toner to remove a developer remaining in an electrostatic latent image bearing member and an intermediate transfer body after transfer procedures, including, for example, aliphatic acid metal salts such as zinc stearate, calcium stearate, and stearic acid; polymer fine particles produced by soap-free emulsion polymerization such as polymethyl methacrylate fine particles and polystyrene fine particles. It is preferable that the polymer fine particles are relatively narrow in particle size distribution, with the volume average particle diameter ranging from 0.01 μm to 1 μm.

[Characteristics of Toner]

There is no particular restriction on conditions under which the toner of the present invention attains the lower-temperature fixing property and heat-resistant storage stability simultaneously at a higher level and is excellent in hot offset resistance, and any conditions can be appropriately selected depending on the purpose. Where a maximum peak temperature of fusion heat of the toner measured by a differential scanning calorimeter is given as Ta (° C.) and a softening temperature measured by a constant-load orifice-type flow tester is given as Tb (° C.), it is desired to satisfy a relationship of $45 \leq Ta \leq 70$, $0.8 \leq Tb/Ta \leq 1.55$, and where a storage elastic modulus of the toner at (Ta+20)° C. is given as G' (Ta+20) (Pa·s), and a loss elastic modulus (Ta+20)° C. is given as G" (Ta+20) (Pa·s), it is preferable to satisfy a relationship of $1.0\times10^3 \leq G'$ (Ta+20)$\leq 5.0\times10^6$, $1.0\times10^3 \leq G''$ (Ta+20)$\leq 5.0\times10^6$.

There is no particular restriction on a maximum peak temperature of fusion heat (Ta) of the toner, and any maximum peak temperature of fusion heat can be appropriately selected depending on the purpose. The maximum peak temperature of fusion heat is preferably 45° C. to 70° C., more preferably 53° C. to 65° C., and in particular preferably 58° C. to 62° C. Where the Ta is 45° C. to 70° C., it is possible to secure a minimum heat-resistant storage stability required by the toner and also obtain the toner with the lower-temperature fixing property which is not found in a conventional toner. Where the Ta is lower than 45° C., the toner may be increased in lower-temperature fixing property but lowered in heat-resistant storage stability. Where the Ta exceeds 70° C., the toner may be increased in heat-resistant storage stability but lowered in lower-temperature fixing property.

There is no particular restriction on a ratio of the softening temperature (Tb) of toner to the maximum peak temperature of fusion heat (Ta), and any ratio can be appropriately selected depending on the purpose. The ratio is preferably 0.8 to 1.55, more preferably 0.85 to 1.25, in particular preferably 0.9 to 1.2, and most preferably 0.9 to 1.19. A resin will soften more abruptly as the Tb becomes smaller, which is excellent in terms of attaining the lower-temperature fixing property and the heat-resistant storage stability at the same time.

[Toner Producing Method]

The toner of the present invention is a toner for electrophotography containing a crystalline resin, a non-crystalline resin and a colorant. The toner for electrophotography is that in which the colorant is a pigment in which a crystalline polyester resin obtained by copolymerization of a non-crystalline polyester resin is used as a surface-treating resin to give surface treatment and the surface-treating resin is poorly soluble in an ethyl acetate solution, as will be defined below. There is no particular restriction on a method and materials thereof as long as they satisfy conditions, and any known method and materials can be used. There are available, for example, a kneading grinding method and a so-called chemical process in which toner particles are granulated in an aqueous medium. The chemical process is preferable because the process is able to attain easy granulation of crystalline resin and by which a pigment can be easily and uniformly dispersed into a toner.

There is no particular restriction on a chemical process in which toner particles are granulated in an aqueous medium, and any chemical process can be appropriately selected depending on the purpose. The chemical process includes, for example, a suspension polymerization method, an emulsion polymerization method, a seed polymerization method and a dispersion polymerization method in which a monomer is used as a starting material to produce a toner; a dissolution suspension method in which a resin or a resin precursor is dissolved in an organic solvent to effect dispersion or emulsification in an aqueous medium; a phase inversion emulsification method in which phase inversion is allowed to take place by adding water to a solution composed of a resin, a resin precursor and an appropriate emulsifying agent; and an aggregation method in which resin particles obtained by any of the above-described methods are aggregated in a state of being dispersed in an aqueous medium and granulated into particles with a desired size by heating, melting or others. Of these methods, a toner produced by the dissolution suspension method is preferable in terms of granulation property due to a crystalline resin (easiness of controlling particle size distribution and particle configuration) and orientation of a pigment in the vicinity of the surface layer of the toner.

Hereinafter, a detailed description will be given of these producing methods.

The kneading grinding method is a method for producing base particles of the toner by procedures in which, for example, a toner material containing at least the colorant and the binding resin is melted and kneaded, and the thus obtained resultant is ground and classified.

In the melting and kneading, the toner material is mixed and the thus obtained mixture is fed into a melting and kneading machine and then subjected to melting and kneading. The melting and kneading machine includes, for example, a monoaxial or a biaxial continuous-type kneader and a batch-type kneader equipped with a roll mill. Preferably used are, for example, a KTK-type biaxial extruder made by Kobe Steel Ltd., a TEM-type extruder made by Toshiba Machine Co. Ltd., a biaxial extruder made by KCK Ceramic Capacitors Ltd., a PCM-type biaxial extruder made by Ikegai Corp., and a co-kneader made by Buss AG. It is preferable that the melting and kneading are operated under appropriate conditions that will not cause cutoff of molecular chains of a binding resin. To be more specific, a melting and kneading temperature is set by referring to a softening point of the binding resin, and where the temperature is much higher than the softening point, the chains may be cut off greatly, and where the temperature is much lower, no dispersion may proceed.

In the above-described grinding, a kneaded product obtained by the kneading is ground. In the grinding, it is preferable that the kneaded product is first crudely ground and then finely ground. In this case, preferably used is a method in which the product is ground by collision with a collision board in a jet stream, ground by allowing particles to collide together in the jet stream or ground at a narrow gap between a mechanically rotating rotor and a stator.

In the above-described classification, a ground product obtained by the grinding is classified and adjusted to particles with a predetermined particle diameter. The classification can be carried out by removing fine particle portions with the use of a cyclone, a decanter, a centrifugal machine or the like.

After completion of the grinding and classification, the ground product is classified in an air current by a centrifugal force or the like, thus making it possible to produce toner base particles with a predetermined particle diameter.

There is no particular restriction on the chemical process, and any chemical process can be appropriately selected depending on the purpose. Preferable is a method in which a toner composition containing at least the crystalline resin, the non-crystalline resin and the colorant is dispersed or emulsified in an aqueous medium to granulate the toner base particles. The toner of the present invention is preferably a toner which is obtained by dispersing or emulsifying fine particles containing at least the binding resin and the colorant in an aqueous medium to granulate toner particles.

Further, as the chemical process, preferable is a method in which an oil phase obtained by dissolving or dispersing in an organic solvent a toner composition containing at least one of the binding resin and the binding resin precursor and also containing the colorant is dispersed or emulsified in an aqueous medium to granulate the toner base particles. As the toner of the present invention, preferable is a toner obtained by procedures in which an oil phase which is obtained by dissolving or dispersing in an organic solvent a toner composition containing at least one of the binding resin and the binding resin precursor and also containing the colorant is dispersed or emulsified in an aqueous medium to granulate toner particles.

Since the crystalline resin is excellent in shock resistance, it is not suitably used in a grinding process in terms of energy efficiency. On the other hand, a dissolution suspension method and an ester elongation method used in the present invention are able to easily granulate the crystalline resin. This is preferable in that the colorant is arrayed uniformly inside the toner on dispersion or emulsification in an aqueous medium.

There is no particular restriction on a method for producing fine resin particles containing at least the binding resin, and any method can be appropriately selected depending on the purpose. The method includes, for example, the following (a) to (h);

(a) a method in which in the case of the vinyl resin, monomer is used as a starting material, polymerization reaction is conducted by any method selected from suspension polymerization method, emulsion polymerization method, seed polymerization method, and dispersion polymerization method to directly produce an aqueous dispersion of fine resin particles, (b) a method in which in the case of polyaddition or condensation resins such as the polyester resin, polyurethane resin and epoxy resin, a precursor (monomer, oligomer and others) or a solvent solution thereof is dispersed in an aqueous medium in the presence of an appropriate dispersing agent, and then cured by heating or addition of a curing agent, thereby producing an aqueous dispersion of fine resin particles, (c) a method in which in the case of polyaddition or condensation resins such as the polyester resin, polyurethane resin and epoxy resin, an appropriate emulsifying agent is dissolved in a precursor (monomer, oligomer or the like) or in a solvent solution thereof (preferably in a liquid or changed into a liquid by heating) and, then, water is added to effect phase inversion emulsification, (d) a method in which a resin previously prepared by polymerization reaction (any type of polymerization reaction is acceptable such as addition polymerization, ring-opening polymerization, polyaddition, addition condensation and condensation polymerization) is ground by using a mechanical rotation-type or jet-type pulverizer, and then classified to obtain fine resin particles, which are thereafter dispersed in water in the presence of an appropriate dispersing agent, (e) a method in which a resin previously prepared by polymerization reaction (any type of polymerization reaction is acceptable such as addition polymerization, ring-opening polymerization, polyaddition, addition condensation and condensation polymerization) is dissolved in a solvent to give a resin solution, which is sprayed in a mist form to obtain fine resin particles, thereafter, the fine resin particles are dispersed in water in the presence of an appropriate dispersing agent, (f) a method in which a resin previously prepared by polymerization reaction (any type of polymerization reaction is acceptable such as addition polymerization, ring-opening polymerization, polyaddition, addition condensation and condensation polymerization) is dissolved in a solvent to give a resin solution, to which a solvent is added, or a resin solution previously dissolved in a solvent by heating is cooled to precipitate fine resin particles, then, the solvent is removed to obtain fine resin particles, and thereafter the fine resin particles are dispersed in water in the presence of an appropriate dispersing agent, (g) a method in which a resin previously prepared by polymerization reaction (any type of polymerization reaction is acceptable such as addition polymerization, ring-opening polymerization, polyaddition, addition condensation and condensation polymerization) is dissolved in a solvent to give a resin solution, the resin solution is dispersed in an aqueous medium in the presence of an appropriate dispersing agent, and thereafter the solvent is removed by heating or under reduced pressure, and (h) a method in which a resin previously prepared by polymerization reaction (any type of polymerization reaction is acceptable such as addition polymerization, ring-opening polymerization, polyaddition, addition condensation and condensation polymerization) is dissolved in a solvent to give a resin solution, and an appropriate emulsifying agent is dissolved in the resin solution, and thereafter water is added to effect phase inversion emulsification.

Further, on emulsification or dispersion in the aqueous medium, it is possible to use a surface active agent, a high-polymer protective colloid and others, as appropriate.

—Surface Active Agent—

There is no particular restriction on the surface active agents, and any surface active agent can be appropriately selected depending on the purpose. The surface active agents include, for example, anionic surface active agents such as alkyl benzene sulfonate, α-olefin sulfonate and phosphorate ester; amine salt-based cationic surface active agents such as alkyl amine salt, amino-alcohol aliphatic acid derivative, polyamine aliphatic acid derivative and imidazoline, and quaternary ammonium salt-based cationic surface active agents such as alkyl trimethyl ammonium salt, dialkyl dimethyl ammonium salt, alkyldimethyl benzyl ammonium salt, pyridinium salt, alkyl isoquinolinium salt and benzetonium chloride; nonionic surface active agents such as an aliphatic acid amide derivative and a polyalcohol derivative; and ampholytic surface active agents such as alanine, dodecydi (aminoethyl)glycine, di(octyl aminoethyl)glycine, and N-alkyl-N,N-dimethyl ammonium betaine.

Further, a surface active agent having a fluoroalkyl group can be used to provide a great effect in a very small quantity. The surface active agent having a fluoro alkyl group includes, for example, an anionic surface active agent with a fluoroalkyl group and a cationic surface active agent with a fluoroalkyl group.

There is no particular restriction on the anionic surface active agent having a fluoroalkyl group, and any anionic surface active agent can be appropriately selected depending on the purpose. The anionic surface active agent includes, for example, fluoro alkyl carboxylic acid with the carbon number of 2 to 10 and its metal salt, disodium perfluorooctane sulfonyl glutamate, sodium 3-[ω-fluoroalkyl(carbon number of 6 to 11)oxy]-1-alkyl(carbon number of 3 to 4)sulfonate, sodium 3-[ω-fluoroalkanoyl(carbon number of 6 to 8)-N-ethylamino]-1-propane sulfonate, fluoroalkyl(carbon number of 11 to 20)carboxylic acid and its metal salt, parfluoroalkyl carboxylic acid (carbon number of 7 to 13) and its metal salt, parfluoroalkyl(carbon number of 4 to 12)sulfonic acid and its metal salt, perfluorooctane sulfonic acid diethanolamide, N-propyl-N-(2-hydroxyethyl) perfluorooctane sulfonamide, perfluoroalkyl(carbon number of 6 to 10)sulfonamide propyltrimethyl ammonium salt, perfluoro alkyl(carbon number of 6 to 10)-N-ethylsulfonyl glycine salt, and monoperfluoro alkyl(carbon number of 6 to 16)ethylphosphate ester.

There is no particular restriction on the cationic surface active agent having a fluoro alkyl group, and any cationic surface active agent can be appropriately selected depending on the purpose. The cationic surface active agent includes, for example, aliphatic primary or secondary amino acid having a fluoro alkyl group, aliphatic quaternary ammonium salt such as perfluoroalkyl(carbon number of 6 to 10)sulfonamide propyl trimethyl ammonium salt, benzalkonium salt, benzetonium chloride, pyridium salt, and imidazolinium salt.

—High Polymer Protective Colloid—

There is no particular restriction on the high polymer protective colloid, and any high polymer protective colloid can be appropriately selected depending on the purpose. The high polymer protective colloid includes, for example, acids such as acrylic acid, methacrylic acid, α-cyanoacrylic acid, α-cyanomethacrylic acid, itaconic acid, crotonic acid, fumaric acid, maleic acid, and anhydrous maleic acid; (meth)acryl monomers having a hydroxyl group such as acrylic acid β-hydroxyethyl, methacrylic acid β-hydroxyethyl, acrylic acid β-hydroxypropyl, methacrylic acid β-hydroxypropyl, acrylic acid γ-hydroxypropyl, methacrylic acid γ-hydroxypropyl, acrylic acid 3-chloro-2-hydroxypropyl, methacrylic acid 3-chloro-2-hydroxypropyl, diethylene glycol monoacrylic acid ester, diethylene glycol monomethacrylic acid ester, glycerine monoacrylic acid ester, glycerine monomethacrylic acid ester, N-methylolacrylamide, N-methylolmethacrylamide; vinyl alcohol; ethers with vinyl alcohol such as vinylmethyl ether, vinylethyl ether and vinylpropyl ether; esters of compounds having vinyl alcohol and a carboxyl group such as vinyl acetate, vinyl propionate and vinyl butyrate; acrylamide, methacrylamide, diacetone acrylamide, and methylol compounds thereof; acid chlorides such as acrylic acid chloride, and methacrylic acid chloride; a homopolymer or a copolymer having nitrogen atom or heterocyclic ring thereof such as vinyl pyridine, vinyl pyrolidone, vinyl imidazole, ethylene imine; polyoxyethylenes such as polyoxyethylene, polyoxypropylene, polyoxyethylene alkyl amine, polyoxypropylene alkyl amine, polyoxyethylene alkyl amide, polyoxypropylene alkyl amide, polyoxyethylenenonylphenyl ether, polyoxyethylene laurylphenyl ether, polyoxyethylenestearyl phenyl ester, polyoxyethylene nonylphenyl ester; and celluloses such as methyl cellulose, hydroxyethyl cellulose and hydroxypropyl cellulose.

—Organic Solvent—

An organic solvent used in dissolving or dispersing a toner composition containing the binding resin, the binding resin precursor, the colorant, and the organic modified-layer like inorganic mineral is preferably volatile, with a boiling point of less than 100° C., in terms of easy subsequent removal of a solvent.

The organic solvent includes, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. They may be used solely or in combination of two or more of them. Of these substances, preferable are ester-based solvents such as methyl acetate and ethyl acetate; aromatic solvents such as toluene and xylene; halogenated hydrocarbon such as methylene chloride, 1,2-dichloroethane, chloroform and carbon tetrachloride.

A concentration on a dry solid basis of an oil phase which is obtained by dissolving or dispersing a toner composition containing the binding resin, the binding resin precursor, the colorant and the organic modified-layer like inorganic mineral is preferably 40% by mass to 80% by mass. Where the concentration is excessively high, the oil phase is hard to dissolve or disperse. Further, the oil phase is increased in viscosity and handled with difficulty. Where the concentration is excessively low, toner is produced in a smaller quantity.

Toner compositions such as the colorant and the organic modified-layer like inorganic mineral other than a resin as well as a master batch thereof may be individually dissolved or dispersed in an organic solvent and mixed with the resin solution or dispersion solution.

—Queous Medium—

Water may be solely used as the aqueous medium but a solvent miscible with water can be used in combination. There is no particular restriction on the solvent miscible with water, and any solvent can be appropriately selected depending on the purpose. The solvent includes, for example, alcohols (such as methanol, isopropanol and ethylene glycol), dimethyl formamide, tetrahydrofuran, cellosolves (such as methyl cellosolve), and lower ketones (such as acetone and methyl ethyl ketone).

There is no particular restriction on content of the aqueous medium used in the toner composition of 100 parts by mass, and any content can be appropriately selected depending on the purpose. The content is preferably 50 parts by mass to 2,000 parts by mass and more preferably 100 parts by mass to 1,000 parts by mass. Where the content is less than 50 parts by mass, the toner composition is poor in dispersion, resulting in a failure of obtaining toner particles with a predetermined particle diameter. Further, where the content exceeds 2,000 parts by mass, the toner particles cannot be economically produced.

An inorganic dispersing agent or organic fine resin particles may be previously dispersed in the aqueous medium, which makes particle size distribution sharp. This is also preferable in terms of stable dispersion.

There is no particular restriction on the inorganic dispersing agent, and any inorganic dispersing agent can be appropriately selected depending on the purpose. The inorganic dispersing agent includes, for example, tricalcium phosphate, calcium carbonate, titanium oxide, colloidal silica, and hydroxyapatite.

Any resin which is capable of forming an aqueous dispersion body can be used as a resin which forms the organic fine resin particles, including a thermoplastic resin and a thermosetting resin. The resin includes, for example, vinyl resin, polyurethane resin, epoxy resin, polyester resin, polyamide resin, polyimide resin, silicon resin, phenol resin, melamine resin, urea resin, aniline resin, ionomer resin and polycarbonate resin. They may be used solely or in combination of two or more of them. Of these resins, preferably used are vinyl resin, polyurethane resin, epoxy resin, polyester resin or in combination of them, in terms of easily obtaining an aqueous dispersion body of micro-spherical resin particles.

There is no particular restriction on a method for emulsification or dispersion in an aqueous medium, and any method can be appropriately selected depending on the purpose. Applicable is any known equipment which is low-speed shearing, high-speed shearing, friction, high-pressure jet or supersonic types. Of the equipment, high-speed shearing equipment is preferable in terms of making particles with a small diameter.

Where a high-speed shearing dispersion machine is used, there is no particular restriction on the number of rotations, and any number of rotations can be appropriately selected depending on the purpose. The number of rotations is preferably 1,000 rpm to 30,000 rpm and more preferably 5,000 rpm to 20,000 rpm. There is no particular restriction on a temperature on dispersion, and any temperature can be appropriately selected depending on the purpose. The temperature is preferably 0° C. to 150° C. (under pressure), and more preferably 20° C. to 80° C.

Where the toner composition contains the binding resin precursor, the compound having an active hydrogen group which is required for the binding resin precursor to undergo elongation or crosslinking reaction may be previously mixed in an oil phase before the toner composition is dispersed in an aqueous medium or may be mixed in an aqueous medium.

Any known method can be employed to remove the organic solvent from the thus obtained emulsified dispersion product. There can be adopted, for example, a method in which a whole system is gradually heated under normal or reduced pressure to completely evaporatively remove an organic solvent in droplets.

Where an aggregation method is used in the aqueous medium, a dispersion of fine resin particles, a dispersion of colorant and a dispersion of organic modified-layer like inorganic mineral obtained by the above-described method and, if necessary, a dispersion of mold releasing agent are mixed to effect aggregation simultaneously, thereby carrying out granulation. The dispersion of fine resin particles may be used solely, or two or more types of dispersions of fine resin particles may be added. They may be added once or added several times separately. The other dispersions may be used in a similar manner.

An aggregation state is preferably controlled by a method in which, for example, heat is applied, a metal salt is added or pH is adjusted.

There is no particular restriction on the metal salt. The metal salt includes, for example, a monovalent metal which constitutes salt such as sodium or potassium: a divalent metal which constitutes salt such as calcium or magnesium; a trivalent metal which constitutes salt such as aluminum.

Anions which constitute the above-described salts include, for example, chloride ion, bromide ion, iodide ion, carbonate ion and sulfate ion. Of these substances, preferable are magnesium chloride, aluminum chloride, a complex thereof and a multimer thereof.

Further, heating is done during aggregation or after completion of aggregation, by which fusion of fine resin particles can be accelerated. This is preferable in terms of uniformity of a toner. Still further, the configuration of the toner can be controlled by heating. In most cases, greater heating makes the toner closer to a spherical form.

A step of washing and drying base particles of a toner dispersed in an aqueous medium is carried out by using known technologies.

That is, after a centrifugal machine or a filter press is used to effect solid-liquid separation, thus obtained toner cake is dispersed again in ion-exchanged water at a normal temperature of approximately 40° C. and acid or alkali is used to adjust pH of the cake, if necessary, thereby effecting solid-liquid separation. This step is repeated several times to remove impurities and a surface active agent and, thereafter, drying is carried out by using a flash dryer, a circulation dryer, a vacuum dryer, a vibration fluidized dryer or the like to obtain toner powder. In this case, centrifugation may be carried out to remove fine particle components of the toner. Further, any known classifier may be used to obtain desired particle-diameter distribution after drying, if necessary.

Figure 5:
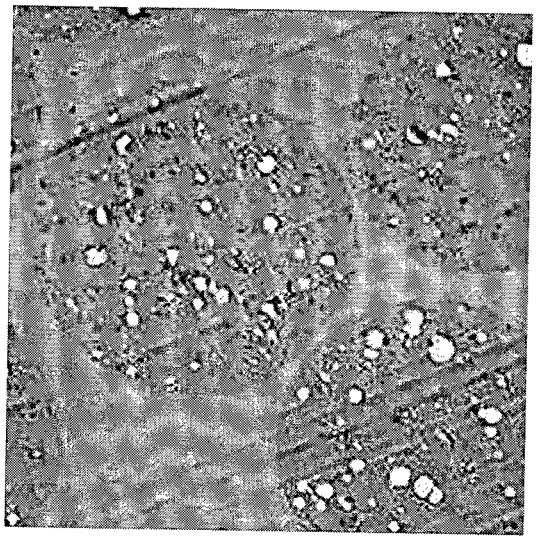
FIG. 5 is a view which shows one example of a cross section of a toner of the present invention.
Figure 6:
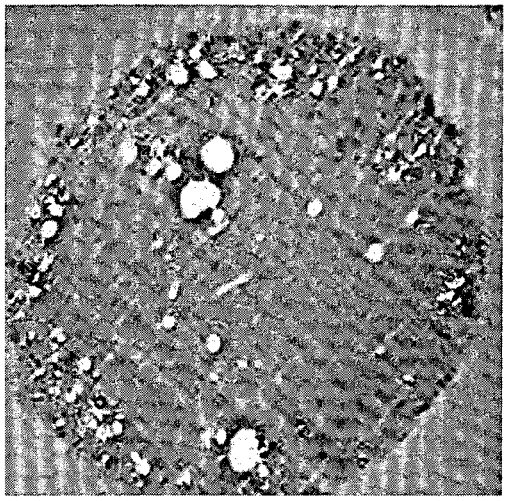
FIG. 6 is a view which shows one example of a cross section of a toner of a comparative example.

FIG. 5 is a microphotograph which shows a cross section of the toner. In FIG. 5, a black dot shows a pigment. It is noted that a white dot is a hole which is made inevitably on observation. FIG. 5 is a cross section view of the toner of the present invention, and the pigment is uniformly dispersed in the toner. Further, FIG. 6 is a cross section view of a toner as a comparative example in which a pigment is unevenly distributed on the surface of the toner.

Thus obtained toner powder after drying is mixed with different types of particles such as the electrostatic charge control fine particles and plasticizer fine particles, or a mechanical impact force is also applied to mixed powder. Thereby, the toner is fixed and fused on the surface, thus making it possible to prevent the different types of particles from being detached from the surface of the thus obtained complex particles.

Specific means include, for example, a method for applying an impact force to a mixture, for example, by using a blade rotating at a high speed and a method in which a mixture is fed into a high-speed air current and accelerated, by which particles are allowed to collide with other particles or complexed particles are allowed to collide against an appropriate collision board.

Devices used in the method include, for example, Ong mill (made by Hosokawa Micron Corporation), a modified device of the I-type mill (made by Nippon Pneumatic Mfg. Co., Ltd.) in which an air pressure for pulverization is reduced, Hybridization system (made by Nara Machinery Co., Ltd.), Criptron system (made by Kawasaki Heavy Industries Ltd.) and an automatic mortar.

(Developer)

A developer of the present invention contains the toner and also contains other components such as a bearing member appropriately selected, as appropriate.

The developer may be either a one-component developer or a two-component developer. When used in a high-speed printer suitable for improvements in information processing speeds in recent years, the two-component developer is preferable in terms of an extended service life.

In the one-component developer in which the above-described toner is used, even after the toner is balanced, that is, supply of the toner to the developer and consumption of the toner by development, the particle diameter of the toner varies less, there is no toner filming onto a developing roller nor toner fusing on a layer thickness-regulating member such as a blade for making the toner into thin layers. When the one-component developer is used (agitated) for a long time by a developing unit, there are provided favorable and stable developing properties and images.

Further, in the two-component developer in which the toner is used, even after the toner is balanced for a long time, the diameter of toner particles in the developer changes less, and there are also provided favorable and stable developing properties upon a prolonged agitation by the developing unit.

<Carrier>

There is no particular restriction on the carrier, and any carrier can be appropriately selected depending on the purpose. It is, however, preferable that the carrier has a core and a resin layer coating the core.

There is no particular restriction on the material of the core, and any material can be appropriately selected from known materials. Preferable are, for example, a manganese strontium (Mn—Sr) based material with 50 emu/g to 90 emu/g and a manganese magnesium (Mn—Mg) based material. In terms of securing the image density, preferable are highly magnetized materials such as iron powder (100 emu/g or more), magnetide (75 emu/g to 120 emu/g). In terms of being advantageous in attaining a high quality image by weakening the collision of toner against an electrostatic latent image bearing member at which the toner is raised, preferable are weakly magnetized materials such as copper-zinc (Cu—Zn) based material (30 emu/g to 80 emu/g). They may be used solely or in combination of two or more of them.

There is no particular restriction on the particle diameter of the core, and any particle diameter can be appropriately selected depending on the purpose. In terms of average particle diameter (volume average particle diameter (D50)), preferable is 10 μm to 200 μm and more preferable is 40 μm to 100 μm. Where the average particle diameter (volume average particle diameter (D50)) is less than 10 μm, there is a case that fine powders may be increased in distribution of carrier particles to lower magnetization per particle, thereby causing carrier scattering. Where the average particle diameter exceeds 200 μm, the specific surface area may be decreased to cause toner scattering, and in full color printing with a greater solid part, the solid part in particular may be poorly reproduced.

There is no particular restriction on the material of the resin layer, and any resin can be appropriately selected depending on the purpose. The resin includes, for example, amino resin, polyvinyl resin, polystyrene resin, halogenated olefin resin, polyester resin, polycarbonate resin, polyethylene resin, polyfluorinated vinyl resin, polyvinylidene fluoride resin, polytrifluoro ethylene resin, polyhexafluoro propylene resin, copolymer of vinylidene fluoride with acryl monomer, copolymer of vinylidene fluoride with vinyl fluoride, fluoro terpolymers (fluorinated tri(multi) copolymers) such as terpolymers of a non-fluorinated monomer with tetrafluoro ethylene and vinylidene fluoride, and silicone resin. They may be used solely or in combination of two or more of them. Of these resins, silicone resin is particularly preferable.

There is no particular restriction on the silicone resin, and any silicone resin can be appropriately selected from generally known silicone resins depending on the purpose. The silicon resin includes, for example, straight silicone resin composed of only an organosiloxane bond; and silicone resin modified with alkyd resin, polyester resin, epoxy resin, acryl resin, urethane resin or the like.

The silicone resin may include a commercially available product. The commercially available product includes, as the straight silicone resin, for example, KR271, KR255, KR152 (made by Shin-Etsu Chemical Co., Ltd.); and SR2400, SR2406, SR2410 (made by Dow Corning Toray Co., Ltd.).

As the modified silicone resin, commercially available products can be used, and the commercially available product includes, for example, KR206 (alkyd-modified), KR5208 (acryl-modified), ES1001N (epoxy-modified) and KR305 (urethane-modified) (made by Shin-Etsu Chemical Co., Ltd.); and SR2115 (epoxy-modified), and SR2110 (alkyd-modified) (made by Dow Corning Toray Co., Ltd.).

It is noted that the silicone resin can be used solely but also can be used together with a component which undergoes crosslinking reaction or a charge-regulating component.

The resin layer may include a conductive powder and others, as appropriate. The conductive powder includes, for example, metal power, carbon black, titanium oxide, tin oxide and zinc oxide. The average particle diameter of the conductive layer is preferably 1 μm or less. Where the average particle diameter of the conductive powder exceeds 1 μm, it may be difficult to control the electric resistance.

The resin layer can be formed by procedures in which, for example, the silicone resin or the like is dissolved in a solvent to prepare a coating solution, thereafter, the coating solution is coated uniformly on the surface of the core by a known coating method, the resultant is dried and printed. The coating method includes, for example, a dipping method, spray method and brush coating method.

There is no particular restriction on the solvent, and any solvent can be appropriately selected depending on the purpose. The solvent includes, for example, toluene, xylene, methyl ethyl ketone, methyl isobutyl ketone, cellosolve and butyl acetate.

There is no particular restriction on the printing, and printing by external heating or that by internal heating will do. The printing can be conducted, for example, by a method of using a stationary-type electric furnace, a fluid-type electric furnace, a rotary-type electric furnace, a burner or the like, or by a method of using a microwave.

There is no particular restriction on content of the carrier in the resin layer, and any content can be appropriately selected depending on the purpose. The content is preferably 0.01% by mass to 5.0% by mass. Where the content is less than 0.01% by mass, it may be impossible to form the resin layer uniformly on the surface of the core. Where the content exceeds 5.0% by mass, the resin layer may be made excessively thick to granulate between carriers, thus resulting in a failure in obtaining uniform carrier particles.

Where the developer is a two-component developer, there is no particular restriction on content of the carrier in the two-component developer, and any content can be appropriately selected depending on the purpose. The content is preferably, for example, 90% by mass to 98% by mass, and more preferably 93% by mass to 97% by mass.

There is no particular restriction on a ratio of mixing a toner with a carrier in the two component developer, and any ratio can be appropriately selected depending on the purpose. However, it is preferable that the toner of one part by mass to 10.0 parts by mass is mixed with the carrier of 100 parts by mass.

(Image Forming Apparatus)

The image forming apparatus of the present invention is provided with an electrostatic latent image bearing member, a charging unit which charges the surface of the electrostatic latent image bearing member, an exposure unit which exposes the charged electrostatic latent image bearing member surface to form an electrostatic latent image, a developing unit which develops the electrostatic latent image with a toner to form a visible image, a transfer unit which transfers the developed visible image on a recording medium to form an unfixed image and a fixing unit which fixes the unfixed image on the recording medium. The image forming apparatus is also provided with other units which are appropriately selected as appropriate, for example, a cleaning unit, a discharging unit, a recycling unit and a control unit.

The developing unit is a unit in which an electrostatic latent image is developed by using a toner to form a visible image and the toner is required to be the toner of the present invention.

It is noted that the charging unit and the exposure unit are from time to time collectively referred to as an electrostatic latent image forming unit. Further, the developing unit is provided with a magnetic-field generating unit which is fixed internally and a developer bearing member which is able to rotate, with the toner of the present invention being carried and supported.

<Electrostatic Latent Image Bearing Member>

There is no particular restriction on the material, configuration, structure, dimensions, or the like of the electrostatic latent image bearing member, and any of them can be appropriately selected depending on the purpose. The configuration includes, for example, a drum, a sheet and an endless belt. A single layer structure and a laminated structure may be acceptable as the structure. The size can be appropriately selected depending on the dimensions and specifications of the image forming apparatus. The material may include, for example, an inorganic photoconductor such as amorphous silicone, selenium, CdS and ZnO; an organic photoconductor (OPC) such as polysilane and phthalopolymethine.

<Charging Unit>

The charging unit is a unit which charges the electrostatic latent image bearing member surface.

There is no particular restriction on the charging unit, as long as it is able to apply voltages on the surface of the electrostatic latent image bearing member, thereby attaining a uniform charge. And, any charging unit can be appropriately selected depending on the purpose. The charging unit is largely categorized into (1) a contact-type charging unit which is in contact with the electrostatic latent image bearing member to cause charging and (2) a non-contact type charging unit which is not in contact with the electrostatic latent image bearing member to cause charging.

The contact-type charging unit (1) includes, for example, a conductive or semi-conductive charging roller, a magnetic brush, a fur brush, a film and a rubber blade. Of these substances, the charging roller is able to greatly reduce an ozone production quantity as compared with corona discharge, excellent in stability on repeated use of the electrostatic latent image bearing member and effective in preventing deterioration of an image.

The non-contact charging unit (2) includes, for example, a non-contact type electrification device or a needle electrode device which uses corona discharge, and a solid discharge element; a conductive or semi-conductive charging roller which is disposed so as to give a small clearance with respect to the electrostatic latent image bearing member.

<Exposure Unit>

The exposure unit is a unit which exposes the charged electrostatic latent image bearing member surface to form an electrostatic latent image.

There is no particular restriction on the exposure unit, as long as it is able to conduct exposure on the surface of the electrostatic latent image bearing member charged by the charging unit to an imagewise to be formed. Any exposure unit can be appropriately selected depending on the purpose, including, for example, various types of exposure devices such as a reproduction optical system, a rod lens array system, a laser optical system, a liquid crystal shutter optical system, and a LED optical system. Further, the present invention may adopt a back exposure method in which exposure is conducted to an imagewise from the back face of the electrostatic latent image bearing member.

<Developing Unit>

The developing unit is a unit in which the electrostatic latent image is developed by using a toner to form a visible image and the toner is required to be the toner of the present invention.

There is no particular restriction on the developing unit, as long as an image can be developed by using, for example, the toner. Any developing unit can be appropriately selected from known units. Preferable is, for example, a developing unit which accommodates the toner and has at least a developing unit capable of imparting the toner to the electrostatic latent image in contact or non-contact therewith.

The developing unit may include a dry-type developing unit, a wet-type developing unit, a single-color developing unit and a multi-color developing unit. Preferable is, for example, a developing device which is provided with an agitator of agitating frictionally the toner to effect charging and a developer bearing member which has a magnetic-field generating unit fixed internally and is able to rotate so as to carry and support a developer that contains the toner on the surface.

Inside the developing unit, for example, the toner and the carrier are mixed and agitated, and the toner is charged by the resulting friction, and kept raised on the surface of a rotating magnet roller, thereby forming a magnetic brush. Since the magnet roller is arranged in the vicinity of the electrostatic latent image bearing member, the toner constituting the magnetic brush formed on the surface of the magnet roller is partially moved to the surface of the electrostatic latent image bearing member due to an electrical suction force. As a result, the electrostatic latent image is developed by the toner and a visible image is formed on the surface of the electrostatic latent image bearing member by the toner.

Here, FIG. 1 is a schematic view which shows one example of a two-component developing device using a two-component developer composed of a toner and a magnetic carrier. In the two-component developing device shown in FIG. 1, the two-component developer is agitated and conveyed by a screw 441 and supplied to a developing sleeve 442 as a developer bearing member. The two-component developer supplied to the developing sleeve 442 is regulated by a doctor blade 443 which acts as a layer thickness regulating member. A quantity of the developer to be supplied is controlled by a doctor gap which is a clearance between the doctor blade 443 and the developing sleeve 442. Where the doctor gap is excessively small, the developer is excessively small in quantity to result in poor image density. Where the doctor gap is excessively large, the developer is supplied in an excessively great quantity, thereby causing carrier adhesion on a photosensitive drum 1 as the electrostatic latent image bearing member, which poses a problem. Therefore, the developing sleeve 442 is internally provided with a magnet as a magnetic-field generating unit which forms a magnetic field so as to raise the developer on a circumferential surface of the developing sleeve 442. The developer is raised in a chain-like fashion on the developing sleeve 442 so as to run along a magnetic line of force emitted from the magnet in a normal line direction, thereby forming a magnetic brush.

The developing sleeve 442 and the photosensitive drum 1 are arranged so as to come closer, with a certain clearance (developing gap) kept, thereby forming a developing region at a part where they oppose each other. The developing sleeve 442 is formed by making a non-magnetic body such as aluminum, brass, stainless steel or a conductive resin into a cylindrical shape and rotated by a rotating driving mechanism (not illustrated). The magnetic brush is transported to the developing region by rotation of the developing sleeve 442. A developing voltage is applied from a power source for development (not illustrated) to the developing sleeve 442. And, the toner on the magnetic brush is separated from the carrier due to a development electric field formed between the developing sleeve 442 and the photosensitive drum 1 and developed on the electrostatic latent image on the photosensitive drum 1. It is noted that alternative current may be superimposed on the developing voltage.

There is no particular restriction on the developing gap, and any developing gap can be appropriately selected depending on the purpose. The developing gap is preferably 5 times to 30 times greater in developer particle diameter. If the developer particle diameter is 50 μm, it is preferable that the developing gap is set to 0.25 mm to 1.5 mm. Where the developing gap is greater than the above, it may be difficult to obtain a favorable image density.

Further, it is preferable that the doctor gap is substantially equal to or slightly greater than the developing gap. The drum diameter and drum linear speed of the photosensitive drum 1 as well as the sleeve diameter and sleeve linear speed of the developing sleeve 442 are regulated depending on the reproduction speed and dimensions of the apparatus. A ratio of sleeve linear speed to drum linear speed is preferably 1.1 or more in order to obtain a necessary image density. It is also possible that a sensor is set at a position after development and toner is detected from an optical reflection coefficient to control adhesion process conditions.

<Transfer Unit>

The transfer unit is a unit in which the visible image is transferred to a recording medium.

The transfer unit is largely categorized into a transfer unit in which a visible image on an electrostatic latent image bearing member is directly transferred on a recording medium, and a secondary transfer unit in which an intermediate transfer body is used to primarily transfer a visible image on the intermediate transfer body and thereafter, the visible image is further secondarily transferred on a recording medium. There is no particular restriction on these transfer units, and any transfer unit can be appropriately selected from known transfer bodies, depending on the purpose.

<Fixing Unit>

The fixing unit is a unit which fixes an image transferred on the recording medium.

There is no particular restriction on the fixing unit, and any fixing unit can be appropriately selected depending on the purpose. Preferably used is a fixing device which is provided with a fixing member and a heat source for heating the fixing member. There is no particular restriction on the fixing members as long as they are in contact with each other to form a nip portion. Any fixing member can be appropriately selected depending on the purpose, including, for example, a combination of an endless belt with a roller and a combination of a roller with another roller. In terms of reducing warm-up time to save energy, preferably used is a combination of an endless belt with a roller or a heating method in which the surface of the fixing member is heated by induction heating or the like.

It is preferable that a recording medium is conveyed at a rate of 280 mm/second or more on fixing by the fixing unit.

As the fixing unit, included is either (1) a mode (internal heating method) in which a fixing unit is provided with at least one of a roller and a belt, heating is carried out from a face not in contact with a toner to heat and press an image transferred on a recording medium, thereby fixing the image, and (2) a mode (external heating method) in which a fixing unit is provided with at least one of a roller and a belt and heating is carried out from a face in contact with a toner to heat and press an image transferred on a recording medium, thereby fixing the image. It is also possible to use a combination of these modes.

The fixing unit used in the internal heating method (1) includes, for example, a fixing unit in which the fixing member itself has a heating unit thereinside. This type of heating unit includes, for example, a heat source such as a heater and a halogen lamp.

The fixing unit used in the external heating method (2) is preferably a mode in which, for example, the surface of at least one of the fixing members is at least partially heated by the heating unit. There is no particular restriction on this type of heating unit, and any heating unit can be appropriately selected depending on the purpose, including, for example, an electromagnetic induction heating unit. There is no particular restriction on the electromagnetic induction heating unit, and any electromagnetic induction heating unit can be appropriately selected depending on the purpose. It is preferable that the electromagnetic induction heating unit is that which is provided with a magnetic field generating unit and a unit generating heat by electromagnetic induction. The electromagnetic induction heating unit preferably includes, for example, a unit which is provided with an induction coil arranged so as to come closer to the fixing member (such as a heating roller), a shield layer on which the induction coil is installed, and an insulation layer installed on the side opposite to the face on which the induction coil of the shield layer is installed. In this case, the heating roller is preferably a mode which is composed of a magnetic body and a mode which is a heat pipe. The induction coil is preferably a coil which is arranged so as to enclose at least a semi-cylindrical part on the side opposite to a site of the heating roller in contact with the fixing member (such as a pressure roller and an endless belt).

<Other Units>

There is no particular restriction on the other units, and any other units can be appropriately selected depending on the purpose, including, for example, a cleaning unit, a discharging unit, a recycling unit and a control unit.

There is no particular restriction on the cleaning unit, and any cleaning unit can be used as long as it is able to remove a toner remaining on the electrostatic latent image bearing member. The cleaning unit can be appropriately selected from known cleaners, including, for example, a magnetic brush cleaner, an electrostatic brush cleaner, a magnetic roller cleaner, a cleaning blade, a brush cleaner and a web cleaner. Of these cleaners, particularly preferable is a cleaning blade which is high in toner removing performance, small in size and low in price.

A rubber blade used in the cleaning blade is preferably made of, for example, urethane rubber, silicone rubber, fluorinated rubber, chloroprene rubber and butadiene rubber. Of these substances, urethane rubber is particularly preferable.

There is no particular restriction on the discharging unit, and any discharging unit can be used as long as it is able to apply an antistatic bias to the electrostatic latent image bearing member and can be appropriately selected from any known antistatic devices. Preferable is, for example, a charge eliminating lamp.

The recycling unit is a unit in which the toner removed by the cleaning unit is recycled by the developing unit and including, for example, any known conveying unit.

There is no particular restriction on the control unit, as long as it is able to control motions of the various units. The control unit can be appropriately selected depending on the purpose and includes, for example, devices such as a sequencer and a computer.

Figure 2:
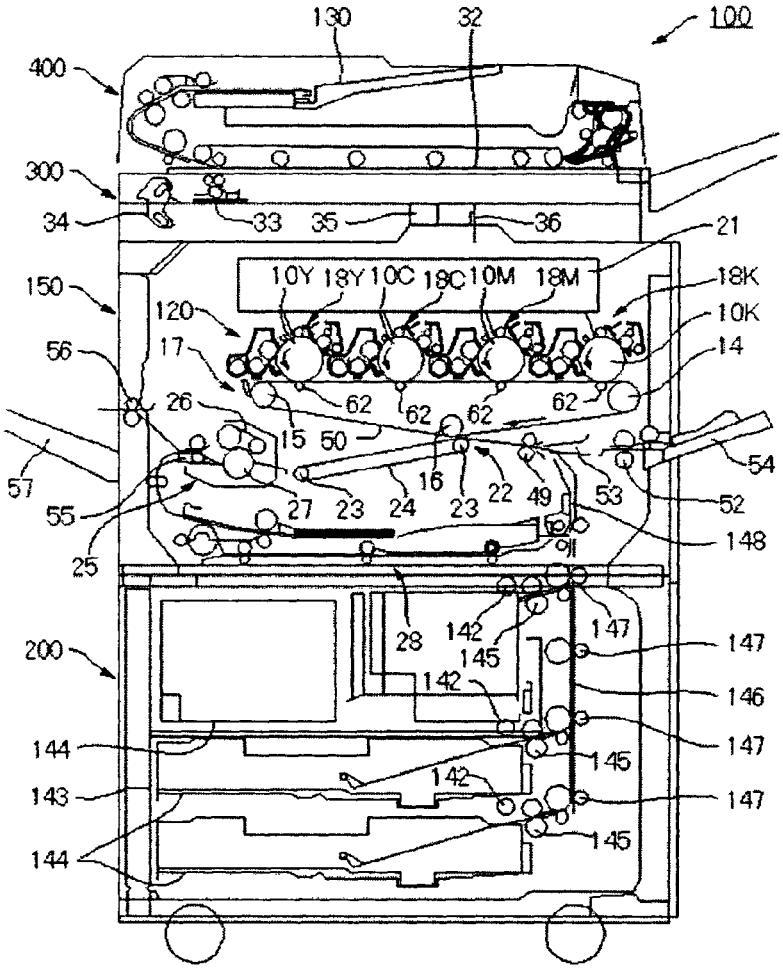
FIG. 2 is a schematic view which shows one example of the image forming apparatus of the present invention.

A description will be given of other modes which carry out an image forming method by using the image forming apparatus of the present invention with reference to FIG. 2. An image forming apparatus 100 shown in FIG. 2 is a tandem-type color image forming apparatus. The tandem image forming apparatus 100 is provided with a copier main body 150, a sheet feeding table 200, a scanner 300 and an automatic document feeder (ADF) 400.

The copier main body 150 is provided at the center with an endless-belt type intermediate transfer body 50. Then, the intermediate transfer body 50 is stretched by supporting rollers 14, 15 and 16 so as to be rotated in a clockwise direction, as shown in FIG. 2. An intermediate transfer body cleaning unit 17 for removing toner remaining on the intermediate transfer body 50 is arranged in the vicinity of the supporting roller 15. On the intermediate transfer body 50 stretched by the supporting roller 14 and the supporting roller 15, a tandem-type developing device 120 is arranged along its conveying direction in which four image forming units 18 (yellow, cyan, magenta and black) are juxtaposed opposedly. An exposure unit 21 is arranged in the vicinity of a tandem-type developing device 120. A secondary transfer unit 22 is arranged on the opposite side to the side at which the tandem-type developing device 120 is arranged on the intermediate transfer body 50. In the secondary transfer unit 22, a secondary transfer belt 24, which is an endless belt, is stretched by a pair of rollers 23. A recording medium conveyed on the secondary transfer belt 24 can be in contact with the intermediate transfer body 50. A fixing unit 25 is arranged in the vicinity of the secondary transfer unit 22.

It is noted that a sheet reversing device 28 for inverting the recording medium to form an image on both sides of the recording medium is arranged in the vicinity of the secondary transfer unit 22 and the fixing unit 25 of the tandem image forming apparatus 100.

Next, a description will be given of a full-color image formation (color copy) by using the tandem-type developing device 120. That is, first, documents are set on a document counter 130 of the automatic document feeder (ADF) 400, or the automatic document feeder 400 is opened to set documents on a contact glass 32 of the scanner 300 and the automatic document feeder 400 is closed.

Depression of a start switch (not illustrated) will actuate the scanner 300 after documents are conveyed and moved to the contact glass 32 when the documents are set on the automatic document feeder 400, whereas actuating the scanner immediately when the documents are set on the contact glass 32, thereby allowing a first traveling body 33 and a second traveling body 34 to travel. In this case, light from a light source is radiated from the first traveling body 33 and also light reflected from the surface of the documents is reflected on a mirror of the second traveling body 34, and received by a reading sensor 36 through an imaging lens 35, by which color documents (color images) are read to give image information of black, yellow, magenta and cyan.

Figure 3:
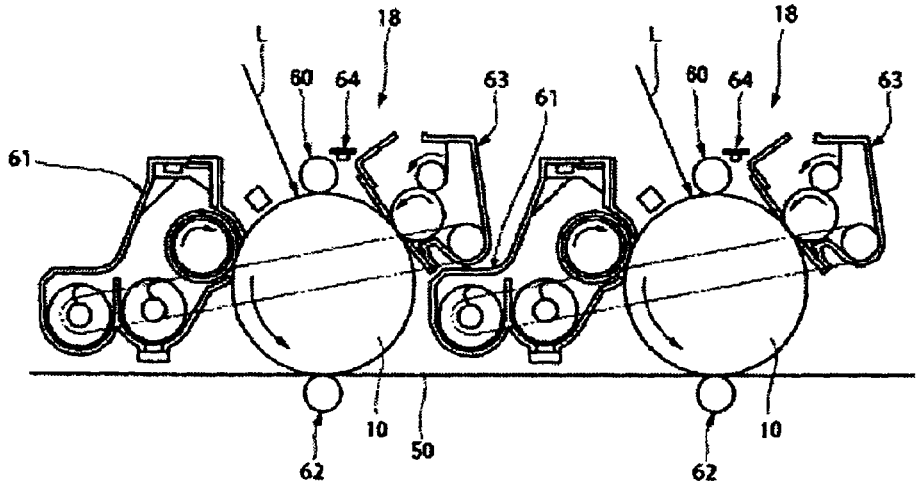
FIG. 3 is an enlarged view which shows one example of individual image forming elements shown in FIG. 2.

Then, image information of black, yellow, magenta and cyan is sent to each of the image forming units 18 (black image forming unit, yellow image forming unit, magenta image forming unit and cyan image forming unit) in the tandem-type developing device 120, thereby forming toner images of black, yellow, magenta and cyan by each of the image forming units. That is, as shown in FIG. 3, the image forming units 18 (black image forming unit, yellow image forming unit, magenta image forming unit and cyan image forming unit) in the tandem-type developing device 120 are respectively provided with electrostatic latent image carrying bodies 10 (black electrostatic latent image bearing member 10K, yellow electrostatic latent image bearing member 10Y, magenta electrostatic latent image bearing member 10M and cyan electrostatic latent image bearing member 10C), an electrification device 60 for uniformly charging the electrostatic latent image carrying bodies, an exposure device for exposing the electrostatic latent image bearing member according to an imagewise corresponding to each of the color images on the basis of each color image information (L shown in FIG. 3) to form an electrostatic latent image corresponding to each color image on the electrostatic latent image bearing member, a developing device 61 for developing the electrostatic latent image by using each color toner (black toner, yellow toner, magenta toner and cyan toner) to form a toner image by each color toner, a transfer electrifier 62 for transferring the toner image onto the intermediate transfer body 50, a cleaning unit 63, and an antistatic device 64. Each of the single color images (black image, yellow image, magenta image and cyan image) can be formed on the basis of the respective color image information. The thus formed black image, the yellow image, the magenta image and the cyan image are sequentially transferred (primary transfer) onto the intermediate transfer body 50 rotated and moved by the supporting rollers 14, 15 and 16, respectively as a black image formed on the black electrostatic latent image bearing member 10K, a yellow image formed on the yellow electrostatic latent image bearing member 10Y, a magenta image formed on the magenta electrostatic latent image bearing member 10M, and a cyan image formed on the cyan electrostatic latent image bearing member 10C. Then, the black image, the yellow image, the magenta image and the cyan image are superimposed on the intermediate transfer body 50, thereby forming a synthesized color image (color transfer image).

In the sheet feeding table 200, one of the sheet feeding rollers 142 is selectively rotated to deliver recording media from one of the sheet feeding cassettes 144 provided in a multistage manner on a paper bank 143. The thus delivered recording media are separated one by one by a separation roller 145 and sent to a sheet feeding path 146. Then, the recording media are conveyed by a conveying roller 147 and guided into a sheet feeding path 148 inside a copier main body 150 and stopped by hitting against a registration roller 49. Alternatively, the sheet feeding roller 142 is rotated to deliver recording media on a manual tray 54. The thus delivered recording media are separated one by one by the separation roller 52 and placed in a manual sheet feeding path 53 and stopped in a similar manner by hitting them against the registration roller 49. It is noted that the registration roller 49 is in general grounded before use, but in this case, the roller 49 may be used, with bias being applied, to remove dust on the recording media. Then, the registration roller 49 is rotated in synchronization with a synthesized color image (color transfer image) on an intermediate transfer body 50, by which the recording media are sent between the intermediate transfer body 50 and the secondary transfer unit 22. The synthesized color image (color transfer image) is transferred (secondary transfer) onto the recording media by the secondary transfer unit 22, thereby transferring and forming a color image on the recording media. It is noted that toner remaining on the intermediate transfer body 50 after transfer of the image is cleaned by an intermediate transfer body cleaning unit 17.

The recording media on which a color image has been transferred and formed are conveyed by the secondary transfer unit 22 and sent to a fixing unit 25, by which the synthesized color image (color transfer image) is fixed on the recording media by heat and pressure. Thereafter, the recording media are changed over by a change-over pawl 55 and discharged by a discharge roller 56 and stacked on a discharge tray 57. Alternatively, the recording media are changed over by the change-over pawl 55, reversed by the sheet reversing device 28, and again guided to a transfer position to record an image on the back face. Thereafter, they are discharged by the discharge roller 56 and stacked on the discharge tray 57.

<Process Cartridge>

The process cartridge used in the present invention is provided with at least an electrostatic latent image bearing member and a developing unit, and additionally provided with other units selected as appropriate such as a charging unit, an exposure unit, a transfer unit, a cleaning unit and a discharging unit.

The developing unit is a unit in which a toner is used to develop an electrostatic latent image carried and supported on the electrostatic latent image bearing member, thereby forming a visible image, and the toner is required to be the toner of the present invention.

The developing unit is provided with at least a toner container for accommodating the toner and a toner bearing member for carrying, and conveying the toner accommodated inside the toner container, and may be additionally provided with a layer thickness regulating member or the like for regulating the thickness of the toner layer to be carried and supported. It is preferable that the developing unit is provided with at least a developer container for accommodating a two-component developer and a developer bearing member for carrying and conveying the two-component developer accommodated inside the developer container. To be more specific, any of the developing units described in the image forming apparatus can be favorably used.

Further, the charging unit, the exposure unit, the transfer unit, the cleaning unit and the discharging unit may be appropriately selected from those described in the image forming apparatus.

The process cartridge can be attached in a detachable manner to various types of electrophotographic image forming apparatuses, facsimiles and printers. The process cartridge is preferably attached in a detachable manner to the image forming apparatus of the present invention.

Figure 4:
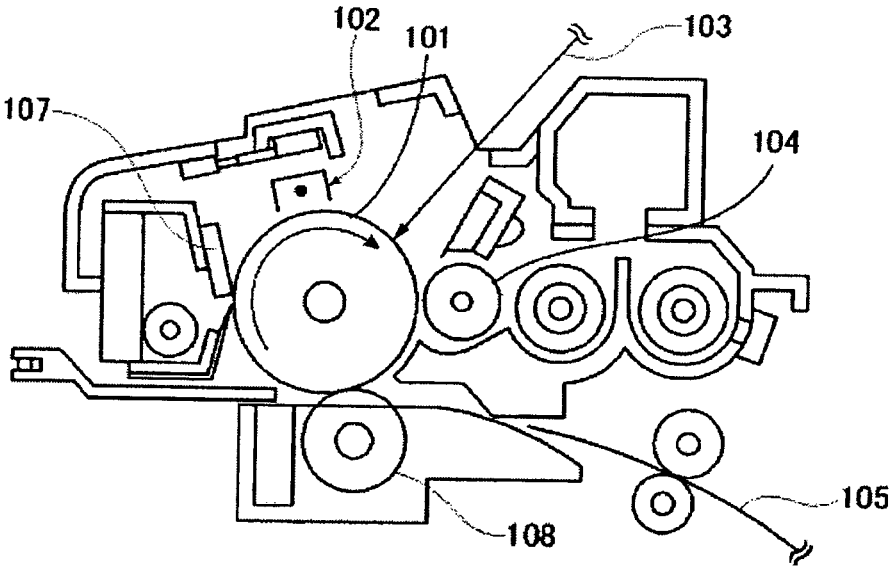
FIG. 4 is a schematic view which shows one example of a process cartridge used in the present invention.

In this case, the process cartridge has a built-in electrostatic latent image bearing member 101, for example, shown in FIG. 4, includes a charging unit 102, a developing unit 104, a transfer unit 108, a cleaning unit 107, and also has other units, if necessary. In FIG. 4, the numerals 103 and 105 representatively denote exposure by an exposure unit and a recording medium.

Next, a description will be given of an image forming process by the process cartridge shown in FIG. 4. The electrostatic latent image bearing member 101 is rotated in a direction given by the arrow to form an electrostatic latent image corresponding to an exposure image on the surface thereof by charging by the charging unit 102 and exposure 103 by the exposure unit (not illustrated).

The electrostatic latent image is developed with the toner by the developing unit 104 and the thus developed toner image is transferred onto the recording medium 105 by the transfer unit 108 and printed out. Then, the electrostatic latent image bearing member surface after the image transfer is cleaned by the cleaning unit 107 and also discharged by the discharging unit (not illustrated). Then the above procedures are repeated.

EXAMPLES

Hereinafter, the present invention will be described in more detail by way of examples. However, the present invention shall not be limited to these examples.

<Synthesis of Crystalline Polyester C1>

241 parts by mass of sebacic acid, 31 parts by mass of adipic acid, 215 parts by mass of 1,6-hexane diol and 0.75 parts by mass of titanium dihydroxy his (triethanol aminate) as a condensation catalyst were placed in a reaction tank equipped with a cooling tube, an agitator and a nitrogen introducing tube and thereafter allowed to react at 180° C. for 8 hours under nitrogen current while distilling away water to be produced. Next, the resultant was gradually heated up to 225° C. and allowed to react for 4 hours under nitrogen current while distilling away water and 1,4-butane diol to be produced. Thereafter, the resultant was allowed to react for 4 hours under a reduced pressure of 5 mmHg to 20 mmHg to obtain crystalline polyester C1 having a weight-average molecular weight 18,000, a melting point of 58° C. and a softening temperature of 73° C.

<Synthesis of Crystalline Polyurethane CU1>

273 parts by mass of sebacic acid, 215 parts by mass of 1,6-hexane diol and 1 part by mass of titanium dihydroxy bis(triethanol aminate) as a condensation catalyst were placed in a reaction tank equipped with a cooling tube, an agitator and a nitrogen introducing tube and thereafter allowed to react at 180° C. for 8 hours under nitrogen current while distilling away water to be produced. Next, the resultant was gradually heated up to 220° C. and allowed to react for 4 hours under nitrogen current while distilling away water and 1,6-hexane diol to be produced. Thereafter, the resultant was allowed to react for 3 hours under a reduced pressure of 5 mmHg to 20 mmHg to obtain polyester diol having a weight-average molecular weight of 6,000.

249 parts by mass of polyester diol, 250 parts by mass of ethyl acetate and 82 parts by mass of hexamethylene diisocyanate (HDI) were placed in a reaction tank equipped with a cooling tube, an agitator and a nitrogen introducing tube and allowed to react at 80° C. for 5 hours under nitrogen current. Next, ethyl acetate was distilled away under reduced pressure to obtain crystalline polyurethane CU1 having a weight-average molecular weight of 20,000, a melting point of 65° C. and a softening temperature of 78° C.

<Synthesis of Prepolymer B1 Derived from Crystalline Polyurethane>

247 parts by mass of hexamethylene diisocyanate (HDI) and 247 parts by mass of ethyl acetate were placed in a reaction tank equipped with a cooling tube, an agitator and a nitrogen introducing tube, and thereafter a solution prepared by dissolving 249 parts by mass of the crystalline polyurethane CU1 in 249 parts by mass of ethyl acetate was added thereto. Then, the resultant was allowed to react at 80° C. for 5 hours under nitrogen current to obtain a 50% by mass ethyl acetate solution of prepolymer B1 having an isocyanate group at an end derived from the crystalline polyurethane.

<Synthesis of Non-Crystalline Polyester A1>

120 parts by mass of 1,3-propane diol, 120 parts by mass of ethylene glycol, 180 parts by mass of terephthalic acid, 46 parts by mass of isophthalic acid and 0.64 parts by mass of tetrabutoxy titanate as a condensation catalyst were placed in a reaction tank equipped with a cooling tube, an agitator and a nitrogen introducing tube and thereafter allowed to react at 180° C. for 8 hours under nitrogen current while distilling away ethanol to be produced. Next, the resultant was gradually heated up to 230° C. and allowed to react for 4 hours under nitrogen current while distilling away water and 1,3-propane diol to be produced, thereafter, allowed to react for 3 hours under a reduced pressure of 5 mmHg to 20 mmHg. Further, the resultant was cooled down to 180° C., and 8 parts by mass of anhydrous trimellitic acid and 0.5 parts by mass of tetrabutoxy titanate were added thereto, and the resultant was allowed to react for one hour. Thereafter, the resultant was allowed to react for 3 hours under a reduced pressure of 5 mmHg to 20 mmHg to obtain non-crystalline polyester A1 having a weight-average molecular weight of 10,000 and a glass transition temperature of 57° C. In this case, a 20% by mass ethyl acetate solution of the non-crystalline polyester A1 was allowed to stand at 50° C. for 24 hours and thereafter measured for transmittance in an optical path length of 1 cm and wavelength of 500 nm. The measured transmittance was less than 1%.

<Synthesis of Non-Crystalline Polyester A2>

80 parts by mass of 1,3-propane diol, 160 parts by mass of ethylene glycol, 113 parts by mass of terephthalic acid, 113 parts by mass of isophthalic acid and 0.64 parts by mass of tetrabutoxy titanate as a condensation catalyst were placed in a reaction tank equipped with a cooling tube, an agitator and a nitrogen introducing tube and thereafter allowed to react at 180° C. for 8 hours under nitrogen current while distilling away methanol to be produced. Next, the resultant was gradually heated up to 230° C. and allowed to react for 4 hours under nitrogen current while distilling away water and 1,3-propane diol to be produced and thereafter allowed to react for one hour under a reduced pressure of 5 mmHg to 20 mmHg. Further, the resultant was cooled down to 180° C., and 8 parts by mass of anhydrous trimellitic acid and 0.5 parts by mass of tetrabutoxy titanate were added thereto and the resultant was allowed to react for one hour and further allowed to react for 3 hours under a reduced pressure of 5 mmHg to 20 mmHg to obtain a non-crystalline polyester A2 having a weight-average molecular weight of 10,000 and a glass transition temperature of 53° C. In this case, a 20% by mass ethyl acetate solution of the non-crystalline polyester A2 was allowed to stand at 50° C. for 24 hours and thereafter measured for transmittance in an optical path length of 1 cm and wavelength of 500 nm. The measured transmittance was 79%.

<Synthesis of Non-Crystalline Polyester A3>

120 parts by mass of 1,4-butane diol, 120 parts by mass of ethylene glycol, 160 parts by mass of terephthalic acid, 66 parts by mass of isophthalic acid and 0.64 parts by mass of tetrabutoxy titanate as a condensation catalyst were placed in a reaction tank equipped with a cooling tube, an agitator and a nitrogen introducing tube and thereafter allowed to react at 180° C. for 8 hours under nitrogen current while distilling away methanol to be produced. Next, the resultant was gradually heated up to 230° C. and allowed to react for 4 hours under nitrogen current while distilling away water and 1,4-butane diol to be produced, and thereafter allowed to react for 3 hours under a reduced pressure of 5 mmHg to 20 mmHg. Further, the resultant was cooled down to 180° C., 8 parts by mass of anhydrous trimellitic acid and 0.5 parts by mass of tetrabutoxy titanate were added thereto, and the resultant was allowed to react for one hour. Thereafter, the resultant was allowed to react for 3 hours under a reduced pressure of 5 mmHg to 20 mmHg to obtain non-crystalline polyester A3 having a weight-average molecular weight of 10,000 and a glass transition temperature of 50° C. In this case, a 20% by mass ethyl acetate solution of the non-crystalline polyester A3 was allowed to stand at 50° C. for 24 hours and thereafter measured for transmittance in an optical path length of 1 cm and wavelength of 500 nm. The measured transmittance was less than 1%.

<Synthesis of Block Copolymer D1>

5 parts by mass of the crystalline polyester C1, the 95 parts by mass of non-crystalline polyester A3 and 0.3 parts by mass of tetrabutoxy titanate were placed in a reaction tank equipped with a cooling tube, an agitator and a nitrogen introducing tube and thereafter allowed to react at 180° C. for 8 hours under nitrogen current while distilling water to be produced. Then, the resultant was gradually heated up to 230° C. and allowed to react for 4 hours under nitrogen current while distilling away water to be produced. Thereafter, the resultant was allowed to react for 3 hours under a reduced pressure of 5 mmHg to 20 mmHg to obtain a block copolymer D1 having a weight-average molecular weight of 20,000 and a glass transition temperature of 51° C. In this case, a 20% by mass ethyl acetate solution of the block copolymer D1 was allowed to stand at 50° C. for 24 hours and thereafter measured for transmittance in an optical path length of 1 cm and wavelength of 500 nm. The measured transmittance was less than 1%.

<Synthesis of Block Copolymer D2>

Procedures were conducted in the same manner for the block copolymer D1 except that added contents of the crystalline polyester C1 and the non-crystalline polyester A3 were changed respectively to 10 parts by mass and 90 parts by mass, thereby obtaining a block copolymer D2 having a weight-average molecular weight of 20,000 and a glass transition temperature of 54° C. In this case, a 20% by mass ethyl acetate solution of the block copolymer D2 was allowed to stand at 50° C. for 24 hours and thereafter measured for transmittance in an optical path length of 1 cm and wavelength of 500 nm. The measured transmittance was less than 1%.

<Synthesis of Block Copolymer D3>

Procedures were conducted in the same manner for the block copolymer D1 except that added contents of the crystalline polyester C1 and the non-crystalline polyester A3 were changed respectively to 30 parts by mass and 70 parts by mass, thereby obtaining a block copolymer D3 having a weight-average molecular weight of 15,000 and a glass transition temperature of 36° C. In this case, a 20% by mass ethyl acetate solution of the block copolymer D3 was allowed to stand at 50° C. for 24 hours and thereafter measured for transmittance in an optical path length of 1 cm and wavelength of 500 nm. The measured transmittance was less than 1%.

<Synthesis of Block Copolymer D4>

Procedures were conducted in the same manner for the block copolymer D1 except that added contents of the crystalline polyester C1 and the non-crystalline polyester A3 were changed respectively to 50 parts by mass and 50 parts by mass, thereby obtaining a block copolymer D4 having a weight-average molecular weight of 12,000 in and a glass transition temperature of 12° C. In this case, a 20% by mass ethyl acetate solution of the block copolymer D4 was allowed to stand at 50° C. for 24 hours and thereafter measured for transmittance in an optical path length of 1 cm and wavelength of 500 nm. The measured transmittance was less than 1%.

<Synthesis of Block Copolymer D5>

Procedures were conducted in the same manner for the block copolymer D1 except that added contents of the crystalline polyester C1 and the non-crystalline polyester A3 were changed respectively to 70 parts by mass and 30 parts by mass, thereby obtaining a block copolymer D5 having a weight-average molecular weight of 11,000 and a glass transition temperature of 29° C. In this case, a 20% by mass ethyl acetate solution of the block copolymer D5 was allowed to stand at 50° C. for 24 hours and thereafter measured for transmittance in an optical path length of 1 cm and wavelength of 500 nm. The measured transmittance was less than 1%.

<Synthesis of Block Copolymer D6>

Procedures were conducted in the same manner for the block copolymer D1 except that added contents of the crystalline polyester C1 and the non-crystalline polyester A3 were changed respectively to 90 parts by mass and 10 parts by mass, thereby obtaining a block copolymer D6 having a weight-average molecular weight of 10,000 and a glass transition temperature of 44° C. In this case, a 20% by mass ethyl acetate solution of the block copolymer D6 was allowed to stand at 50° C. for 24 hours and thereafter measured for transmittance in an optical path length of 1 cm and wavelength of 500 nm. The measured transmittance was less than 1%.

<Synthesis of Block Copolymer D7>

Procedures were conducted in the same manner for the block copolymer D1 except that added contents of the crystalline polyester C1 and the non-crystalline polyester A3 were changed respectively to 95 parts by mass and 5 parts by mass, thereby obtaining a block copolymer D7 having a weight-average molecular weight of 10,000 and a glass transition temperature of 60° C. In this case, a 20% by mass ethyl acetate solution of the block copolymer D7 was allowed to stand at 50° C. for 24 hours and thereafter measured for transmittance in an optical path length of 1 cm and wavelength of 500 nm. The measured transmittance was less than 1%.

<Synthesis of Block Copolymer D8>

Procedures were conducted in the same manner for the block copolymer D2 except that in place of the non-crystalline polyester A3, the non-crystalline polyester A2 was used, thereby obtaining a block copolymer D8 having a weight-average molecular weight of 20,000 and a glass transition temperature of 57° C. In this case, a 20% by mass ethyl acetate solution of the block copolymer D8 was allowed to stand at 50° C. for 24 hours and thereafter measured for transmittance in an optical path length of 1 cm and wavelength of 500 nm. The measured transmittance was 89%.

<Synthesis of Block Copolymer D9>

Procedures were conducted in the same manner for the block copolymer D4 except that in place of the non-crystalline polyester A3, the non-crystalline polyester A2 was used, thereby obtaining a block copolymer D9 having a weight-average molecular weight of 12,000 and a glass transition temperature of 48° C. In this case, a 20% by mass ethyl acetate solution of the block copolymer D9 was allowed to stand at 50° C. for 24 hours and thereafter measured for transmittance in an optical path length of 1 cm and wavelength of 500 nm. The measured transmittance was 84%.

<Synthesis of Block Copolymer D10>

Procedures were conducted in the same manner for the block copolymer D6 except that in place of the non-crystalline polyester A3, the non-crystalline polyester A2 was used, thereby obtaining a block copolymer D10 having a weight-average molecular weight of 10,000 and a glass transition temperature of 60° C. In this case, a 20% by mass ethyl acetate solution of the block copolymer D10 was allowed to stand at 50° C. for 24 hours and thereafter measured for transmittance in an optical path length of 1 cm and wavelength of 500 nm. The measured transmittance was 30%.

<Synthesis of Block Copolymer D11>

Procedures were conducted in the same manner for the block copolymer D3 except that in place of the non-crystalline polyester A3, the non-crystalline polyester A1 was used, thereby obtaining a block copolymer D11 having a weight-average molecular weight of 15,000 and a glass transition temperature of 61° C. In this case, a 20% by mass ethyl acetate solution of the block copolymer D11 was allowed to stand at 50° C. for 24 hours and thereafter measured for transmittance in an optical path length of 1 cm and wavelength of 500 nm. The measured transmittance was less than 1%.

<Melting Point Ta>

Differential scanning calorimeters (DSC) TA-60WS and DSC-60 (made by Shimadzu Corporation) were used to measure a melting point. To be more specific, after being melted at 130° C., a sample was cooled down to 70° C. at a rate of 1.0° C./min and further down to 10° C. at a rate of 0.5° C./min. Next, the sample was heated at a rate of 20° C./min to give a temperature of an endothermic peak in the range of 20° C. to 100° C. as Ta*. Where a plurality of endothermic peaks were found, a temperature of an endothermic peak which was greatest in endotherm was given as Ta*. Further, the sample was kept at (Ta*−10)° C. for 6 hours and, thereafter, kept at (Ta*−15)° C. for 6 hours. Then, the sample was cooled down to 0° C. at a rate of 10° C./min and thereafter heated at a rate of 20° C./min to give a temperature of an endothermic peak as a melting point Ta. Where a plurality of endothermic peaks were found, a temperature of an endothermic peak which was greatest in endotherm was given as a melting point Ta.

<Softening Temperature Tb>

A constant-load orifice-type flow tester CFT-500D (made by Shimadzu Corporation) was used to measure softening temperature. To be more specific, while heating a sample of 1 g at a temperature rising rate of 6° C./min, a load of 1.96 MPa was applied to the sample by using a plunger. And, the sample was pushed out of a nozzle which was 1 mm in diameter and 1 mm in length, thereby plotting a depression extent of the plunger of the flow tester with respect to temperature. In this case, a temperature at which a half quantity of the sample flowed out was given as a softening temperature Tb.

<Weight-Average Molecular Weight>

A gel permeation chromatograph (GPC)-8220 GPC (made by Tosoh Corporation) and a column TSK gel Super HZM-H (triple column) (15 cm in length) (made by Tosoh Corporation) were used to determine weight-average molecular weight. To be more specific, a sample was dissolved in tetrahydrofuran (made by Wako Pure Chemical Industries Ltd.) containing a stabilizing agent to give a solution of 0.15% by mass. Thereafter the solution was filtered through a filter which was 0.2 μm in pore diameter and a filtrate thereof (100 μL) was injected. In this case, the filtrate was determined at an atmospheric temperature of 40° C. at a flow rate of 0.35 mL/min. It is noted that the molecular weight of the sample was calculated from the relationship between the logarithm and the count number of a calibration curve prepared by using standard samples of monodisperse polystyrene. The monodisperse polystyrene includes Std. No S-7300, S-210, S-390, S-875, S-1980, S-10.9, S-629, S-3.0, S-0.580 of Showdex STANDARD (made by Showa Denko K.K.). As the detector, a R1 (refraction index) detector was used.

<Glass Transition Temperature>

A digital signal controller (DSC) Q2000 (made by Texas Instruments Incorporated) was used to measure glass transition temperature. To be more specific, a sample of 5 mg to 10 mg was filled into an aluminum-made simple hermetic pan and, thereafter, the glass transition temperature was determined under the following conditions.

First heating: 30° C. to 220° C. at a rate of 5° C./min,
Kept for one minute,
Cooling: quenched to −60° C. without temperature control,
Kept for one minute,
Second heating: −60° C. to 180° C. at a rate of 5° C./min, It is noted that in a thermograph of the second heating, the glass transition temperature was measured by referring to a mid point on the basis of a method described in ASTM D3418/82.

<Poor Solubility in Ethyl Acetate>

A shaker was used to dissolve 10 g of a sample in 40 g of ethyl acetate at 50° C. and, thereafter, a solution thereof was allowed to stand for 24 hours in a temperature-controlled tank kept at 50° C. The solution was placed in a glass cell which was 1 cm in an optical path length and thereafter measured for transmittance of light which was 500 nm in wavelength by using a spectro-photometer (V-660 made by JASCO Corporation). The sample was evaluated for poor solubility in ethyl acetate.

Table 1 shows characteristics of the crystalline resins.

TABLE 1

| Crystalline resins | Ta (° C.) | Tb (° C.) | Tb/Ta |
|---|---|---|---|
| Crystalline polyester C1 | 58 | 73 | 1.26 |
| Crystalline polyurethane CU1 | 65 | 78 | 1.20 |

Table 2 shows characteristics of the non-crystalline resins.

TABLE 2

| Non-crystalline resin | Glass transition temperature (° C.) | Poor solubility in ethyl acetate: transmittance (%) |
|---|---|---|
| Non-crystalline polyester A1 | 57 | <1 |
| Non-crystalline polyester A2 | 53 | 79 |
| Non-crystalline polyester A3 | 50 | <1 |

Table 3 shows characteristics of the block copolymers.

TABLE 3

| | Crystalline polyester | | Non-crystalline polyester | | | |
|---|---|---|---|---|---|---|
| Block copolymers | Type | Mass ratio (part by mass) | Type | Mass ratio (part by mass) | Glass transition temp. (° C.) | Poor solubility in ethyl acetate: transmittance (%) |
| D1 | C1 | 5 | A3 | 95 | 51 | <1 |
| D2 | C1 | 10 | A3 | 90 | 54 | <1 |

TABLE 3-continued

| Block copolymers | Crystalline polyester Type | Crystalline polyester Mass ratio (part by mass) | Non-crystalline polyester Type | Non-crystalline polyester Mass ratio (part by mass) | Glass transition temp. (° C.) | Poor solubility in ethyl acetate: transmittance (%) |
|---|---|---|---|---|---|---|
| D3 | C1 | 30 | A3 | 70 | 36 | <1 |
| D4 | C1 | 50 | A3 | 50 | 12 | <1 |
| D5 | C1 | 70 | A3 | 30 | 29 | <1 |
| D6 | C1 | 90 | A3 | 10 | 44 | <1 |
| D7 | C1 | 95 | A3 | 5 | 60 | <1 |
| D8 | C1 | 10 | A2 | 90 | 57 | 89 |
| D9 | C1 | 50 | A2 | 50 | 48 | 84 |
| D10 | C1 | 90 | A2 | 10 | 60 | 30 |
| D11 | C1 | 30 | A1 | 70 | 61 | <1 |

<Preparation of Pigment Master Batch E1>

120 parts by mass of a yellow pigment C.I. Pigment yellow 185 (made by BASF Japan Ltd.), 80 parts by mass of the non-crystalline polyester A3 and 36 parts by mass of ion-exchanged water were mixed and thereafter kneaded by using an open-roll type kneader, Knedex (made by Mitsui Mining Co., Ltd.) to obtain a pigment master batch E1. To be more specific, kneading of the pigment was started from 100° C. and the pigment was gradually cooled down to 50° C.

<Preparation of Pigment Master Batch E2>

Procedures were conducted in the same manner for the pigment master batch E1 except that added contents of the yellow pigment C.I. Pigment yellow 185 (made by BASF Japan Ltd.) and the non-crystalline polyester A3 were changed respectively to 100 parts by mass and 100 parts by mass, thereby obtaining a pigment master batch E2.

<Preparation of Pigment Master Batch E3>

Procedures were conducted in the same manner for the pigment master batch E1 except that added contents of the yellow pigment C.I. Pigment yellow 185 (made by BASF Japan Ltd.) and the non-crystalline polyester A3 were changed respectively to 70 parts by mass and 130 parts by mass, thereby obtaining a pigment master batch E3.

<Preparation of Pigment Master Batch E4>

Procedures were conducted in the same manner for the pigment master batch E1 except that added contents of the yellow pigment C.I. Pigment yellow 185 (made by BASF Japan Ltd.) and the non-crystalline polyester A3 were changed respectively to 40 parts by mass and 160 parts by mass, thereby obtaining a pigment master batch E4.

<Preparation of Pigment Master Batch E5>

Procedures were conducted in the same manner for the pigment master batch E1 except that added contents of the yellow pigment C.I. Pigment yellow 185 (made by BASF Japan Ltd.) and the non-crystalline polyester A3 were changed respectively to 20 parts by mass and 180 parts by mass, thereby obtaining a pigment master batch E5.

<Preparation of Pigment Master Batch E6>

Procedures were conducted in the same manner for the pigment master batch E4 except that a magenta pigment C.I. Pigment Red 122 (made by Clariant AG) was used in place of the yellow pigment C.I. Pigment yellow 185 (made by BASF Japan Ltd.), thereby obtaining a pigment master batch E6.

<Preparation of Pigment Master Batch E7>

Procedures were conducted in the same manner for the pigment master batch E4 except that a cyan pigment C. I. Pigment Blue 15:3 (made by Dainichiseika Color & Chemicals Mfg. Co., Ltd.) was used in place of the yellow pigment C.I. Pigment yellow 185 (made by BASF Japan Ltd.), thereby obtaining a pigment master batch E7.

<Preparation of Pigment Master Batch E8>

Procedures were conducted in the same manner for the pigment master batch E2 except that the non-crystalline polyester A2 was used in place of the non-crystalline polyester A3, thereby obtaining a pigment master batch E8.

<Preparation of Pigment Master Batch E9>

Procedures were conducted in the same manner for the pigment master batch E3 except that the non-crystalline polyester A2 was used in place of the non-crystalline polyester A3, thereby obtaining a pigment master batch E9.

<Preparation of Pigment Master Batch E10>

Procedures were conducted in the same manner for the pigment master batch E4 except that the non-crystalline polyester A2 was used in place of the non-crystalline polyester A3, thereby obtaining a pigment master batch E10.

Table 4 shows pigment formulations of the master batches.

TABLE 4

| Pigment master batches | Pigment Color | Pigment Mass ratio | Non-crystalline polyester Type | Non-crystalline polyester Mass ratio |
|---|---|---|---|---|
| E1 | Yellow | 60 | A3 | 40 |
| E2 | Yellow | 50 | A3 | 50 |
| E3 | Yellow | 35 | A3 | 65 |
| E4 | Yellow | 20 | A3 | 80 |
| E5 | Yellow | 10 | A3 | 90 |
| E6 | Magenta | 20 | A3 | 80 |
| E7 | Cyan | 20 | A3 | 80 |
| E8 | Yellow | 50 | A2 | 50 |
| E9 | Yellow | 35 | A2 | 65 |
| E10 | Yellow | 20 | A2 | 80 |

Example 1-1

20 parts by mass of paraffin wax HNP-9 having a melting point of 75° C. (made by Nippon Seiro Co., Ltd.) and 80 parts by mass of ethyl acetate were placed in a container equipped with a cooling tube, a thermometer and an agitator, heated up to 78° C. and dissolved. Thereafter, the resultant was cooled down to 30° C. for one hour, with agitation. Then, the resultant was subjected to wet grinding by using an Ultravisco Mill (made by Imex Co., Ltd.) under the following conditions: feeding speed, 1.0 kg/h; circumferential speed of disk, 10 m/s; loading amount of zirconia beads with the particle diameter of 0.5 mm, 80% by volume; and pass schedule, 6 times, thereby obtaining a wax dispersion.

60 parts by mass of the crystalline polyester C1, 10 parts by mass of the block copolymer D2, 10 parts by mass of the pigment master batch E1 and 80 parts by mass of ethyl acetate were placed in a container equipped with a thermometer and an agitator, and thereafter heated up to 60° C. for dissolution. Next, after addition of 25 parts by mass of the wax dispersion, the resultant was agitated at 50° C. by using a TK-type homomixer (made by Primix Corporation) at 10,000 rpm to obtain a mixture solution.

70 parts by mass of the mixture solution and 30 parts by mass of a 50% by mass ethyl acetate solution of the prepolymer B1 were placed in a 500 mL beaker made with stainless steel and thereafter agitated in an oil bath kept at 40° C. to 50° C. for one minute by using the TK-type homomixer (made by Primix Corporation) at 3,000 rpm, thereby obtaining a first liquid.

90 parts by mass of ion-exchanged water, 4 parts by mass of a 48.5% by mass aqueous solution of ELEMINOL MON-7 (made by Sanyo Chemical Industries Ltd.) of dodecydiphenyl ether sodium disulphonate and 10 parts by mass of ethyl acetate were placed in a container equipped with an agitator and a thermometer and, thereafter, subjected to agitation at 40° C., thereby obtaining an aqueous medium.

50 parts by mass of the first liquid kept at 50° C. was added to aqueous medium kept at 40° C. and, thereafter, agitated at 40° C. to 50° C. for one minute by using the TK-type homomixer (made by Primix Corporation) at 13,000 rpm, thereby obtaining a second liquid.

The second liquid was placed in a container equipped with an agitator and a thermometer and, thereafter, a solvent was removed therefrom at 60° C. for 6 hours, thereby obtaining a slurry.

100 parts by mass of the slurry was filtered under reduced pressure. Next, 100 parts by mass of ion-exchanged water was added to a filter cake and the resultant was agitated by using the TK-type homomixer (made by Primix Corporation) at 6,000 rpm for 5 minutes and thereafter filtered. Further, 100 parts by mass of a 10% by mass sodium hydroxide aqueous solution was added to the filter cake and agitated by using the TK-type homomixer (made by Primix Corporation) at 6,000 rpm for 10 minutes, and thereafter filtered under reduced pressure. Then, 100 parts by mass of a 10% by mass hydrochloride acid was added to the filter cake and agitated by using the TK-type homomixer (made by Primix Corporation) at 6,000 rpm for 5 minutes and, thereafter, filtered. Still further, ion-exchanged water (300 parts by mass) was added to the filter cake and agitated by using the TK-type homomixer (made by Primix Corporation) at 6,000 rpm for 5 minutes. Thereafter, filtration was repeated two times.

A circulating dryer was used to dry the filter cake at 45° C. for 48 hours. Thereafter, the cake was sieved through a mesh with an aperture of 75 μm to obtain base particles.

A Henschel mixer was used to mix 100 parts by mass of the base particles with hydrophobic silica, 1 part by mass of HDK-2000 (made by Wacker Chemie AG) to obtain a toner which was 0.2 μm in domain diameter of an island in the sea-island structure and $1.5\times10^4$ Pa in storage elastic modulus at 160° C.

Example 1-2

Procedures were conducted in the same manner described in Example 1-1 except that the crystalline polyurethane CU1 was used in place of 60 parts by mass of the crystalline polyester C1, thereby obtaining a toner which was 0.7 μm in domain diameter of an island in the sea-island structure and $8.0\times10^3$ Pa in storage elastic modulus at 160° C.

Example 1-3

Procedures were conducted in the same manner described in Example 1-1 except that 58 parts by mass of the crystalline polyester C1 and 12 parts by mass of the pigment master batch E2 were used in place of 60 parts by mass of the crystalline polyester C1 and 10 parts by mass of the pigment master batch E1, thereby obtaining a toner which was 0.5 μm in domain diameter of an island in the sea-island structure and $1.0\times10^4$ Pa in storage elastic modulus at 160° C.

Example 1-4

Procedures were conducted in the same manner described in Example 1-1 except that 53 parts by mass of the crystalline polyester C1 and 17 parts by mass of the pigment master batch E3 were used in place of 60 parts by mass of the crystalline polyester C1 and 10 parts by mass of the pigment master batch E1, thereby obtaining a toner which was 0.7 μm in domain diameter of an island in the sea-island structure and $9.0\times10^3$ Pa in storage elastic modulus at 160° C.

Example 1-5

Procedures were conducted in the same manner described in Example 1-1 except that 40 parts by mass of the crystalline polyester C1 and 30 parts by mass of the pigment master batch E4 were used in place of 60 parts by mass of the crystalline polyester C1 and 10 parts by mass of the pigment master batch E1, thereby obtaining a toner which was 0.8 μm in domain diameter of an island in the sea-island structure and $6.0\times10^3$ Pa in storage elastic modulus at 160° C.

Example 1-6

Procedures were conducted in the same manner described in Example 1-1 except that 20 parts by mass of the crystalline polyester C1 and 60 parts by mass of the pigment master batch E5 were used in place of 60 parts by mass of the crystalline polyester C1 and 10 parts by mass of the pigment master batch E1, thereby obtaining a toner which was 0.9 μm in domain diameter of an island in the sea-island structure and $1.1\times10^3$ Pa in storage elastic modulus at 160° C.

Example 1-7

Procedures were conducted in the same manner described in Example 1-5 except that the block copolymer D1 was used in place of the block copolymer D2, thereby obtaining a toner which was 1.0 μm in domain diameter of an island in the sea-island structure and $5.6\times10^3$ Pa in storage elastic modulus at 160° C.

Example 1-8

Procedures were conducted in the same manner described in Example 1-5 except that the block copolymer D3 was used in place of the block copolymer D2, thereby obtaining a toner which was 1.0 μm in domain diameter of an island in the sea-island structure and $5.1\times10^3$ Pa in storage elastic modulus at 160° C.

Example 1-9

Procedures were conducted in the same manner described in Example 1-5 except that the block copolymer D4 was used in place of the block copolymer D2, thereby obtaining a toner which was 1.0 μm in domain diameter of an island in the sea-island structure and $5.0\times10^3$ Pa in storage elastic modulus at 160° C.

Example 1-10

Procedures were conducted in the same manner described in Example 1-5 except that the block copolymer D5 was used in place of the block copolymer D2, thereby obtaining a toner which was 1.0 μm in domain diameter of an island in the sea-island structure and $4.2\times10^3$ Pa in storage elastic modulus at 160° C.

Example 1-11

Procedures were conducted in the same manner described in Example 1-5 except that the block copolymer D6 was used in place of the block copolymer D2, thereby obtaining a toner which was 1.0 μm in domain diameter of an island in the sea-island structure and $3.0\times10^3$ Pa in storage elastic modulus at 160° C.

Example 1-12

Procedures were conducted in the same manner described in Example 1-5 except that the block copolymer D7 was used in place of the block copolymer D2, thereby obtaining a toner which was 1.0 μm in domain diameter of an island in the sea-island structure and $2.3\times10^3$ Pa in storage elastic modulus at 160° C.

Example 1-13

Procedures were conducted in the same manner described in Example 1-5 except that 48 parts by mass of the crystalline polyester C1 and 2 parts by mass of the block copolymer D2 were used in place of 40 parts by mass of the crystalline polyester C1 and 10 parts by mass of the block copolymer D2, thereby obtaining a toner which was 1.0 μm in domain diameter of an island in the sea-island structure and $6.5\times10^3$ Pa in storage elastic modulus at 160° C.

Example 1-14

Procedures were conducted in the same manner described in Example 1-5 except that 45 parts by mass of the crystalline polyester C1 and 5 parts by mass of the block copolymer D2 were used in place of 40 parts by mass of the crystalline polyester C1 and 10 parts by mass of the block copolymer D2, thereby obtaining a toner which was 1.0 μm in domain diameter of an island in the sea-island structure and $6.3\times10^3$ Pa in storage elastic modulus at 160° C.

Example 1-15

Procedures were conducted in the same manner described in Example 1-5 except that 33 parts by mass of the crystalline polyester C1 and 17 parts by mass of the block copolymer D2 were used in place of 40 parts by mass of the crystalline polyester C1 and 10 parts by mass of the block copolymer D2, thereby obtaining a toner which was 1.0 μm in domain diameter of an island in the sea-island structure and $4.6\times10^3$ Pa in storage elastic modulus at 160° C.

Example 1-16

Procedures were conducted in the same manner described in Example 1-5 except that 25 parts by mass of the crystalline polyester C1 and 25 parts by mass of the block copolymer D2 were used in place of 40 parts by mass of the crystalline polyester C1 and 10 parts by mass of the block copolymer D2, thereby obtaining a toner which was 1.0 μm in domain diameter of an island in the sea-island structure and $3.8\times10^3$ Pa in storage elastic modulus at 160° C.

Example 1-17

Procedures were conducted in the same manner described in Example 1-5 except that 20 parts by mass of the crystalline polyester C1 and 30 parts by mass of the block copolymer D2 were used in place of 40 parts by mass of the crystalline polyester C1 and 10 parts by mass of the block copolymer D2, thereby obtaining a toner which was 0.9 μm in domain diameter of an island in the sea-island structure and $3.0\times10^3$ Pa in storage elastic modulus at 160° C.

Example 1-18

Procedures were conducted in the same manner described in Example 1-5 except that the pigment master batch E6 was used in place of the pigment master batch E4, thereby obtaining a toner which was 0.9 μm in domain diameter of an island in the sea-island structure and $6.2\times10^3$ Pa in storage elastic modulus at 160° C.

Example 1-19

Procedures were conducted in the same manner described in Example 1-5 except that the pigment master batch E7 was used in place of the pigment master batch E4, thereby obtaining a toner which was 1.0 μm in domain diameter of an island in the sea-island structure and $5.7\times10^3$ Pa in storage elastic modulus at 160° C.

Comparative Example 1-1

Procedures were conducted in the same manner described in Example 1-5 except that the non-crystalline polyester A1 was used in place of the crystalline polyester C1, thereby obtaining a toner. In this case, it was impossible to observe an island or measure storage elastic modulus at 160° C.

Comparative Example 1-2

Procedures were conducted in the same manner described in Example 1-5 except that 55 parts by mass of the crystalline polyester C1 and 0 parts by mass of the block copolymer D2 were used in place of 40 parts by mass of the crystalline polyester C1 and 10 parts by mass of the block copolymer D2, thereby obtaining a toner which was 1.6 μm in domain diameter of an island in the sea-island structure and $1.7\times10^4$ Pa in storage elastic modulus at 160° C.

Comparative Example 1-3

Procedures were conducted in the same manner described in Example 1-3 except that the pigment master batch E8 was used in place of the pigment master batch E2, thereby obtaining a toner which was 1.2 μm in domain diameter of an island in the sea-island structure and $3.0\times10^4$ Pa in storage elastic modulus at 160° C.

Comparative Example 1-4

Procedures were conducted in the same manner described in Example 1-4 except that the pigment master batch E9 was used in place of the pigment master batch E3, thereby obtaining a toner which was $2.8\times10^4$ Pa in storage elastic modulus at 160° C. In this case, the non-crystalline resin and the pigment were unevenly distributed.

Comparative Example 1-5

Procedures were conducted in the same manner described in Example 1-5 except that the pigment master batch E10 was used in place of the pigment master batch E4, thereby obtaining a toner which was $2.0\times10^4$ Pa in storage elastic modulus at 160° C. In this case, the non-crystalline resin and the pigment were unevenly distributed.

Comparative Example 1-6

Procedures were conducted in the same manner described in Example 1-5 except that the block copolymer D8 was used in place of the block copolymer D2, thereby obtaining a toner which was $5.2\times10^4$ Pa in storage elastic modulus at 160° C. In this case, the non-crystalline resin and the pigment were unevenly distributed.

Comparative Example 1-7

Procedures were conducted in the same manner described in Example 1-5 except that the block copolymer D9 was used in place of the block copolymer D2, thereby obtaining a toner which was $5.0\times10^4$ Pa in storage elastic modulus at 160° C. In this case, the non-crystalline resin and the pigment were unevenly distributed.

Comparative Example 1-8

Procedures were conducted in the same manner described in Example 1-5 except that the block copolymer D10 was used in place of the block copolymer D2, thereby obtaining a toner which was 1.3 μm in domain diameter of an island in the sea-island structure and $4.3\times10^4$ Pa in storage elastic modulus at 160° C.

Comparative Example 1-9

Procedures were conducted in the same manner described in Example 1-5 except that the block copolymer D11 was used in place of the block copolymer D2, thereby obtaining a toner which was 1.7 μm in domain diameter of an island in the sea-island structure and $2.1\times10^4$ Pa in storage elastic modulus at 160° C.

Table 5 collectively describes compositions of toners and others.

TABLE 5

| | | Binding resin | | Pigment master batch | | Block copolymer resin | | Wax |
|---|---|---|---|---|---|---|---|---|
| | Toner No. | Type | Added content (parts by mass) | Type | Added content (parts by mass) | Type | Added content (parts by mass) | Added content (parts by mass) |
| Ex. 1-1 | Toner 1 | C1 + B1 | 75 | E1 | 10 | D2 | 10 | 5 |
| Ex. 1-2 | Toner 2 | CU1 + B1 | 75 | E1 | 10 | D2 | 10 | 5 |
| Ex. 1-3 | Toner 3 | C1 + B1 | 73 | E2 | 12 | D2 | 10 | 5 |
| Ex. 1-4 | Toner 4 | C1 + B1 | 68 | E3 | 17 | D2 | 10 | 5 |
| Ex. 1-5 | Toner 5 | C1 + B1 | 55 | E4 | 30 | D2 | 10 | 5 |
| Ex. 1-6 | Toner 6 | C1 + B1 | 35 | E5 | 60 | D2 | 10 | 5 |
| Ex. 1-7 | Toner 7 | C1 + B1 | 55 | E4 | 30 | D1 | 10 | 5 |
| Ex. 1-8 | Toner 8 | C1 + B1 | 55 | E4 | 30 | D3 | 10 | 5 |
| Ex. 1-9 | Toner 9 | C1 + B1 | 55 | E4 | 30 | D4 | 10 | 5 |
| Ex. 1-10 | Toner 10 | C1 + B1 | 55 | E4 | 30 | D5 | 10 | 5 |
| Ex. 1-11 | Toner 11 | C1 + B1 | 55 | E4 | 30 | D6 | 10 | 5 |
| Ex. 1-12 | Toner 12 | C1 + B1 | 55 | E4 | 30 | D7 | 10 | 5 |
| Ex. 1-13 | Toner 13 | C1 + B1 | 63 | E4 | 30 | D2 | 2 | 5 |
| Ex. 1-14 | Toner 14 | C1 + B1 | 60 | E4 | 30 | D2 | 5 | 5 |
| Ex. 1-15 | Toner 15 | C1 + B1 | 48 | E4 | 30 | D2 | 17 | 5 |
| Ex. 1-16 | Toner 16 | C1 + B1 | 40 | E4 | 30 | D2 | 25 | 5 |
| Ex. 1-17 | Toner 17 | C1 + B1 | 35 | E4 | 30 | D2 | 30 | 5 |
| Ex. 1-18 | Toner 18 | C1 + B1 | 55 | E6 | 30 | D2 | 10 | 5 |
| Ex. 1-19 | Toner 19 | C1 + B1 | 55 | E7 | 30 | D2 | 10 | 5 |
| Comp. Ex. 1-1 | Toner 20 | A1 + B1 | 55 | E4 | 30 | D2 | 10 | 5 |
| Comp. Ex 1-2 | Toner 21 | C1 + B1 | 70 | E4 | 30 | None | 0 | 5 |
| Comp. Ex. 1-3 | Toner 22 | C1 + B1 | 73 | E8 | 12 | D2 | 10 | 5 |
| Comp. Ex 1-4 | Toner 23 | C1 + B1 | 68 | E9 | 17 | D2 | 10 | 5 |
| Comp. Ex. 1-5 | Toner 24 | C1 + B1 | 55 | E10 | 30 | D2 | 10 | 5 |
| Comp. Ex. 1-6 | Toner 25 | C1 + B1 | 55 | E4 | 30 | D8 | 10 | 5 |
| Comp. Ex. 1-7 | Toner 26 | C1 + B1 | 55 | E4 | 30 | D9 | 10 | 5 |
| Comp. Ex. 1-8 | Toner 27 | C1 + B1 | 55 | E4 | 30 | D10 | 10 | 5 |
| Comp. Ex. 1-9 | Toner 28 | C1 + B1 | 55 | E4 | 30 | D11 | 10 | 5 |

<Production of Crystalline Resin C2>

241 parts by mass of sebacic acid, 31 parts by mass of adipic acid, 164 parts by mass of 1,4-butane diol and 0.75 parts by mass of titanium dihydroxy bis(triethanol aminate) as a condensation catalyst were placed in a reaction tank equipped with a cooling tube, an agitator and a nitrogen introducing tube, and allowed to react at 180° C. for 8 hours under nitrogen current while distilling away water to be produced. Next, the resultant was gradually heated up to 225° C. and allowed to react for 4 hours under nitrogen current while distilling away water and 1,4-butane diol to be produced. Further, the resultant was allowed to react under a reduced pressure of 5 mmHg to 20 mmHg until the weight-average molecular weight Mw reached approximately 18,000, thereby obtaining the crystalline resin C2 (crystalline polyester resin) having a melting point of 58° C.

<Production of Crystalline Resin C3>

283 parts by mass of sebacic acid, 215 parts by mass of 1,6-hexane diol and 1 part by mass of titanium dihydroxy bis(triethanol aminate) as a condensation catalyst were placed in a reaction tank equipped with a cooling tube, an agitator and a nitrogen introducing tube, and allowed to react at 180° C. for 8 hours under nitrogen current while distilling away water to be produced. Next, the resultant was gradually heated up to 220° C. and allowed to react for 4 hours under nitrogen current while distilling away water and 1,6-hexane diol to be produced. Further, the resultant was allowed to react under a reduced pressure of 5 mmHg to 20 mmHg until the Mw reached approximately 6,000.

249 parts by mass of the thus obtained crystalline resin was transferred to a reaction tank equipped with a cooling tube, an agitator and a nitrogen introducing tube, 250 parts by mass of ethyl acetate and 82 parts by mass of hexamethylene diisocyanate (HDI) were added thereto and allowed to react at 80° C. for 5 hours under nitrogen current. Then, ethyl acetate was distilled away under reduced pressure, thereby obtaining the crystalline resin C3 (crystalline polyurethane resin) having a weight-average molecular weight Mw of approximately 20,000 and a melting point of 65° C.

<Production of Non-Crystalline Resin A4>

240 parts by mass of 1,3-propane diol, 180 parts by mass of terephthalic acid, 46 parts by mass of isophthalic acid and 0.64 parts by mass of tetrabutoxy titanate as a condensation catalyst were placed in a reaction tank equipped with a cooling tube, an agitator and a nitrogen introducing tube, and allowed to react at 180° C. for 8 hours under nitrogen current while distilling away methanol to be produced. Next, the resultant was gradually heated up to 230° C. and allowed to react for 4 hours under nitrogen current while distilling water and 1,2-propane diol to be produced. Further, the resultant was allowed to react for one hour under a reduced pressure of 5 mmHg to 20 mmHg and cooled down to 180° C. Thereafter, 8 parts by mass of anhydrous trimellitic acid and 0.5 parts by mass of tetrabutoxy titanate were placed therein and allowed to react for one hour. Thereafter, the resultant was further allowed to react under a reduced pressure of 5 mmHg to 20 mmHg until the weight-average molecular weight Mw reached approximately 7,000, thereby obtaining the non-crystalline resin A4 (non-crystalline polyester resin) having a melting point 61° C.

<Production of Non-Crystalline Resin A5>

240 parts by mass of 1,3-propane diol, 113 parts by mass of terephthalic acid, 113 parts by mass of isophthalic acid and 0.64 parts by mass of tetrabutocy titanate as a condensation catalyst were placed in a reaction tank equipped with a cooling tube, an agitator and a nitrogen introducing tube, and allowed to react at 180° C. for 8 hours under nitrogen current while distilling away methanol to be produced. Next, the resultant was gradually heated up to 230° C. and allowed to react for 4 hours under nitrogen current while distilling water and 1,2-propane diol to be produced. Further, the resultant was allowed to react for one hour under a reduced pressure of 5 mmHg to 20 mmHg and cooled down to 180° C. Thereafter, 8 parts by mass of anhydrous trimellitic acid and 0.5 parts by mass of tetrabutoxy titanate were placed therein and allowed to react for one hour. Thereafter, the resultant was further allowed to react under a reduced pressure of 5 mmHg to 20 mmHg until the weight-average molecular weight Mw reached approximately 7,000, thereby obtaining the non-crystalline resin A5 (non-crystalline polyester resin) having a melting point 60° C.

<Production of Non-Crystalline Resin A6>

240 parts by mass of 1,3-propane diol, 113 parts by mass of terephthalic acid, 113 parts by mass of isophthalic acid and 0.64 parts by mass of tetrabutoxy titanate as a condensation catalyst were placed in a reaction tank equipped with a cooling tube, an agitator and a nitrogen introducing tube, and allowed to react at 180° C. for 8 hours under nitrogen current while distilling away methanol to be produced. Next, the resultant was gradually heated up to 230° C. and allowed to react for 4 hours under nitrogen current while distilling away water and 1,2-propane diol to be produced. The resultant was further allowed to react for one hour under a reduced pressure of 5 mmHg to 20 mmHg and cooled down to 180° C. Thereafter, 8 parts by mass of anhydrous trimellitic acid and 0.5 parts by mass of tetrabutoxy titanate were placed therein and allowed to react for one hour. Then, the resultant was further allowed to react under a reduced pressure of 5 mmHg to 20 mmHg until the weight-average molecular weight Mw reached approximately 100,000, thereby obtaining the non-crystalline resin A6 (non-crystalline polyester resin) having a melting point 63° C. The weight-average molecular weight of the non-crystalline resin A6 was 120,000.

<Production of Non-Crystalline Resin A7>

240 parts by mass of 1,3-propane diol, 113 parts by mass of terephthalic acid, 113 parts by mass of isophthalic acid and 0.64 parts by mass of tetrabutoxy titanate as a condensation catalyst were placed in a reaction tank equipped with a cooling tube, an agitator and a nitrogen introducing tube, and allowed to react at 180° C. for 8 hours under nitrogen current while distilling away methanol to be produced. Next, the resultant was gradually heated up to 230° C. and allowed to react for 4 hours under nitrogen current while distilling away water and 1,2-propane diol to be produced. Further, the resultant was allowed to react for one hour under a reduced pressure of 5 mmHg to 20 mmHg and cooled down to 180° C., thereafter, 8 parts by mass of anhydrous trimellitic acid and 0.5 parts by mass of tetrabutoxy titanate were placed therein and allowed to react for one hour. Then, the resultant was further allowed to react under a reduced pressure of 1 mmHg until the weight-average molecular weight Mw reached approximately 500,000, thereby obtaining the non-crystalline resin A7 (non-crystalline polyester resin) having a melting point of 64° C.

The weight-average molecular weight Mw of the thus obtained non-crystalline resin A7 was 440,000.

Producing Examples of Colorants

The colorants F1 to F9 are colorants used in Examples, while the colorants F10 to F13 are colorants used in Comparative examples.

<Production of Colorant F1>

70 parts by mass of the crystalline resin C2, 30 parts by mass of the non-crystalline resin A4, 100 parts by mass of the yellow pigment (C. I. Pigment yellow 185) and 30 parts by mass of ion-exchanged water were thoroughly mixed and kneaded by using an open-roll type kneader (Knedex made by Mitsui Mining Co., Ltd.). The mixture was kneaded from a temperature of 10° C., and gradually cooled down to 50° C. Thereby, prepared was the colorant F1 ratio of crystalline polyester resin to non-crystalline polyester resin (mass ratio) of which was 70:30 and the ratio of a resin to a pigment (mass ratio) of which was 50:50.

<Production of Colorant F2>

Prepared was the colorant F2 ratio of a crystalline polyester resin to a non-crystalline polyester resin (mass ratio) of which was 50:50 and the ratio of a resin to a pigment (mass ratio) of which was 50:50 in the same manner for producing the colorant F1 except that 50 parts by mass of the crystalline resin C2 and 50 parts by mass of the non-crystalline resin A4 were used.

<Production of Colorant F3>

Prepared was the colorant F3 ratio of a crystalline polyester resin to a non-crystalline polyester resin (mass ratio) of which was 30:70 and the ratio of a resin to a pigment (mass ratio) of which was 50:50 in the same manner for producing the colorant F1 except that 30 parts by mass of the crystalline resin C2 and 70 parts by mass of the non-crystalline resin A4 were used.

<Production of Colorant F4>

Prepared was the colorant F4 ratio of a crystalline polyester resin to a non-crystalline polyester resin (mass ratio) of which was 10:90 and the ratio of a resin to a pigment (mass ratio) of which was 50:50 in the same manner for producing the colorant F1 except that 10 parts by mass of the crystalline resin C2 and 90 parts by mass of the non-crystalline resin A4 were used.

<Production of Colorant F5>

Prepared was the colorant F5 ratio of a crystalline polyester resin to a non-crystalline polyester resin (mass ratio) was 90:10 and the ratio of a resin to a pigment (mass ratio) of which was 50:50 in the same manner for producing the colorant F1 except that 90 parts by mass of the crystalline resin C2 and 10 parts by mass of the non-crystalline resin A4 were used.

<Production of Colorant F6>

Prepared was the colorant F6 ratio of a crystalline polyester resin to a non-crystalline polyester resin (mass ratio) of which was 50:50 and the ratio of a resin to a pigment (mass ratio) of which was 80:20 in the same manner for producing the colorant F1 except that 50 parts by mass of the crystalline resin C2, 50 parts by mass of the non-crystalline resin A4 and 25 parts by mass of the yellow pigment (C. I. Pigment yellow 185) were used.

<Production of Colorant F7>

Prepared was the colorant F7 ratio of a crystalline polyester resin to a non-crystalline polyester resin (mass ratio) of which was 5050 and the ratio of a resin to a pigment (mass ratio) of which was 85:15 in the same manner for producing the colorant F1 except that 50 parts by mass of the crystalline resin C2, 50 parts by mass of the non-crystalline resin A4 and 15 parts by mass of the yellow pigment (C. I. Pigment yellow 185) were used.

<Production of Colorant F8>

Prepared was the colorant F8 ratio of crystalline polyester resin to non-crystalline polyester resin (mass ratio) of which was 50:50 and the ratio of a resin to a pigment (mass ratio) of which was 50:50 in the same manner for producing the colorant F2 except that 50 parts by mass of the crystalline resin C2, 50 parts by mass of the non-crystalline resin A5 and 100 parts by mass of the yellow pigment (C. I. Pigment yellow 185) were used.

<Production of Colorant F9>

Prepared was the colorant F9 ratio of a crystalline polyester resin to a non-crystalline polyester resin (mass ratio) of which was 50:50 and ratio of resin to pigment (mass ratio) of which was 50:50 in the same manner for producing the colorant F2 except that 50 parts by mass of the crystalline resin C2, 50 parts by mass of the non-crystalline resin A6 and 100 parts by mass of the yellow pigment (C. I. Pigment yellow 185) were used.

<Production of Colorant F10>

Prepared was the colorant F10 ratio of a crystalline polyester resin to a non-crystalline polyester resin (mass ratio) of which was 50:50 and ratio of resin to pigment (mass ratio) of which was 50:50 in the same manner for producing the colorant F2 except that 50 parts by mass of the crystalline resin C2, 50 parts by mass of the non-crystalline resin A7 and 100 parts by mass of the yellow pigment (C. I. Pigment yellow 185) were used.

<Production of Colorant F11>

Prepared was the colorant F11 ratio of a crystalline polyester resin to a non-crystalline polyester resin (mass ratio) of which was 100:0 and the ratio of a resin to a pigment (mass ratio) of which was 50:50 in the same manner for producing the colorant F1 except that 100 parts by mass of the crystalline resin C2 were used.

<Production of Colorant F12>

Prepared was the colorant F12 ratio of a crystalline polyester resin to a non-crystalline polyester resin (mass ratio) of which was 0:100 and the ratio of a resin to a pigment (mass ratio) of which was 50:50 in the same manner for producing the colorant F8 except that 100 parts by mass of the non-crystalline resin A4 were used in place of the crystalline resin C2.

<Production of Colorant F13>

Prepared was the colorant F13 ratio of a crystalline polyester resin to a non-crystalline polyester resin (mass ratio) of which was 0:100 and the ratio of a resin to a pigment (mass ratio) was 50:50 in the same manner for producing the colorant F11 except that 100 parts by mass of the non-crystalline resin A5 were used in place of the crystalline resin C2.

<Production of Colorant F14>

Prepared was the colorant F14 ratio of a crystalline polyester resin to a non-crystalline polyester resin (mass ratio) of which was 50:50 and the ratio of a resin to a pigment (mass ratio) of which was 50:50 in the same manner for producing the colorant F2 except that 50 parts by mass of the crystalline resin C3, 50 parts by mass of the non-crystalline resin A5 and 100 parts by mass of the yellow pigment (C. I. Pigment yellow 185) were used.

Table 6 shows formulations of the above-obtained colorants F1 to F14. Table 6 also shows the results of evaluation test on poor solubility of resins for surface treatment in ethyl acetate which will be described later.

TABLE 6

| Colorants | Crystalline resin Type | Crystalline resin Content (parts by mass) | Non-crystalline resin Type | Non-crystalline resin Content (parts by mass) | Solubility in ethyl acetate | Ratio of pigment to resin |
|---|---|---|---|---|---|---|
| F1 | C2 | 70 | A4 | 30 | Poorly soluble | 50/50 |
| F2 | | 50 | | 50 | Poorly soluble | 50/50 |
| F3 | | 30 | | 70 | Poorly soluble | 50/50 |
| F4 | | 10 | | 90 | Poorly soluble | 50/50 |
| F5 | | 90 | | 10 | Poorly soluble | 50/50 |
| F6 | | 50 | | 50 | Poorly soluble | 20/80 |
| F7 | | 50 | | 50 | Poorly soluble | 10/90 |
| F8 | | 50 | A5 | 50 | Poorly soluble | 50/50 |
| F9 | | 50 | A6 | 50 | Poorly soluble | 50/50 |
| F10 | | 50 | A7 | 50 | Poorly soluble | 50/50 |
| F11 | | 100 | | | Soluble | 50/50 |
| F12 | | | A4 | 100 | Soluble | 50/50 |
| F13 | | | A5 | 100 | Soluble | 50/50 |
| F14 | C3 | 50 | A5 | 50 | Soluble | 50/50 |

Example 2-1

Production of Wax Dispersion 20 parts by mass of paraffin wax (HNP-9, melting point: 75° C., made by Nippon Seiro Co., Ltd.) and 80 parts by mass of ethyl acetate were placed in a reaction vessel equipped with a cooling tube, a thermometer and an agitator, heated up to 78° C. for sufficient dissolution and then cooled for one hour down to 30° C. while agitating. Thereafter, the resultant was subjected to wet grinding by using an ULTRAVISCO Mill (made by Imex Co., Ltd.) under the following conditions: feeding speed, 1.0 kg/h; circumferential speed of disk, 10 m/s; loading amount of zirconia beads with the particle diameter of 0.5 mm, 80% by volume; and pass schedule, 6 times, thereby obtaining a wax dispersion.

Production of Toner Base Particles 82 parts by mass of the crystalline resin C2 and 82 parts by mass of ethyl acetate were placed in a container equipped with a thermometer and an agitator and heated up to a temperature higher than a melting point of the resin for sufficient dissolution. 30 parts by mass of the wax dispersion, 12 parts by mass of the colorant F1 and 47 parts by mass of ethyl acetate were added thereto and agitated at 50° C. by using a TK-type homomixer (made by Primix Corporation) at 10,000 rpm so as to be uniformly dissolved and dispersed, thereby obtaining an oil phase 2. It is noted that the oil phase 2 was kept at a temperature of 50° C. in the container and used within 5 hours after production thereof so as to prevent crystallization.

90 parts by mass of ion-exchanged water, 4 parts by mass of a 48.5% aqueous solution of dodecyldiphenyl ether sodium disulphonate (ELEMINOL MON-7 made by Sanyo Chemical Industries Ltd.) and 10 parts by mass of ethyl acetate were placed in another container equipped with an agitator and a thermometer, mixed and agitated at 40° C. to form an aqueous solution. 50 parts by mass of the oil phase 2 kept at 50° C. were added thereto and mixed at 40° C. to 50° C. for one minute by using a TK-type homomixer (made by Primix Corporation) at 13,000 rpm, thereby obtaining an emulsified slurry 2.

The emulsified slurry 2 was fed into a container equipped with an agitator and a thermometer. A solvent was removed at 60° C. for 6 hours, thereby obtaining a slurry 2.

100 parts by mass of the thus obtained slurry 2 of toner base particles were filtered under reduced pressure and, thereafter, the washing treatment was conducted as follows.

(1) 100 parts by mass of ion-exchanged water were added to a filter cake and mixed by using a TK-type homomixer (for 5 minutes at 6,000 rpm) and thereafter the resultant was filtered.

(2) 100 parts by mass of 10% by mass sodium hydroxide aqueous solution were added to the filter cake prepared in (1) and mixed by using the TK-type homomixer (for 10 minutes at 6,000 rpm) and thereafter the resultant was filtered under reduced pressure.

(3) 100 parts by mass of 10% by mass hydrochloric acid were added to the filter cake prepared in (2) and mixed by using the TK-type homomixer (for 5 minutes at 6,000 rpm) and the resultant was filtered.

(4) 300 parts by mass of ion-exchanged water were added to the filter cake prepared in (3) and mixed by using the TK-type homomixer (for 5 minutes at 6,000 rpm) and the resultant was filtered. The above procedure was conducted two times to obtain a filter cake 1.

The thus obtained filter cake 2 was dried at 45° C. for 48 hours by using a circulation dryer. Thereafter, the cake was sieved by using a mesh having an aperture of 75 μm to prepare toner base particles 2.

Addition of External Additive

Then, 1.0 part by mass of hydrophobic silica (HDK-2000, made by Wacker Chemie AG) was mixed with 100 parts by mass of the thus obtained toner base particles 2 by using a Henschel mixer, thereby preparing the toner of Example 2-1 with a volume average particle diameter of 5.8

Example 2-2 to Example 2-5

The toners of Example 2-2 to Example 2-5 were obtained in the same manner described in Example 2-1 except that in place of the colorant F1 in Example 2-1, the colorant F2 to the colorant F5 were respectively used.

Example 2-6

The toner of Example 2-6 was obtained in the same manner described in Example 2-1 except that in place of the colorant F1 in Example 2-1, 30 parts by mass of the colorant F6 were used and an added content of the crystalline resin C2 was changed to 64 parts by mass.

Example 2-7

The toner of Example 2-7 was obtained in the same manner described in Example 2-1 except that in place of the colorant F1 in Example 2-1, 50 parts by mass of the colorant F7 were used and an added content of the crystalline resin C2 was changed to 44 parts by mass.

Example 2-8

The toner of Example 2-8 was obtained in the same manner described in Example 2-1 except that in place of addition of 82 parts by mass of the crystalline resin C2 in Example 2-1, an added content of the crystalline resin C2 was changed to 61 parts by mass and 21 parts by mass of the non-crystalline resin A4 were added.

Example 2-9

The toner of Example 2-9 was obtained in the same manner described in Example 2-1 except that in place of addition of the crystalline resin C2 in Example 2-1, an added content of 82 parts by mass of the crystalline resin C2 was changed to 41 parts by mass and 41 parts by mass of the non-crystalline resin A4 were added.

Example 2-10

The toner of Example 2-10 was obtained in the same manner described in Example 2-1 except that in place of addition of 82 parts by mass of the crystalline resin C2 in Example 2-1, an added content of the crystalline resin C2 was changed to 21 parts by mass and 61 parts by mass of the non-crystalline resin A4 were added.

Example 2-11

The toner of Example 2-11 was obtained in the same manner described in Example 2-2 except that in place of addition of the colorant F2 in Example 2-2, the colorant was changed to the colorant F8.

Example 2-12

The toner of Example 2-12 was obtained in the same manner described in Example 2-2 except that in place of addition of the colorant F2 in Example 2-2, the colorant was changed to the colorant F9.

Example 2-13

The toner of Example 2-13 was obtained in the same manner described in Example 2-2 except that in place of addition of the colorant F2 in Example 2-2, the colorant was changed to the colorant F10.

Example 2-14

The toner of Example 2-14 was obtained in the same manner described in Example 2-2 except that in place of addition of the colorant F2 in Example 2-2, the colorant was changed to the colorant F11.

Comparative Example 2-1 to Comparative Example 2-3

The toners of Comparative example 2-1 to Comparative example 2-3 were obtained in the same manner described in Example 2-1 except that in place of the colorant F1 in Example 2-1, the colorants F12 to F14 were respectively used.

Comparative Example 2-4

The toner of Comparative example 2-4 was obtained in the same manner described in Example 2-1 except that in Example 2-1, the colorant F1 was not used but an added content of the crystalline resin C2 was changed to 86.2 parts by mass and 1.8 parts by mass of the non-crystalline resin A4 were added to prepare an oil phase.

Comparative Example 2-5

The toner of Comparative example 2-5 was obtained in the same manner described in Example 2-1 except that in place of addition of 82 parts by mass of the crystalline resin C2 used in Example 2-1, an added content of the crystalline resin C2 was changed to 21 parts by mass and 61 parts by mass of the non-crystalline resin A4 were added.

Table 7 collectively describes compositions of toners and others.

TABLE 7

| | | Binding resin | | Colorant | | Wax |
|---|---|---|---|---|---|---|
| | Toner No. | Types | Added content (parts by mass) | Types | Added content (parts by mass) | Added content (parts by mass) |
| Example 2-1 | Toner 29 | C2 | 82 | F1 | 12 | 5 |
| Example 2-2 | Toner 30 | C2 | 82 | F2 | 12 | 5 |
| Example 2-3 | Toner 31 | C2 | 82 | F3 | 12 | 5 |
| Example 2-4 | Toner 32 | C2 | 82 | F4 | 12 | 5 |
| Example 2-5 | Toner 33 | C2 | 82 | F5 | 12 | 5 |
| Example 2-6 | Toner 34 | C2 | 64 | F6 | 30 | 5 |
| Example 2-7 | Toner 35 | C2 | 44 | F7 | 50 | 5 |
| Example 2-8 | Toner 36 | C2 + A4 | 61 + 21 | F1 | 12 | 5 |
| Example 2-9 | Toner 37 | C2 + A4 | 41 + 41 | F1 | 12 | 5 |
| Example 2-10 | Toner 38 | C2 + A4 | 21 + 61 | F1 | 12 | 5 |
| Example 2-11 | Toner 39 | C2 | 82 | F8 | 12 | 5 |
| Example 2-12 | Toner 40 | C2 | 82 | F9 | 12 | 5 |
| Example 2-13 | Toner 41 | C2 | 82 | F10 | 12 | 5 |
| Example 2-14 | Toner 42 | C2 | 82 | F11 | 12 | 5 |
| Comparative example 2-1 | Toner 43 | C2 | 82 | F12 | 12 | 5 |
| Comparative example 2-2 | Toner 44 | C2 | 82 | F13 | 12 | 5 |
| Comparative example 2-3 | Toner 45 | C2 | 82 | F14 | 12 | 5 |

TABLE 7-continued

| | Toner No. | Binding resin Types | Binding resin Added content (parts by mass) | Colorant Types | Colorant Added content (parts by mass) | Wax Added content (parts by mass) |
|---|---|---|---|---|---|---|
| Comparative example 2-4 | Toner 46 | C2 + A4 | 86.2 + 1.8 | None | 12 | 5 |
| Comparative example 2-5 | Toner 47 | C2 + A4 | 21 + 61 | F1 | 12 | 5 |

<Sea-Island Structure>

After each of the prepared toners was buried into an epoxy resin, the resin was cut by using an ultramicrotome (ULTRACUT-S, Leica AG). Next, a transmission electron microscope (H7000, made by Hitachi, Ltd.) was used to observe a cross section of the toner to evaluate a dispersion state of pigments. Further, a thin section of the thus cut resin was dyed with ruthenium tetraoxide to observe similarly the cross section of the toner and also the sea-island structure to calculate the domain diameter of an island. To be more specific, a sum of longer diameters of the islands in 20 toners was subtracted by the number of the islands. The results are shown in Table 8 and Table 9.

<Storage Elastic Modulus at 160° C.>

A dynamic mechanical analyzer (ARES made by TA Instruments Japan Inc.) was used to measure a storage elastic modulus at 160° C. To be more specific, first, toner was molded into a pellet with a diameter of 8 mm and a thickness of 1 mm to 2 mm and thereafter fixed onto a parallel plate with a diameter of 8 mm. Then, the pellet was made stable at 40° C. and heated up to 200° C. at a temperature rising rate of 2.0° C./min under conditions of a frequency of 1 Hz (6.28 rad/s) and a distortion amount of 0.1% (distortion-amount controlling mode) for measurement of storage elastic modulus. The results are shown in Table 8 and Table 9.

<Degree of Crystallinity>

An X-ray diffractometer equipped with a two-dimensional detector (D8 DISCOVER with GADDS, made by Bruker Corporation) was used to measure the X-ray diffraction spectrum of toner.

As a capillary tube, there was used a 0.70 mm-across wire marker (Lindeman glass) to measure the degree of crystallinity, with the toner filled up to an upper part of the capillary tube. When the toner was filled, tapping was done 100 times.

The measurement was made under the following detailed conditions.

Tube current: 40 mA
Tube voltage: 40 kV
Goniometer 2θ axis: 20.0000°
Goniometer Ω axis: 0.0000°
Goniometer ϕ axis: 0.000°
Distance of detector: 15 cm (wide angle measurement)
Measurement range: 3.2≤2θ[°]≤37.2
Measurement time: 600 sec As an incident optical system, a collimeter having a 1 mm-across pin hole was used. The thus obtained two dimensional data was integrated by using available software (the x axis of 3.2° to 37.2°) and converted to one-dimensional data covering the diffraction intensity and 2θ. Hereinafter, a description will be given of a method for calculating the degree of crystallinity on the basis of the thus obtained X-ray diffraction spectrum.

Figure 7A:
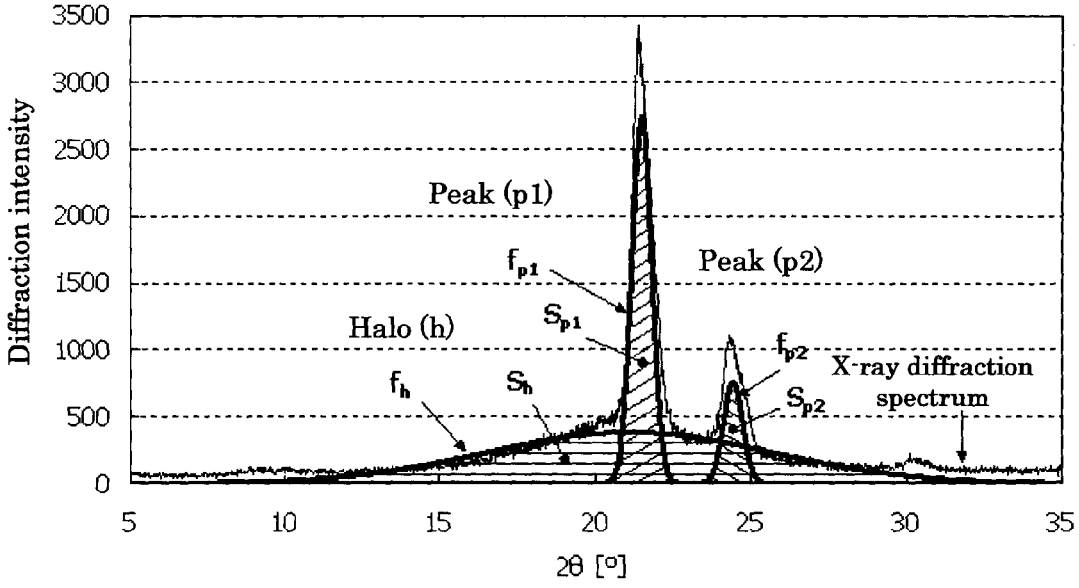
FIG. 7A is a view which shows one example of an X-ray diffraction spectrum of the toner.
Figure 7B:
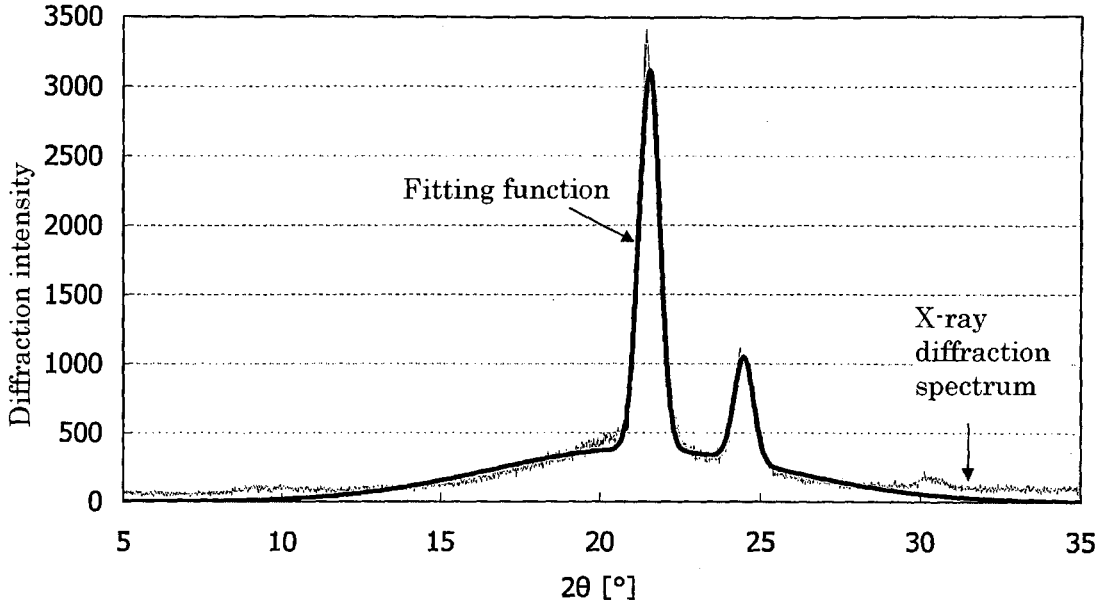

FIG. 7A and FIG. 7B show one example of the X-ray diffraction spectrum of toner. The horizontal axis indicates 2θ and the longitudinal axis indicates the intensity of X-ray diffraction, both of which are linear axes. In the X-ray diffraction spectrum shown in FIG. 7A, major peaks (p1, p2) are found at 2θ=21.3° and 24.2°. A halo (h) is found in a wide range including these two peaks. In this case, the major peaks are derived from a crystalline structure and the halo is derived from a non-crystalline structure.

The major peaks (p1, p2) and the (h) are expressed by the following Gaussian functions $$f_{p1}(2\theta)=a_{p1}\exp(-(2\theta-b_{p1})^2/(2c_{p1}^2))$$

$$f_{p2}(2\theta)=a_{p2}\exp(-(2\theta-b_{p2})^2/(2c_{p2}^2))$$

$$f_h(2\theta)=a_h\exp(-(2\theta-b_h)^2/(2c_h^2))$$

and a sum of these three functions of $f(2\theta)=f_{p1}(2\theta)+f_{p2}(2\theta)+f_h(2\theta)$ is given as a fitting function of an X-ray diffraction spectrum as a whole (refer to FIG. 7B) and fitting is done based on a least-square method.

There are nine fitting variables, that is, $a_{p1}$, $b_{p1}$, $c_{p1}$, $a_{p2}$, $b_{p2}$, $C_{p2}$, $a_h$, $b_h$, and $c_h$. As an initial value of each fitting variable, a value is set which is obtained by procedures in which peak positions of the X-ray diffraction spectrum (in FIG. 7A, $b_{p1}$=21.3, $b_{p2}$=24.2 and $b_h$=22.5) are respectively input to $b_{p1}$, $b_{p2}$ and $b_h$ and any appropriate values are input to other variables so as to match the major peaks and the halo with the X-ray diffraction spectrum as much as possible. Fitting can be done, for example, by using the solver of Excel 2003 (made by Microsoft Corporation).

The degree of crystallinity [%] was calculated from a formula $(S_{p1}+S_{p2})/(S_{p1}+S_{p2}+S_h)\times100$ by referring to integrated areas ($S_{p1}$, $S_{p2}$, $S_h$) respectively for the Gaussian functions $f_{p1}(2\theta)$ and $f_2(2\theta)$ corresponding to two major peaks (p1, p2) and the Gaussian function $f_{h1}(2\theta)$ corresponding to the halo after the fitting. The results are shown in Table 8 and Table 9.

Preparation of Developer

Each of the toners prepared in the Examples and Comparative examples was mixed with a carrier used in an image forming apparatus (imageo MP C4300, made by Ricoh Company Ltd.) so that the toner concentration was 5% by mass to prepare each developer.

<Hot Offset Resistance>

After a developer of each color (180 g) was fed into a unit of each color of an image forming apparatus (imageo MP C4300, made by Ricoh Company Ltd.), a fixing roller was heated so as to give a temperature of 120° C. on the surface thereof. Then, a solid image (2 cm×15 cm) was output on an A4-size long grain sheet of paper of T6000 70W (made by Ricoh Company Ltd.) so as to give a toner adhesion amount of 0.40 mg/cm$^2$ to evaluate the hot offset resistance by the following criteria. The results are shown in Table 8 and Table 9.

[Criteria]

Evaluation was made in such a manner that where an undeveloped image of the solid image was not fixed at a site other than a desired site, "A" was given, and where an undeveloped image of the solid image was fixed at a site other than a desired site, "B" was given.

<Image Density>

A developer was fed into a yellow unit of the image forming apparatus (IMAGEO MP C4300, made by Ricoh Company Ltd.) so that each of the developers was 180 g in mass.

Each of the developers was used to output a rectangular solid image with an area of 2 cm×15 cm on an A4-size long grain sheet of paper of T6000 70W (made by Ricoh Company Ltd.) so that toner content was 0.40 mg/cm$^2$ and the surface of the fixing roller was 120° C. Yellow toner, cyan toner and magenta toner on a fixed image were measured respectively for image density (ID) of yellow, that of cyan and that of magenta by using X-RITE 938 (made by X-Rite Incorporated) in a status A mode by d50 light. The results are shown in Table 8 and Table 9.

<Image Gloss Level>

An image forming apparatus (imageo MP C7500, made by Ricoh Company Ltd.) was used at a linear speed of 282 mm/s and at 160° C. on the surface of a fixing roller, by which a solid image with an area of 2 cm×15 cm was output on an A4-size long grain sheet of paper of T6000 70W (made by Ricoh Company Ltd.) so as to give a toner adhesion amount of 0.85 mg/cm$^2$. Then, evaluation was made for an image gloss level. In this case, according to JIS-Z8741, a gloss meter (VGS-1D, made by Nippon Denshoku Industries Co., Ltd.) was used to measure gloss level of the fixed image at 60°/60°. Evaluation was made based on the following criteria. The results are shown in Table 8 and Table 9.

[Criteria]

Evaluation was made in the following manner; where the gloss level was 10 or more, A was given, where the gloss level was 6 or more and less than 10, B was given, and where the gloss level was less than 6, C was given.

<Overall Evaluation>

A: The hot offset resistance was "A," the image gloss level was "A" or "B" and the image density was 1.20 or more.

B: The hot offset resistance was "B," the image gloss level was "C" or the image density was less than 1.20.

TABLE 8

| | Domain diameter of island in sea-island structure (μm) | Storage elastic modulus at 160° C. (Pa) | Degree of crystallinity (%) | Hot offset resistance | Image gloss level | Image density | Overall evaluation |
|---|---|---|---|---|---|---|---|
| Ex. 1-1 | 0.2 | $1.5 \times 10^4$ | 29 | A | B | 1.46 | A |
| Ex. 1-2 | 0.7 | $8.0 \times 10^3$ | 29 | A | B | 1.37 | A |
| Ex. 1-3 | 0.5 | $1.0 \times 10^4$ | 26 | A | A | 1.65 | A |
| Ex. 1-4 | 0.7 | $9.0 \times 10^3$ | 23 | A | A | 1.62 | A |
| Ex. 1-5 | 0.8 | $6.0 \times 10^3$ | 16 | A | A | 1.74 | A |
| Ex. 1-6 | 0.9 | $1.1 \times 10^3$ | 11 | A | B | 1.44 | A |
| Ex. 1-7 | 1.0 | $5.6 \times 10^3$ | 20 | A | B | 1.48 | A |
| Ex. 1-8 | 1.0 | $5.1 \times 10^3$ | 20 | A | A | 1.78 | A |
| Ex. 1-9 | 1.0 | $5.0 \times 10^3$ | 21 | A | A | 1.74 | A |
| Ex. 1-10 | 1.0 | $4.2 \times 10^3$ | 22 | A | A | 1.72 | A |
| Ex. 1-11 | 1.0 | $3.0 \times 10^3$ | 23 | A | A | 1.51 | A |
| Ex. 1-12 | 1.0 | $2.3 \times 10^3$ | 29 | A | B | 1.33 | A |
| Ex. 1-13 | 1.0 | $6.5 \times 10^3$ | 31 | A | B | 1.38 | A |
| Ex. 1-14 | 1.0 | $6.3 \times 10^3$ | 24 | A | A | 1.60 | A |
| Ex. 1-15 | 1.0 | $4.6 \times 10^3$ | 20 | A | A | 1.70 | A |
| Ex. 1-16 | 1.0 | $3.8 \times 10^3$ | 18 | A | A | 1.65 | A |
| Ex. 1-17 | 0.9 | $3.0 \times 10^3$ | 14 | A | B | 1.47 | A |
| Ex. 1-18 | 0.9 | $6.2 \times 10^3$ | 22 | A | A | 1.50 | A |
| Ex. 1-19 | 1.0 | $5.7 \times 10^3$ | 22 | A | A | 1.92 | A |
| Comp. Ex. 1-1 | — | — | 1 | B | C | 1.12 | B |
| Comp. Ex. 1-2 | 1.6 | $1.7 \times 10^4$ | 27 | A | C | 0.98 | B |
| Comp. Ex. 1-3 | 1.2 | $3.0 \times 10^4$ | 28 | A | C | 1.16 | B |
| Comp. Ex. 1-4 | — | $2.8 \times 10^4$ | 29 | A | C | 0.95 | B |
| Comp. Ex. 1-5 | — | $2.0 \times 10^4$ | 18 | A | C | 0.87 | B |
| Comp. Ex. 1-6 | — | $5.2 \times 10^4$ | 17 | B | C | 0.78 | B |
| Comp. Ex. 1-7 | — | $5.0 \times 10^4$ | 15 | B | C | 0.99 | B |
| Comp. Ex. 1-8 | 1.3 | $4.3 \times 10^4$ | 16 | A | C | 1.11 | B |
| Comp. Ex. 1-9 | 1.7 | $2.1 \times 10^4$ | 12 | A | C | 0.76 | B |

*In Table 8 "—" in Comp. Exs. 1-1 and 1-4 to 1-7 means "non-measurable."

TABLE 9

| | Domain diameter of island in sea-island structure (μm) | Storage elastic modulus at 160° C. (Pa) | Degree of crystallinity (%) | Hot offset resistance | Image gloss level | Image density | Overall evaluation |
|---|---|---|---|---|---|---|---|
| Ex. 2-1 | 0.4 | $0.7 \times 10^3$ | 29 | A | A | 1.52 | A |
| Ex. 2-2 | 0.6 | $0.5 \times 10^3$ | 28 | A | A | 1.57 | A |
| Ex. 2-3 | 0.5 | $0.8 \times 10^3$ | 29 | A | A | 1.54 | A |
| Ex. 2-4 | 0.7 | $0.6 \times 10^3$ | 28 | A | B | 1.41 | A |
| Ex. 2-5 | 0.8 | $0.8 \times 10^3$ | 28 | A | B | 1.45 | A |
| Ex. 2-6 | 0.3 | $0.9 \times 10^3$ | 26 | A | A | 1.71 | A |
| Ex. 2-7 | 0.3 | $1.1 \times 10^4$ | 24 | A | A | 1.68 | A |
| Ex. 2-8 | 0.7 | $1.5 \times 10^4$ | 17 | A | A | 1.55 | A |
| Ex. 2-9 | 0.8 | $1.5 \times 10^4$ | 16 | A | A | 1.75 | A |
| Ex. 2-10 | 0.6 | $1.5 \times 10^4$ | 17 | A | B | 1.37 | A |
| Ex. 2-11 | 0.8 | $0.9 \times 10^3$ | 26 | A | B | 1.49 | A |
| Ex. 2-12 | 0.7 | $0.8 \times 10^3$ | 27 | A | B | 1.48 | A |
| Ex. 2-13 | 0.6 | $1.3 \times 10^4$ | 28 | A | A | 1.45 | A |
| Ex. 2-14 | 0.8 | $0.6 \times 10^3$ | 26 | A | B | 1.24 | A |
| Comp. Ex. 2-1 | — | $0.7 \times 10^3$ | 27 | A | C | 0.98 | B |
| Comp. Ex. 2-2 | — | $0.8 \times 10^3$ | 29 | A | C | 0.99 | B |
| Comp. Ex. 2-3 | — | $0.4 \times 10^3$ | 27 | A | C | 1.11 | B |
| Comp. Ex. 2-4 | 1.4 | $0.2 \times 10^3$ | 30 | A | C | 0.00 | B |
| Comp. Ex. 2-5 | 1.8 | $2.3 \times 10^4$ | 11 | B | C | 0.85 | B |

*In Table 9 "—" in Comp. Exs. 2-1 to 2.3 means "non-measurable."

Aspects of the present invention include, for example, as follows.

<1> A toner, including:

a crystalline resin;

a non-crystalline resin; and a colorant, wherein the toner has a sea-island structure which includes: a sea containing the crystalline resin; and an island containing the non-crystalline resin and the colorant, wherein the island is 1.0 μm or less in domain diameter, and wherein the toner is $1.7 \times 10^4$ Pa or less in storage elastic modulus at 160° C.

<2> The toner according to <1>, wherein the toner has a degree of crystallinity of 15% or more.

<3> The toner according to <1> or <2>, wherein the crystalline resin contains, in a backbone thereof, a urethane bond, a urea bond, or both thereof.

<4> The toner according to any one of <1> to <3>, wherein the non-crystalline resin is poorly soluble in ethyl acetate, where the "poorly soluble" means that when 40 parts by mass of the non-crystalline resin is added to and mixed with 100 parts by mass of ethyl acetate, a mixture of the non-crystalline resin and the ethyl acetate yields a white turbidity at 50° C., or even when the mixture becomes a transparent solution without yielding a white turbidity at 50° C., the mixture yields a white turbidity after the mixture is allowed to stand for 12 hours at 50° C.

<5> The toner according to any one of <1> to <4>, wherein the non-crystalline resin has a weight-average molecular weight of 100,000 to 500,000.

<6> The toner according to any one of <1> to <5>, wherein the toner further includes a block copolymer containing a crystalline block and a non-crystalline block.

<7> The toner according to <6>, wherein the block copolymer is poorly soluble in ethyl acetate, where the "poorly soluble" means that when 40 parts by mass of the block copolymer is added to and mixed with 100 parts by mass of ethyl acetate, a mixture of the block copolymer and the ethyl acetate yields a white turbidity at 50° C., or even when the mixture becomes a transparent solution at 50° C. without yielding a white turbidity, the mixture yields a white turbidity after the mixture is allowed to stand for 12 hours at 50° C.

<8> The toner according to <6> or <7>, wherein the block copolymer has a glass transition temperature of 30° C. or less.

<9> The toner according to any one of <6> to <8>, wherein a content of the block copolymer in a total of the resins is 5% by mass to 20% by mass.

<10> The toner according to any one of <6> to <9>, wherein a mass ratio of the non-crystalline block to the crystalline block in the block copolymer is 1/9 or more but 9 or less.

<11> The toner according to any one of <1> to <10>, wherein the crystalline resin is a crystalline polyester.

<12> The toner according to any one of <6> to <11>, wherein the non-crystalline resin is a non-crystalline polyester, and the block copolymer contains a crystalline polyester block and a non-crystalline polyester block.

<13> The toner according to any one of <1> to <12>, wherein the crystalline resin contains a first crystalline resin and a second crystalline resin which is greater in weight-average molecular weight than the first crystalline resin, and wherein the second crystalline resin is obtained by elongating the first crystalline resin.

<14> A two-component developer, including:

the toner according to any one of <1> to <13>; and, a carrier.

<15> An image forming apparatus, including:

an electrostatic latent image bearing member;

a charging unit configured to charge a surface of the electrostatic latent image bearing member;

an exposure unit configured to expose the charged surface of the electrostatic latent image bearing member to light, to thereby form an electrostatic latent image;

a developing unit configured to develop the electrostatic latent image with a toner to form a visible image;

a transfer unit configured to transfer the developed visible image onto a recording medium to form an unfixed image; and, a fixing unit configured to fix the unfixed image on the recording medium, wherein the toner is the toner according to any one of <1> to <13>.

<16> The image forming apparatus according to <15>, wherein a transfer velocity of the recording medium upon fixing by the fixing unit is 280 mm/second or more.

REFERENCE SIGNS LIST

1: electrostatic latent image bearing member (photosensitive drum)
10: electrostatic latent image bearing member (photosensitive drum)
10K: electrostatic latent image bearing member for black
10Y: electrostatic latent image bearing member for yellow
10M: electrostatic latent image bearing member for magenta
10C: electrostatic latent image bearing member for cyan
14: supporting roller
15: supporting roller
16: supporting roller
17: intermediate transfer cleaning unit
18K, 18Y, 18M, 18C: image forming unit
21: exposure unit
22: secondary transfer unit
23: roller
24: secondary transfer belt
25: fixing unit
26: fixing belt
27: pressure roller
28: sheet reversing device
32: contact glass
33: first traveling body
34: second traveling body
35: imaging lens
36: reading sensor
40: developing device
49: registration roller
50: intermediate transfer body
52: separation roller
53: manual sheet feeding path
54: manual tray
55: changeover pawl
56: discharge roller
57: discharge tray
60: electrification device
61: developing device
62: transfer electrifier
63: cleaning unit
64: antistatic device
100: image forming apparatus
101: electrostatic latent image bearing member
102: charging unit
103: exposure unit
104: developing unit
105: recording medium
107: cleaning unit
108: transfer unit
120: tandem-type developing device
130: document counter
142: sheet feeding roller
143: paper bank
144: sheet feeding cassette
145: separation roller
146: sheet feeding path
147: transfer roller
148: sheet feeding path
150: copier main body
200: sheet feeding table
220: heating roller
230: pressure roller
300: scanner
400: automatic document feeder (ADF)
424: developing device
441: screw
442: developing sleeve
443: doctor blade
L: exposure

The invention claimed is:

1. A toner, comprising:

a crystalline resin;

a non-crystalline resin; and a colorant, wherein the toner has a sea-island structure which comprises a sea comprising the crystalline resin and an island comprising the non-crystalline resin and the colorant, the island is 1.0 μm or less in domain diameter, and the toner is $1.7\times10^4$ Pa or less in storage elastic modulus at 160° C., and wherein the crystalline resin comprises, in a backbone thereof, a urethane bond, a urea bond, or both thereof.

2. The toner according to claim 1, wherein the toner has a degree of crystallinity of 15% or more.

3. The toner according to claim 1, wherein the non-crystalline resin is poorly soluble in ethyl acetate, where the "poorly soluble" means that when 40 parts by mass of the non-crystalline resin is added to and mixed with 100 parts by mass of ethyl acetate, a mixture of the non-crystalline resin and the ethyl acetate yields a white turbidity at 50° C., or even when the mixture becomes a transparent solution without yielding a white turbidity at 50° C., the mixture yields a white turbidity after the mixture is allowed to stand for 12 hours at 50° C.

4. The toner according to claim 1, wherein the non-crystalline resin has a weight-average molecular weight of 100,000 to 500,000.

5. The toner according to claim 1, wherein the toner further comprises a block copolymer containing a crystalline block and a non-crystalline block.

6. The toner according to claim 5, wherein the block copolymer is poorly soluble in ethyl acetate, where the "poorly soluble" means that when 40 parts by mass of the block copolymer is added to and mixed with 100 parts by mass of ethyl acetate, a mixture of the block copolymer and the ethyl acetate yields a white turbidity at 50° C., or even when the mixture becomes a transparent solution at 50° C. without yielding a white turbidity, the mixture yields a white turbidity after the mixture is allowed to stand for 12 hours at 50° C.

7. The toner according to claim 5, wherein the block copolymer has a glass transition temperature of 30° C. or less.

8. The toner according to claim 5, wherein a content of the block copolymer in a total of the resins is 5% by mass to 20% by mass.

9. The toner according to claim 5, wherein a mass ratio of the non-crystalline block to the crystalline block in the block copolymer is 1/9 or more but 9 or less.

10. The toner according to claim 5, wherein the non-crystalline resin is a non-crystalline polyester, and the block copolymer contains a crystalline polyester block and a non-crystalline polyester block.

11. The toner according to claim 1, wherein the crystalline resin is a crystalline polyester.

12. The toner according to claim 1, wherein the crystalline resin contains a first crystalline resin and a second crystalline resin which is greater in weight-average molecular weight than the first crystalline resin, and wherein the second crystalline resin is obtained by elongating the first crystalline resin.

13. A two-component developer, comprising:

a toner; and, a carrier, wherein the toner comprises:

a crystalline resin, a non-crystalline resin, and a colorant, wherein the toner has a sea-island structure which comprises a sea containing the crystalline resin and an island comprising the non-crystalline resin and the colorant, the island is 1.0 μm or less in domain diameter, and the toner is $1.7\times10^4$ Pa or less in storage elastic modulus at 160° C., and wherein the crystalline resin comprises, in a backbone thereof, a urethane bond, a urea bond, or both thereof.

14. An image forming apparatus, comprising:

an electrostatic latent image bearing member;

a charging unit configured to charge a surface of the electrostatic latent image bearing member;

an exposure unit configured to expose the charged surface of the electrostatic latent image bearing member to light, to thereby form an electrostatic latent image;

a developing unit configured to develop the electrostatic latent image with a toner to form a visible image;

a transfer unit configured to transfer the developed visible image onto a recording medium to form an unfixed image; and, a fixing unit configured to fix the unfixed image on the recording medium, wherein the image forming apparatus comprises the toner, and wherein the toner comprises:

a crystalline resin;

a non-crystalline resin; and a colorant, wherein the toner has a sea-island structure which comprises a sea comprising the crystalline resin and an island comprising the non-crystalline resin and the colorant, the island is 1.0 μm or less in domain diameter, and the toner is $1.7\times10^4$ Pa or less in storage elastic modulus at 160° C., and wherein the crystalline resin comprises, in a backbone thereof, a urethane bond, a urea bond, or both thereof.

* * * * *